US009994392B1

(12) United States Patent
Stravitz

(10) Patent No.: US 9,994,392 B1
(45) **Date of Patent: *Jun. 12, 2018**

(54) UNITARY INSERT FOR WASTE CONTAINERS

(71) Applicant: David M Stravitz, New York, NY (US)

(72) Inventor: David M Stravitz, New York, NY (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/668,414

(22) Filed: Aug. 3, 2017

Related U.S. Application Data

(60) Continuation of application No. 15/413,163, filed on Jan. 23, 2017, now Pat. No. 9,745,127, which is a continuation-in-part of application No. 14/709,878, filed on May 12, 2015, now Pat. No. 9,555,962, which is a continuation-in-part of application No. 14/537,044, filed on Nov. 10, 2014, now Pat. No. 9,181,028, which is a division of application No. 14/109,270, filed on Dec. 17, 2013, now Pat. No. 8,910,821, said application No. 15/413,163 is a continuation-in-part of application No. 14/935,835, filed on Nov. 9, 2015, now Pat. No. 9,573,757, which is a continuation-in-part of application No. 14/709,878, filed on May 12, 2015, now Pat. No.
(Continued)

(51) Int. Cl.
*B65F 1/06* (2006.01)
*B65F 1/14* (2006.01)
*B65B 67/12* (2006.01)

(52) U.S. Cl.
CPC ..... *B65F 1/06* (2013.01); *B65F 1/1415* (2013.01)

(58) Field of Classification Search
CPC ..... B09B 3/0025; B09B 3/0075; B65B 9/15; B65B 67/1277; B65B 67/12; B65B 67/1205; B65B 67/1211; B65B 67/1216; B65B 67/1222; B65B 67/1227; B65B 67/1233; B65F 7/00; B65F 1/062; B65F 1/1607; B65F 1/16; B65F 1/06; B65F 1/14; B65F 1/04; B65D 2251/1016; A01M 1/2055
USPC ..... 248/99–101; 220/833, 834, 908, 908.1, 220/495, 8, 495.06, 320, 315, 324
See application file for complete search history.

(56) References Cited

U.S. PATENT DOCUMENTS 1,719,185 A 7/1929 Lowy
2,434,238 A 1/1948 Wolfson
(Continued)

*Primary Examiner* — Andrew Perreault
(74) *Attorney, Agent, or Firm* — Brian Roffe

(57) ABSTRACT

Waste container includes a base defining a waste-receiving compartment, and an insert supported on the base and adapted to engage a peripheral edge of a bag that extends into the compartment while maintaining an opening of the bag unobstructed. The insert has at least one bag-engagement edge. A movable closure component has a first engagement position in which the closure component engages with the insert to press the bag when present against the bag-engagement edge(s) of the insert, and a second non-engagement position in which the closure component is separated from the bag-engagement edge(s) of the insert. A lid is attached to the base and movable between a first, closed position covering the opening of the bag and a second, open position in which it does not obstruct the opening of the bag.

20 Claims, 54 Drawing Sheets

Related U.S. Application Data

9,555,962, which is a continuation-in-part of application No. 14/537,044, filed on Nov. 10, 2014, now Pat. No. 9,181,028, which is a division of application No. 14/109,270, filed on Dec. 17, 2013, now Pat. No. 8,910,821, said application No. 14/935,835 is a continuation-in-part of application No. 14/537,044, filed on Nov. 10, 2014, now Pat. No. 9,181,028, which is a division of application No. 14/109,270, filed on Dec. 17, 2013, now Pat. No. 8,910,821.

(60) Provisional application No. 61/881,386, filed on Sep. 23, 2013.

(56) References Cited

U.S. PATENT DOCUMENTS

| | | | | |
|---|---|---|---|---|
| 2,793,373 | A | 5/1957 | Ewing | |
| 3,204,866 | A * | 9/1965 | Brighton | B65F 1/06 232/43.2 |
| 3,214,065 | A | 10/1965 | Thornton | |
| 4,427,110 | A | 1/1984 | Shaw, Jr. | |
| 4,765,579 | A * | 8/1988 | Robbins, III | B65F 1/06 220/495.04 |
| 4,902,482 | A | 2/1990 | Faust | |
| 4,955,566 | A | 9/1990 | Blocih | |
| 5,174,462 | A | 12/1992 | Hames | |
| D334,975 | S | 4/1993 | Bunce et al. | |
| 5,520,303 | A | 5/1996 | Bernstein et al. | |
| 5,556,063 | A | 9/1996 | Boyd | |
| 5,836,553 | A | 11/1998 | Bergaila | |
| 5,988,520 | A | 11/1999 | Bitner | |
| 6,206,221 | B1 | 3/2001 | Bando et al. | |
| D457,283 | S | 5/2002 | Wayt | |
| 6,540,103 | B2 | 4/2003 | Silvers | |
| 6,612,099 | B2 | 9/2003 | Stravitz | |
| D485,404 | S | 1/2004 | Del Prato | |
| 6,679,462 | B1 | 1/2004 | Valdez | |
| 6,804,930 | B2 | 10/2004 | Stravitz | |
| 6,837,394 | B2 | 1/2005 | Nnamani | |
| 6,851,251 | B2 | 2/2005 | Stravitz | |
| 6,904,867 | B2 | 6/2005 | Zamjahn | |
| 6,974,029 | B2 | 12/2005 | Morand et al. | |
| 7,086,569 | B2 | 8/2006 | Stravitz | |
| 7,114,314 | B2 | 10/2006 | Stravitz | |
| 7,146,785 | B2 | 12/2006 | Stravitz | |
| D537,598 | S | 2/2007 | Moore | |
| 7,225,943 | B2 | 6/2007 | Yang et al. | |
| 7,316,100 | B2 | 1/2008 | Stravitz et al. | |
| 7,406,814 | B2 | 8/2008 | Morand | |
| 7,434,377 | B2 | 10/2008 | Stravitz et al. | |
| 7,503,152 | B2 | 3/2009 | Stravitz et al. | |
| 7,503,159 | B2 | 3/2009 | Stravitz et al. | |
| 7,516,865 | B1 | 4/2009 | Pierre | |
| 7,543,716 | B2 | 6/2009 | Lin | |
| D596,364 | S | 7/2009 | Morand | |
| 7,617,659 | B2 | 11/2009 | Stravitz et al. | |
| 7,696,711 | B2 | 4/2010 | Pollack et al. | |
| 7,708,188 | B2 | 5/2010 | Stravitz et al. | |
| 7,712,285 | B2 | 5/2010 | Stravitz et al. | |
| D619,905 | S | 7/2010 | Dunn et al. | |
| 7,878,359 | B1 | 2/2011 | Ko | |
| 7,931,150 | B2 | 4/2011 | Morand | |
| D639,002 | S | 5/2011 | Dunn et al. | |
| D639,003 | S | 5/2011 | Dunn et al. | |
| D639,004 | S | 5/2011 | Dunn et al. | |
| 7,963,414 | B1 | 6/2011 | Stravitz | |
| D652,189 | S | 1/2012 | Morand | |
| D654,738 | S | 2/2012 | Morand | |
| 8,127,519 | B2 | 3/2012 | Stravitz | |
| D657,107 | S | 4/2012 | Fitzpatrick et al. | |
| 8,215,089 | B2 | 7/2012 | Stravitz | |
| 8,235,237 | B1 | 8/2012 | Stravitz | |
| 8,266,871 | B1 | 9/2012 | Stravitz | |
| 8,393,489 | B1 | 3/2013 | Stravitz | |
| 8,567,157 | B2 | 10/2013 | Dunn et al. | |
| 8,635,838 | B2 | 1/2014 | Dunn et al. | |
| 8,647,587 | B2 | 2/2014 | Dunn et al. | |
| 8,657,139 | B1 | 2/2014 | Bodine | |
| 8,690,017 | B2 | 4/2014 | Dunn et al. | |
| 8,739,501 | B2 | 6/2014 | Dunn et al. | |
| 8,752,724 | B2 | 6/2014 | Babikian et al. | |
| 8,833,592 | B2 | 9/2014 | Dunn et al. | |
| 8,834,023 | B1 | 9/2014 | Laera | |
| 8,844,751 | B2 | 9/2014 | Sakaguchi et al. | |
| 8,899,420 | B2 | 12/2014 | Morand | |
| 8,910,821 | B1 | 12/2014 | Stravitz | |
| 8,959,880 | B2 | 2/2015 | Morand | |
| 8,973,774 | B1 | 3/2015 | Stravitz | |
| D728,184 | S | 4/2015 | Hoggatt et al. | |
| 9,085,404 | B2 | 7/2015 | Dunn et al. | |
| D766,534 | S | 9/2016 | Stravitz | |
| D777,394 | S | 1/2017 | Stravitz | |
| D797,393 | S | 9/2017 | Stravitz | |
| 2002/0051739 | A1 | 5/2002 | Wang | |
| 2003/0085227 | A1 | 5/2003 | Azzarello | |
| 2005/0056649 | A1 | 3/2005 | Simonson et al. | |
| 2008/0134644 | A1 | 6/2008 | Knuth et al. | |
| 2008/0264948 | A1 | 10/2008 | Kovacevich et al. | |
| 2009/0046955 | A1 | 2/2009 | Schember et al. | |
| 2010/0005762 | A1 | 1/2010 | Stravitz | |
| 2010/0140423 | A1 | 6/2010 | Davies et al. | |
| 2011/0099958 | A1 | 5/2011 | Dunn et al. | |
| 2012/0211494 | A1 | 8/2012 | Morand | |
| 2013/0181000 | A1 | 7/2013 | Miksovsky et al. | |
| 2013/0252534 | A1 | 9/2013 | Smith | |
| 2014/0027452 | A1 | 1/2014 | Pan | |
| 2014/0042168 | A1 | 2/2014 | Dunn et al. | |

* cited by examiner

FIG. 37
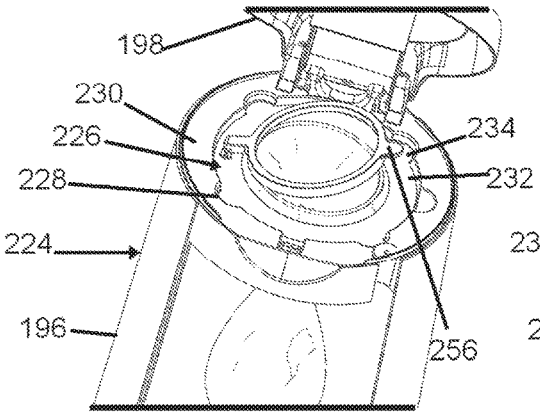
FIG. 38
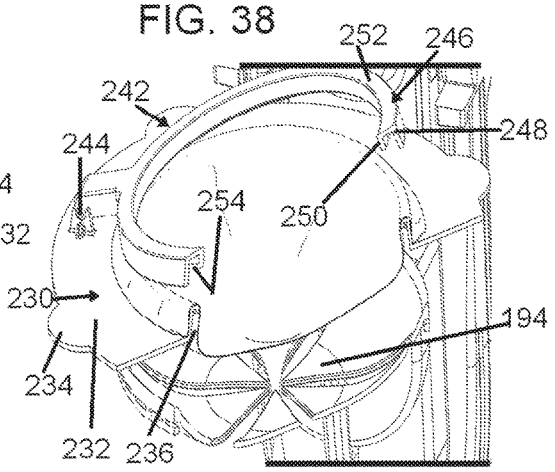
FIG. 39
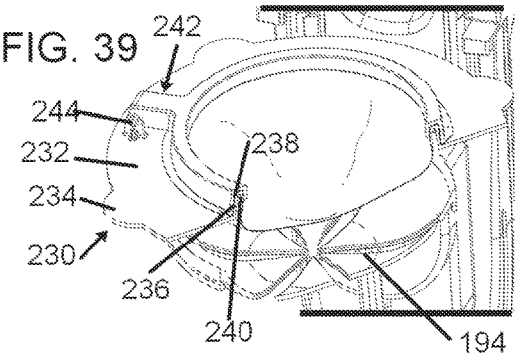
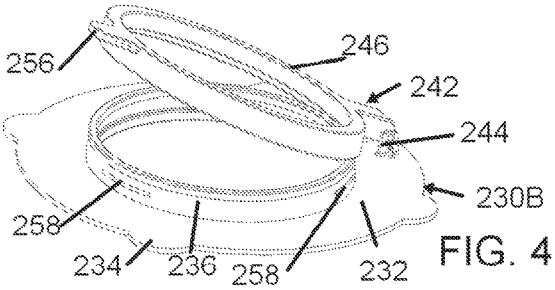
FIG. 41
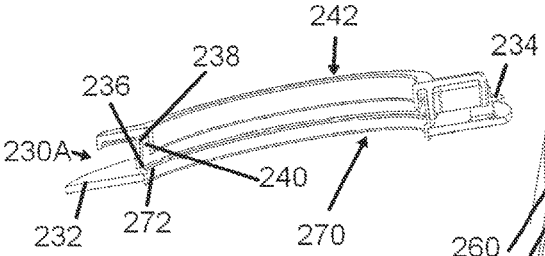
FIG. 40
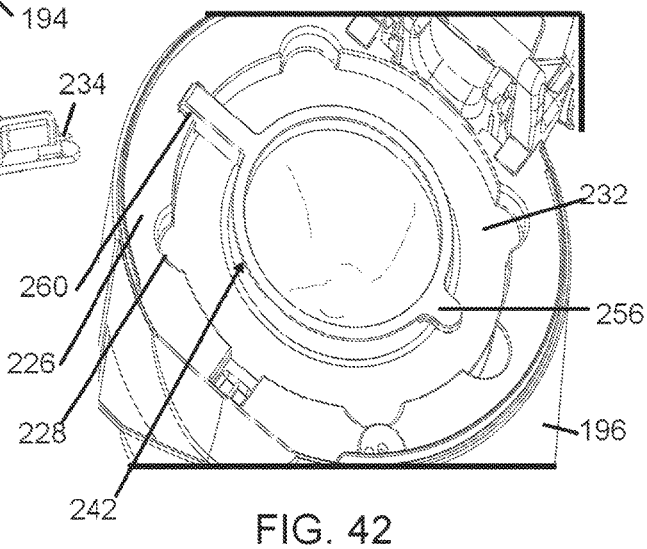
FIG. 42

FIG. 45
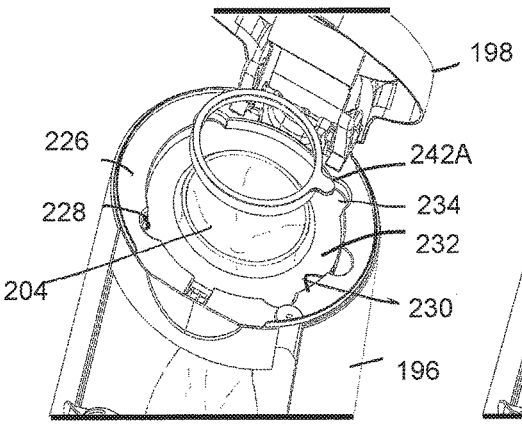
FIG. 46
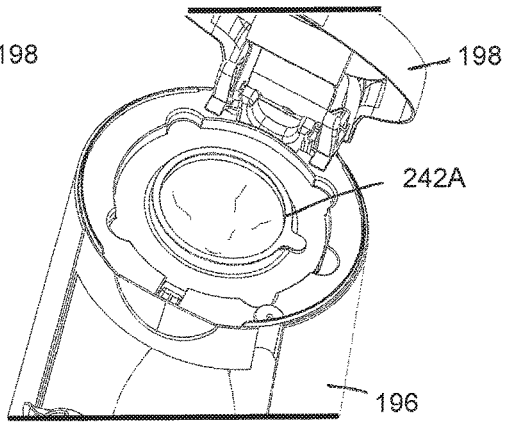
FIG. 47
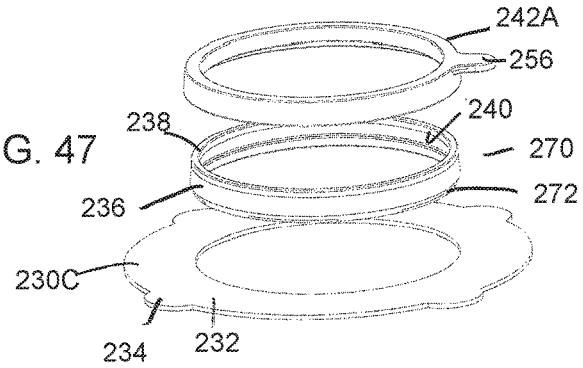
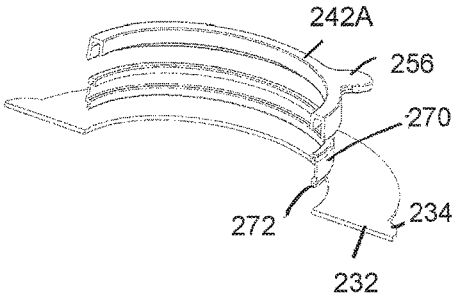
FIG. 48

FIG. 49
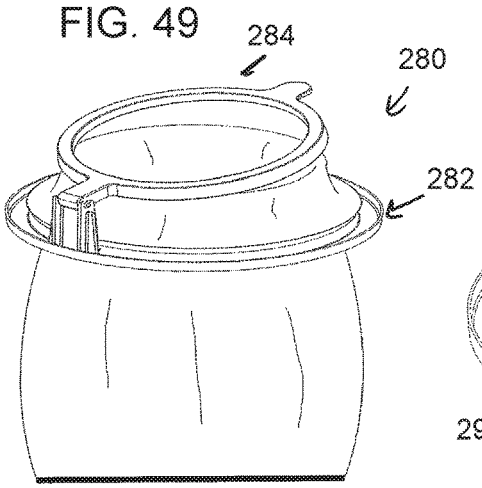
FIG. 50
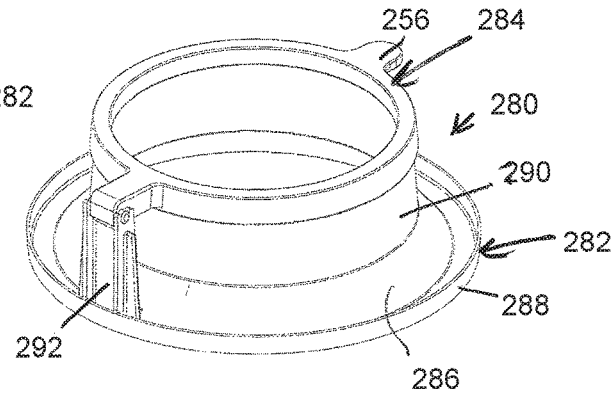
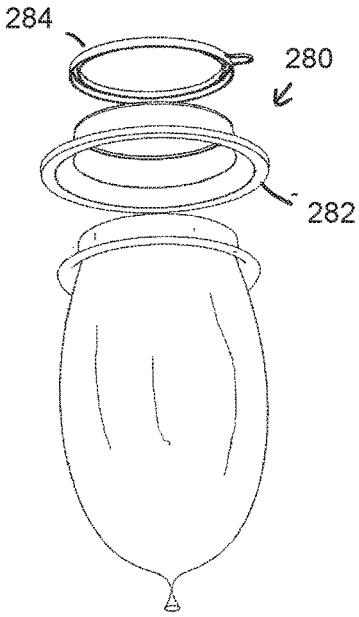
FIG. 51

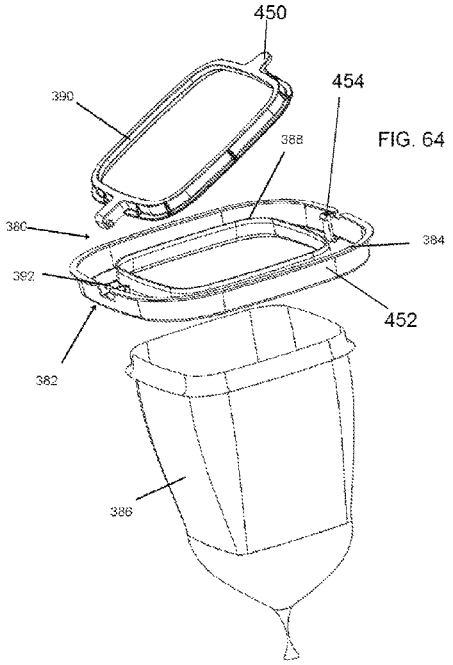
FIG. 64
FIG. 65
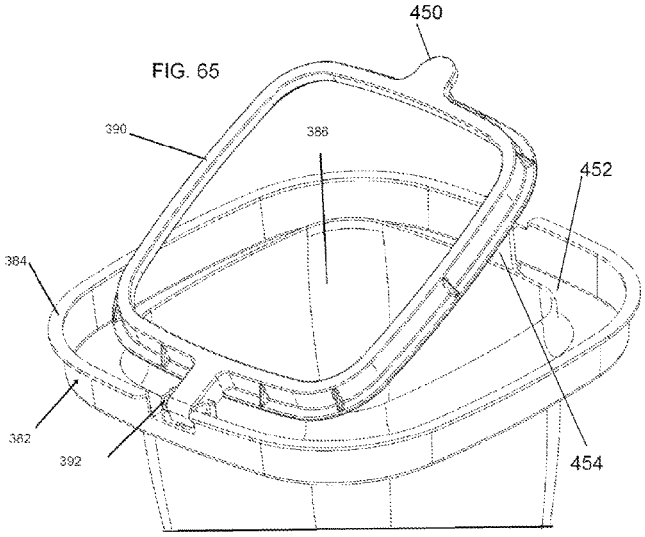

UNITARY INSERT FOR WASTE CONTAINERS

CROSS-REFERENCE TO RELATED APPLICATIONS

This application is a continuation of U.S. patent application Ser. No. 15/413,163 filed Jan. 23, 2017 which is:

a continuation-in-part (CIP) of U.S. patent application Ser. No. 14/709,878 filed May 12, 2015, now U.S. Pat. No. 9,555,962, which is a CIP of U.S. patent application Ser. No. 14/537,044 filed Nov. 10, 2014, now U.S. Pat. No. 9,181,208, which is a divisional of U.S. patent application Ser. No. 14/109,270 filed Dec. 17, 2013, now U.S. Pat. No. 8,910,821, which claims priority under 35 U.S.C. § 119 of U.S. provisional patent application Ser. No. 61/881,386 filed Sep. 23, 2013; and a CIP of U.S. patent application Ser. No. 14/935,835 filed Nov. 9, 2015, now U.S. Pat. No. 9,573,757, which is:

- a CIP of U.S. patent application Ser. No. 14/537,044 filed Nov. 10, 2014, now U.S. Pat. No. 9,181,208, which is a divisional of U.S. patent application Ser. No. 14/109,270 filed Dec. 17, 2013, now U.S. Pat. No. 8,910,821, which claims priority under 35 U.S.C. § 119 of U.S. provisional patent application Ser. No. 61/881,386 filed Sep. 23, 2013; and
- a CIP of U.S. patent application Ser. No. 14/709,878 filed May 12, 2015, now U.S. Pat. No. 9,555,962, which is a CIP of U.S. patent application Ser. No. 14/537,044 filed Nov. 10, 2014, now U.S. Pat. No. 9,181,208, which is a divisional of U.S. patent application Ser. No. 14/109,270 filed Dec. 17, 2013, now U.S. Pat. No. 8,910,821, which claims priority under 35 U.S.C. § 119 of U.S. provisional patent application Ser. No. 61/881,386 filed Sep. 23, 2013, all of which are incorporated by reference herein.

FIELD OF THE INVENTION

The present invention relates generally to waste disposal devices that may be used for any type of waste, including but not limited to, cat litter, medical waste from hospitals, doctors' offices, home health care personnel and facilities, nursing homes, biohazard laboratories, diapers, general household waste, disposables and the like, and include structure that securely retains or traps a bag so that the bag does not fall into the waste receptacle when waste is inserted.

The present invention also relates generally to waste treatment components for various uses, including for use in a waste disposal device that may be used for any type of waste, including but not limited to, cat litter, medical waste from hospitals, doctors' offices, home health care personnel and facilities, nursing homes, biohazard laboratories, diapers, general household waste, disposables and the like.

BACKGROUND OF THE INVENTION

Waste disposal devices are common in hospitals, doctors' offices, kitchens and other household locations and other locations where waste is generated and must be disposed of in a sanitary manner Waste disposal devices are also often used to dispose of household waste, cat litter and other pet waste. If the waste emits odors, the waste disposal device should also contain odors emanating from the waste.

Some waste disposal devices include a dispenser that dispenses tubing, and therefore include an internal ring-shaped flange on which a tubular core or cartridge rests and houses a continuous length of flexible, substantially non-resilient plastic tubing. A knot is tied at one end and the continuous tubing is pulled down to the bottom of the pail to form a bag for inserting one diaper after another until the bag is full. When full, you cut the top of the bag with a built in blade and then tie a knot in the open area for subsequent removal. This procedure is once again repeated—tie the knot-fill the bag-remove the bag, etc. When the canister is depleted of bag lengths, one replaces the canister. Canisters are costly and require changing regularly.

Another disposal device utilizes a single use bag sealed at one end and is welded to a foldable plastic header at the open end. The header when opened flat rests securely in the pail to accept diapers as they fill up. Once full, the plastic header folds to seal the upper open area and at the same time forms a handle for convenient removal. These polypropylene living hinge headers are wasteful, costly to produce and require welding or bonding them to a one time use bag.

Numerous waste disposal devices exist including those disclosed in U.S. Pat. Nos. 6,612,099, 6,804,930, 6,851,251, 7,086,569, 7,114,314, 7,146,785, 7,316,100, 7,434,377, 7,503,152, 7,503,159, 7,617,659, 7,708,188, 7,712,285, 7,963,414, 8,127,519, 8,215,089, 8,235,237, 8,266,871, 8,973,774 and all of which are incorporated by reference herein. Additionally, innovative waste disposal devices are disclosed in U.S. patent application Ser. No. 12/172,715 filed Jul. 14, 2008, now abandoned, Ser. No. 13/172,976 filed Jun. 30, 2011, now abandoned, and Ser. No. 13/270,697 filed Oct. 11, 2011, now abandoned, all of which are incorporated by reference herein.

Some of these waste disposal devices include a base defining a waste-receiving compartment and a lid pivotally connected to the base. When the lid is opened, a bag becomes visible and waste is inserted into an opening of the bag. The bag often passes through a membrane that requires force to insert the waste, and also serves to close the bag above the waste providing a barrier to waste and odor outflow. In some waste disposal devices, the bag is actually part of an accordion-folded length of flexible tubing that is housed in a cartridge.

Further, some of these waste disposal devices include a step or foot pedal assembly to complement or replace the manual opening and closing of the lid. The foot pedal assembly includes a depressible foot pedal and a spring, and is arranged to cause both opening of the lid when the foot pedal is depressed and closure of the lid when the pressing force is removed. The spring is moved against its bias upon depression of the foot pedal and returns to its original state when the pressing force is removed to thereby cause closure of the lid and rotation of the twisting mechanism.

SUMMARY OF THE INVENTION

An insert assembly for supporting a bag of a waste disposal device or other container in accordance with the invention includes a lower bag support structure defining an aperture and having a substantially planar portion around the aperture and at least one bag-engagement surface on an upper side of the planar portion, and an upper bag support structure having a first state in which the upper bag support structure is connected to the lower bag support structure along a periphery of the planar portion of the lower bag support structure and also engages with the bag-engagement surface(s) of the lower bag support structure inward of the periphery of the planar portion of the lower bag support structure. This provides multiple engagement locations between the upper and lower bag support structures. The upper bag support structure has a second state in which the upper bag support structure is connected to the lower bag support structure along the periphery of the planar portion of the lower bag support structure and does not engage with the bag-engagement surface(s) of the lower bag support structure inward of the periphery of the lower bag support structure. In this state, insertion and removal of a bag is possible, between the upper and lower bag support structures inward of the periphery of the planar portion of the lower bag support structure. The insert exerts pressure to retain the bag between the upper and lower bag support structures when the upper bag support structure is in the first state with the upper bag support structure engaging with the bag-engagement surface(s) of the lower bag support structure inward of the periphery of the planar portion of the lower bag support structure. The upper and lower bag support structures are a unitary structure when the upper bag support structure is connected to the lower bag support structure along the periphery of the planar portion of the lower bag support structure. To this end, an attachment structure is arranged in connection with the upper and lower bag support structures and enables the upper bag support structure to move between the first and second states.

Another way to view the invention is as including a lower bag support structure defining an aperture and including at least one bag-engagement surface on an upper side, an upper bag support structure including at least one bag-engagement wall, and an attachment structure arranged in connection with the upper and lower bag support structures and configured to enable the upper bag support structure to pivot relative to the lower bag support structure. The attachment structure enables the insert to have a first state in which the bag-engagement wall(s) of the upper bag support structure is engaged with the bag-engagement edge(s) of the lower bag support structure while the attachment structure connects the upper and lower bag support structures together and to have a second state in which the bag-engagement wall(s) of the upper bag support structure is not engaged with the bag-engagement edge(s) of the lower bag support structure while the attachment structure connects the upper and lower bag support structures together. The insert exerts pressure to retain a bag between the upper and lower bag support structures when the insert is in the first state with the bag-engagement wall(s) of the upper bag support structure engaged with the bag-engagement edge(s) of the lower bag support structure. The upper and lower bag support structures are a unitary structure when the upper bag support structure is connected to the lower bag support by the attachment structure.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein:

FIG. 37 shows another embodiment of a waste container in accordance with the invention with a closure component in a non-engagement position;

FIG. 38 is a partial cross-section of FIG. 37;

FIG. 39 is a partial cross-section of FIG. 37 but showing the closure component in an engagement position;

FIG. 40 is a cross-section of the insert of FIG. 37;

FIG. 41 is a perspective view of an alternative embodiment of an insert for a waste container in accordance with the invention;

FIG. 42 is a perspective view of another embodiment of a waste container similar to that shown in FIG. 37 but with a different attachment of the closure component;

FIG. 45 is a perspective view of an alternative embodiment of an insert for a waste container in accordance with the invention shown with the closure component in a non-engagement position;

FIG. 46 is a perspective view of the embodiment shown in FIG. 46 with the closure component in an engagement position;

FIG. 47 is an exploded view of the insert of FIGS. 45 and 46:

FIG. 48 is a cross-section of the insert shown in FIG. 47;

FIG. 49 is a view of a bag securing assembly with a bag in accordance with the invention;

FIG. 50 is a view of the bag securing assembly shown in FIG. 49;

FIG. 51 is an exploded view of the bag securing assembly with a bag as shown in FIG. 49;

FIG. 64 is a perspective, exploded view of another embodiment of an insert in accordance with the invention shown with a bag;

FIG. 65 is an assembled view of the insert shown in FIG. 64;

DETAILED DESCRIPTION OF THE INVENTION

Figure 1:
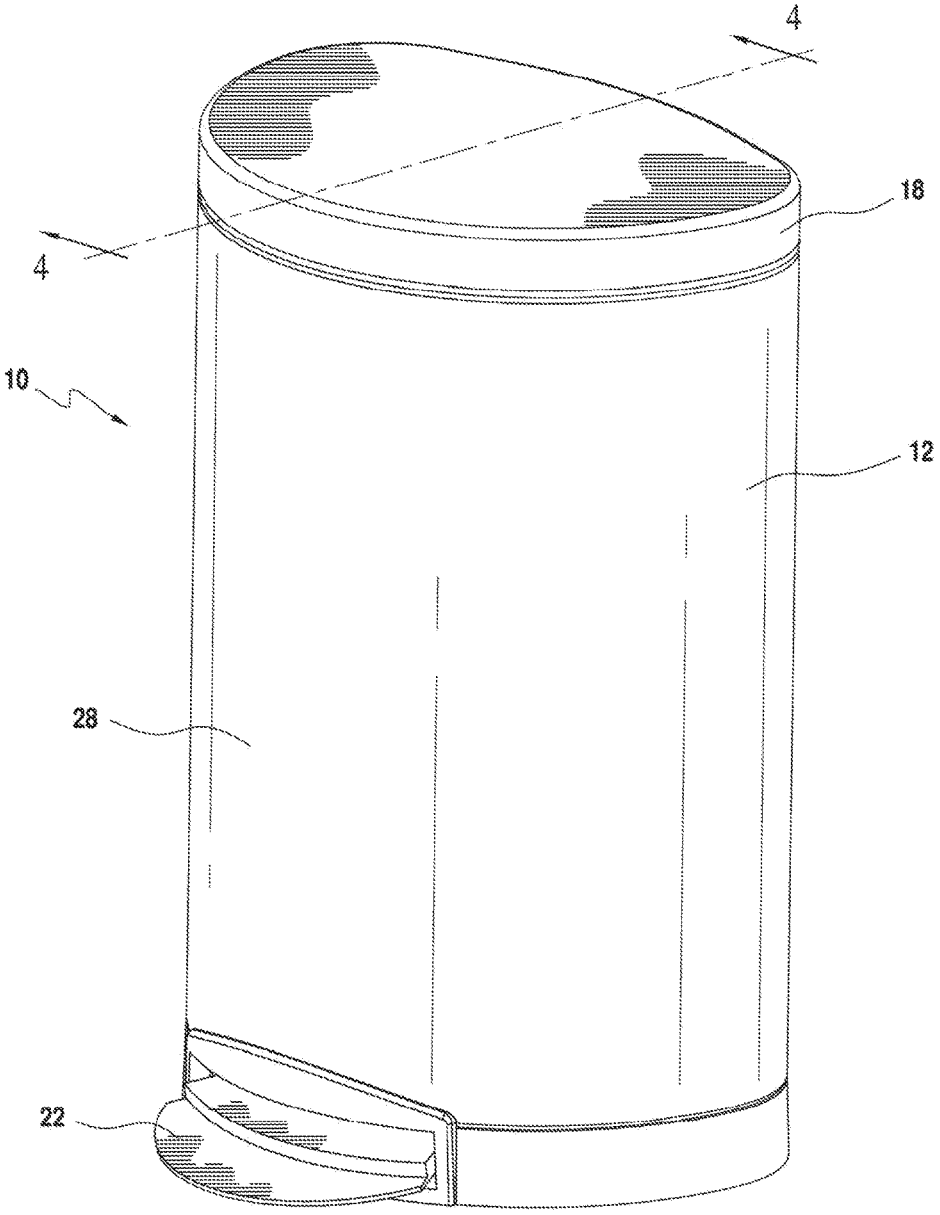
FIG. 1 is a perspective view of a first embodiment of a waste container in accordance with the invention shown with its lid in a closed state.

Referring to the accompanying drawings wherein like reference numerals refer to the same or similar elements, a first embodiment of a waste container in accordance with the invention is shown in FIGS. 1-6 and is designated generally as 10. Container 10 includes a base 12 defining a waste-receiving compartment 14 and an opening 16 communicating with the waste-receiving compartment 14 (see FIGS. 4 and 5). A lid 18 is movably attached to the base 12 and moves between a first position covering the opening 16, i.e., prevents insertion of waste into the waste-receiving compartment 14 (see FIG. 4) and a second position in which it does not obstruct the opening 16, i.e., enables insertion of waste (see FIG. 2).

The lid 18 may be pivotally mounted to a rear, upper edge of the base 12 by any type of pivotal mounting mechanism 20. Generally, the pivotal mounting mechanism 20 would include one or more parts on the base 12 and one or more cooperating parts on the lid 18. Instead of a pivotal mounting mechanism, another type of mechanism that enables the lid 18 to move while mounted to the base 12 between a closed position shown in FIG. 1 and an open position shown in FIG. 2 may be used in the invention, including any known to those skilled in the art of waste containers. Such a mechanism will be referred to herein as a lid mounting mechanism or lid mounting means.

Figure 2:
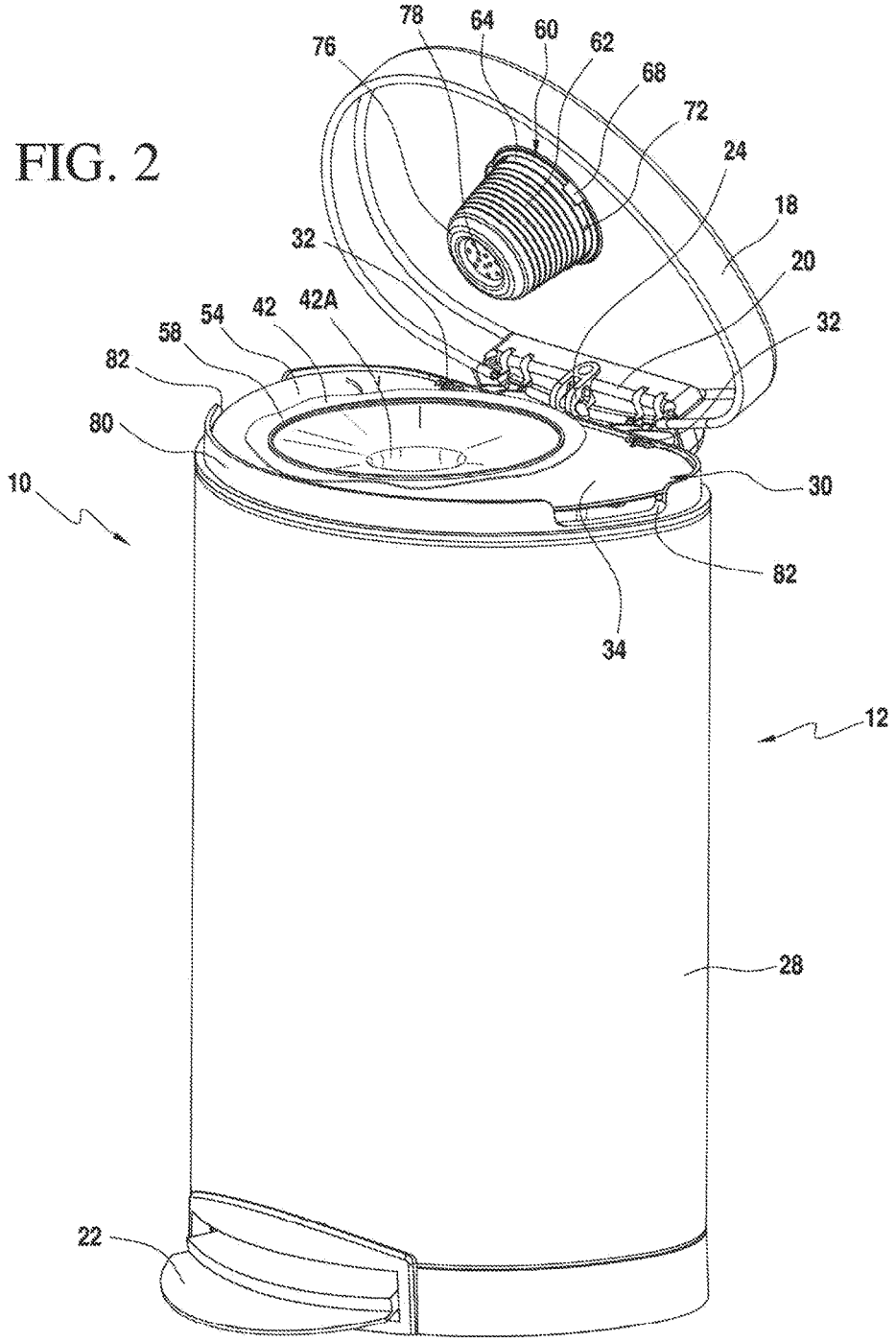
FIG. 2 is a perspective view of the waste container shown in FIG. 1 with its lid in an open and ready-for-use state.

Container 10 also includes a depressible pedal 22 that is coupled to the lid 18 and controls movement of the lid 18 between the closed position shown in FIG. 1 and the open position shown in FIG. 2. As shown, pedal 22 is a foot pedal having a first, undepressed state shown in FIG. 1 wherein it is slightly elevated from a plane defined by the lower surface of the base to enable depression thereof. When depressed into the state shown in FIG. 2, the coupling between the foot pedal 22 and the lid 18 causes the lid 18 to open. When pressure on the foot pedal 22 is released, the lid 18 closes. This coupling between the foot pedal 22 and the lid 18 to convert depression of the foot pedal 22 into opening movement of the lid 18 may be any coupling used in containers known to those skilled in the art. A portion of this coupling mechanism, also potentially referred to as coupling means herein, is shown at 24 in FIGS. 2 and 3, and includes a horizontal actuating member 26 shown in FIG. 4. The coupling mechanism may be as described in U.S. Pat. No. 8,393,489 (Stravitz), incorporated by reference herein.

Figure 3:
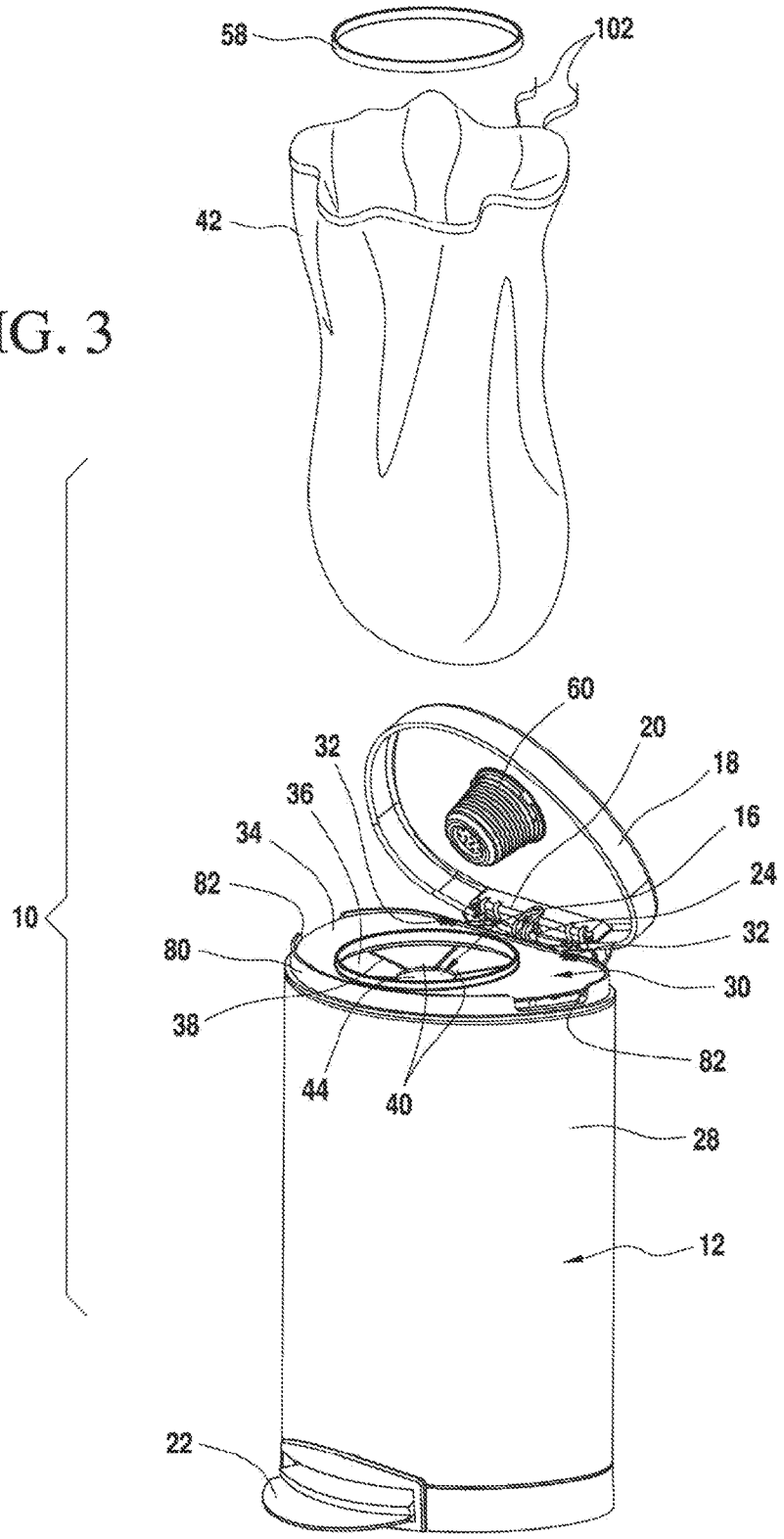
FIG. 3 is a perspective view of the waste container shown in FIG. 1 with its lid in an open state and a bag assembly separated from the container.
Figure 6:
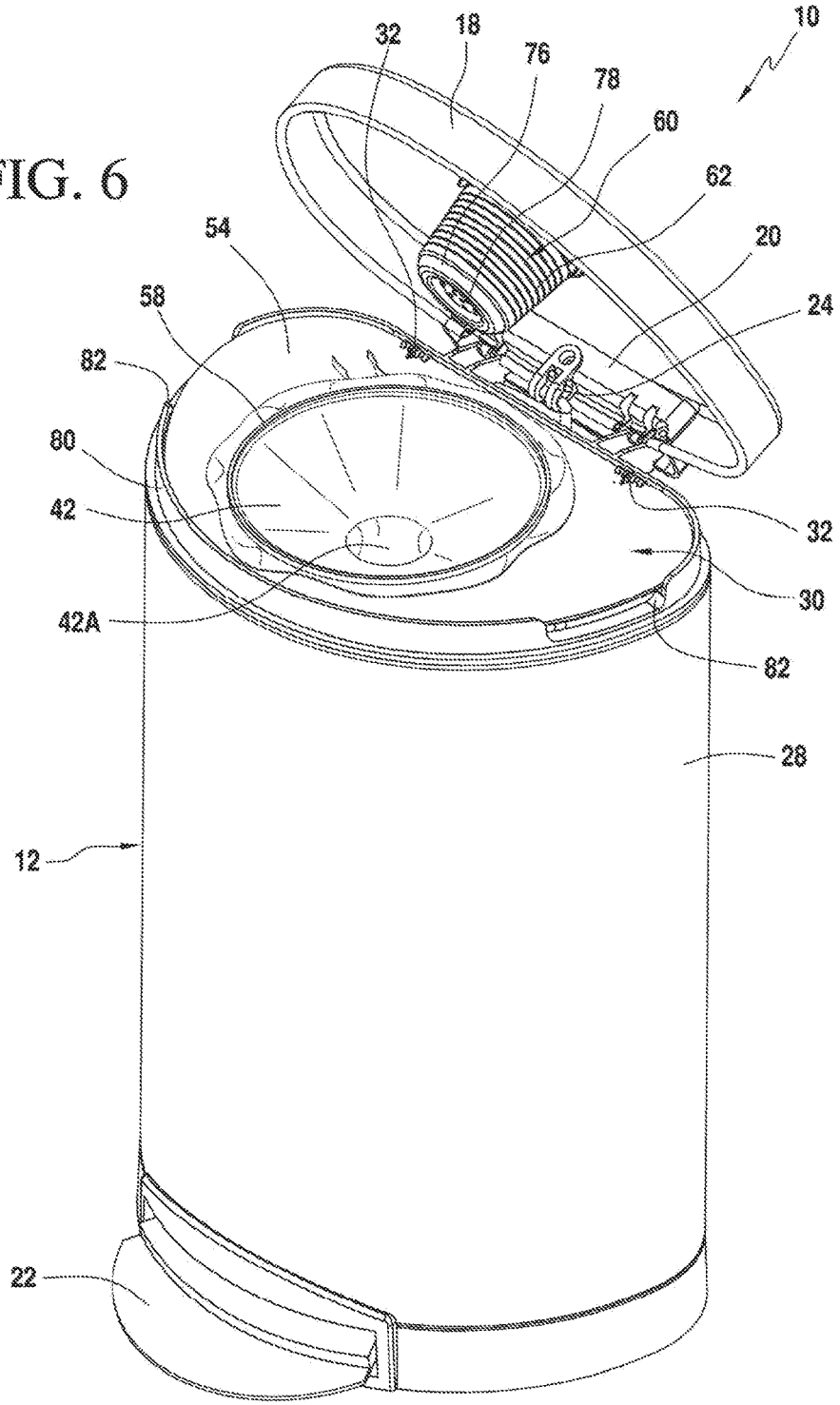
FIG. 6 is another perspective view of the container shown in FIG. 1.

Base 12 includes a body 28 and an upper compartment closure component, or closure component 30 pivotally attached to the body 28. To this end, a pivotal attachment mechanism or pivotal attachment means is arranged along a rear edge of the base 12 and includes one or more parts arranged on the closure component 30 and one or more complementary parts arranged on the body 20. For example, the pivotal attachment means may comprise two hinges 32 as shown in FIGS. 3 and 6, with one part of each hinge 32 being situated on or attached to the body 28 and the other, complementary part of each hinge 32 being situated on or attached to the closure component 30 to enable the closure component 30 to pivot about an axis substantially perpendicular to a vertical axis of the container 10. Other mechanisms and means that enable pivotal movement of one part relative to another may be used in the invention.

Closure component 30 includes a support portion 34 that generally has the same cross-sectional shape as the cross-sectional shape of the container 10 parallel to a surface on which the container 10 rests. Support portion 34 defines the opening 16 of the container 10. Closure component 30 also optionally includes or retains a membrane 36 that is situated in the opening 16 and may be releasably or permanently attached to the support portion 34.

Figure 26:
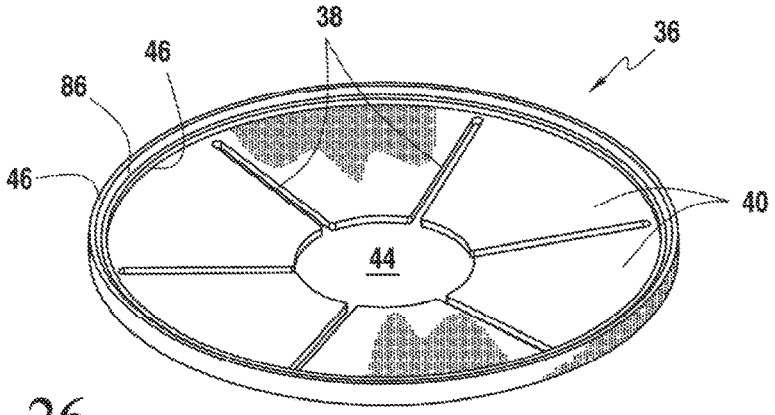
FIGS. 26, 27 and 28 shows various membranes used with the waste containers in accordance with the invention.

Membrane 36 includes a plurality of slots 38 between fingers 40 of the membrane 36, and specifically six slots 38 (see FIGS. 3 and 26). The slots 38 provide the membrane 36 with flexibility to enable insertion of waste into a bag 42 that overlies the membrane 36 with a portion of the bag 42 being passed through a central opening 44 of the membrane 36.

More specifically, the bag 42 overlies the membrane 36 to define a bag aperture 42A which forms at the central opening 44 of the membrane 36 (see FIG. 2). This bag aperture 42A is exposed when the lid 18 is pivoted upward relative to the base 12, e.g., by depressing the foot pedal 22 (see FIG. 6). The bag aperture 42A is covered when the lid 18 is closed, i.e., upon releasing pressure on the foot pedal 22, and may also be closed by means of a waste treatment component 60 or 110, described more fully below, when such a waste treatment component is present.

The membrane 36 may be formed and constructed in different ways and is not limited to the presence of six fingers 40 separated by six slots 38 as in the illustrated embodiment (see FIG. 26). The material of the fingers 40 may be selected to be flexible so that they flex downward in a direction away from the center when a person pushes waste through the central region of the membrane 36. The material of the fingers 40 should also be resilient so that the fingers 40 return to their initial form after the person has removed their hand from engagement with the membrane 36, or the inserted waste has been pushed downward through the membrane 36 and is no longer in engagement therewith.

For example, the membrane 36 may be made of silicone or another rubbery material. It may also be made of a flexible synthetic material which flexes under pressure and returns when pressure is removed. The edges of the fingers 40 which are expected to engage the bag 42 may be provided with a friction-enhancing material to increase the contact force between the fingers 40 and the bag 42.

Furthermore, the membrane 36 is preferably molded in a resilient substrate that can be adjusted for proper rigidity depending on the application. Polypropylene is one such material. The membrane 36 can also be reinforced with some ribbing to give it strength to return substantially to its relaxed shape. The membrane opening 44, 44A and 44B of membranes 36, 36A and 36B, respectively, shown in FIGS. 26-28 may have smaller apertures for specific applications, for example, when not using the waste treatment component 60, 110 to seal off the bag opening 42A that aligns with the membrane opening 44, 44A, 44B.

Membrane 36 may be formed integral with the support portion 34 to provide a unitary closure component 30 or separate therefrom and then attached thereto. For example, as shown in FIGS. 4 and 5, the membrane 36 includes an upwardly facing channel 86 defined between two walls 46 (see also, FIGS. 26-28) and the support portion 34 includes two support walls 48 separated by a channel 50 (see also, FIG. 14), all of which are dimensioned such that one wall 46 of the membrane 36 securely fits into the channel 50 of the support portion 34 and one wall 48 of the support portion 34 securely fits into the channel 44 of the membrane 36.

Figure 4:
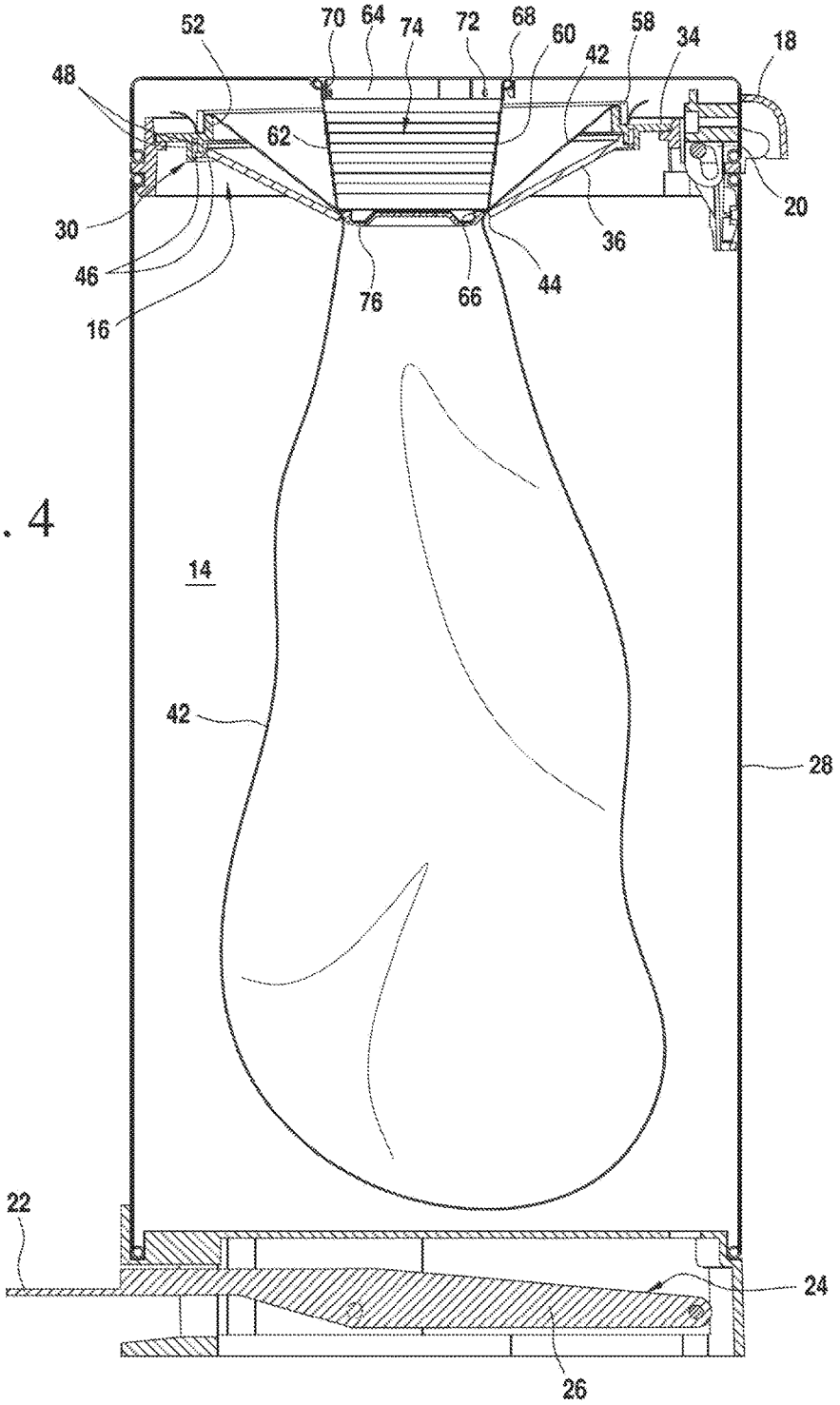
FIG. 4 is a cross-sectional view of the container shown in FIG. 1 taken along the line 4-4-in FIG. 1.
Figure 5:
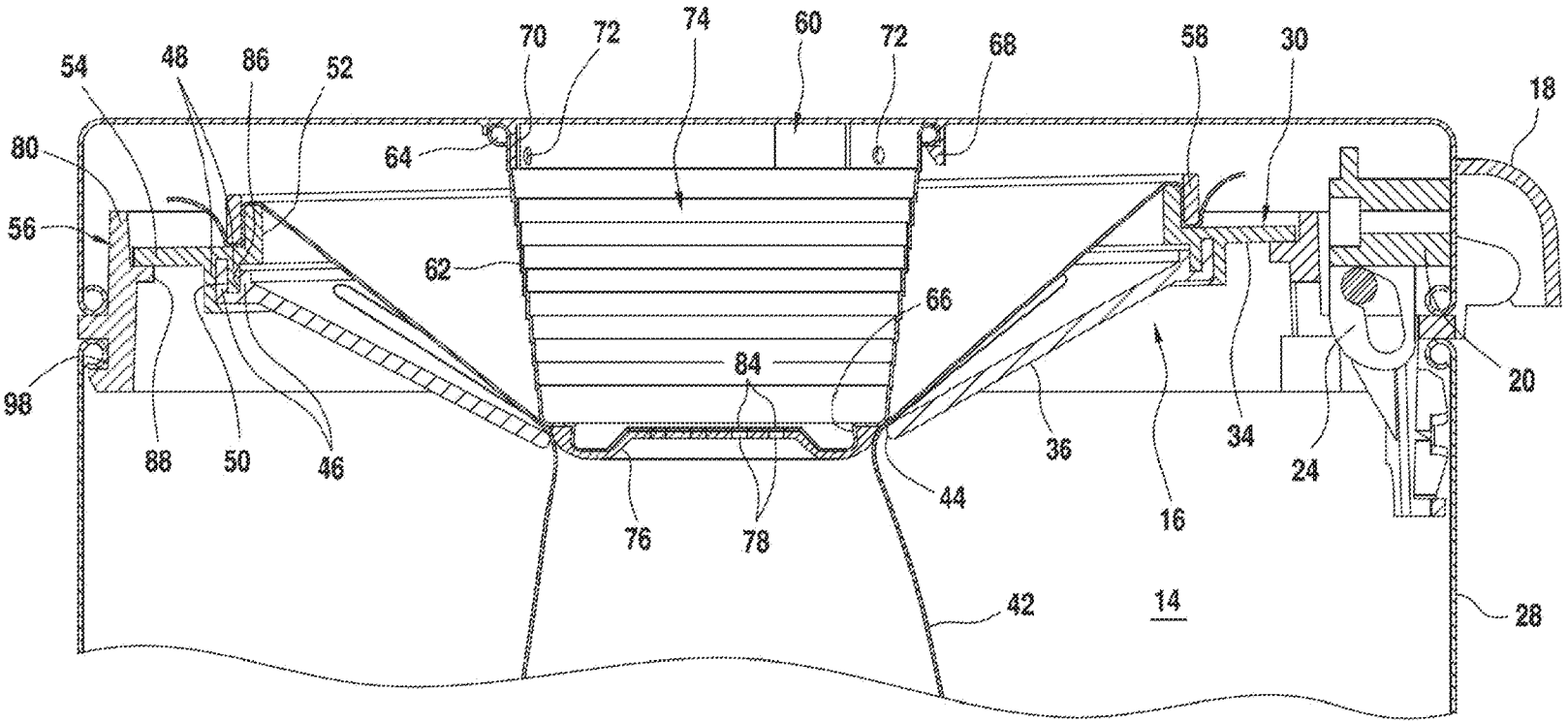
FIG. 5 is an enlarged view of the upper portion of FIG. 4.

The support portion 34 also includes a wall 52 that projects from a planar portion 54 and over which the bag 42 is placed (see FIGS. 4 and 5).

The body 28 of the base 12 includes a closure component support portion 56 that includes an inwardly projecting lip 88 on which a peripheral edge of the planar portion 54 of the support portion 34 rests when the closure component 30 is in its use position (shown in FIGS. 4 and 5). Closure component support portion 56 may be formed integral with a remaining portion of the body 28 or separate therefrom and then attached thereto. In the latter case, the closure component support portion 56 may be formed with a channel 98 that receives a rim at the upper edge of the remaining portion of the body 28 (see FIG. 5). Also, closure component support portion 56 includes a peripheral wall 80 that has one or more cut-out portions 82 (see FIGS. 2 and 3). The purpose of the cut-out portion(s) 82 is to facilitate lifting of the support portion 34, causing it to pivot relative to the body 28 of the base 12 and thereby enable access to a bag of waste in the compartment 14.

Another element of the container 10 is a hoop 58 that secures the bag 42 to the closure component 30. Hoop 58 has the same shape as the projecting wall 52 of the support portion 34 of the closure component 30 and is dimensioned relative thereto, i.e., with its inner circumference slightly larger than the outer circumference of the projecting wall 52, to provide a tight fit of the bag 42 therebetween (see FIGS. 4 and 5). This tight fit secures the bag 42 to the container 10 and should prevent unintentional release of the bag 42 from engagement with the container 10. The hoop 58 may be retained when not in use on the underside of the lid 18, e.g., by providing a securing or attachment mechanism such as clamps, on the underside of the lid 18. This should prevent loss of the hoop 58, yet ensure that the hoop 58 is readily available when it is desired to use it (note that the waste container 58 may be used with or without the hoop 58). As an alternative, the hoop 58 may be attached to the closure component 30, as described below with reference to FIG. 30.

Container 10 also includes a waste treatment component 60 that is positioned on the underside of the lid 18 (see FIGS. 2-6 and 23). Waste treatment component 60 includes a base 62 having an attachment portion 64 at an upper end and a conduit portion 66 at a lower end (see FIGS. 5 and 23). Attachment portion 64 may comprise an enlarged rim that is designed to be positioned between projections 68, 70 on the underside of the lid 18. Projections 68 are designed to be positioned radially outward of the attachment portion 64 (as shown in FIG. 2) and projections 70 are designed to be positioned radially inward of the attachment portion 64 (as shown in FIG. 5), when the attachment portion 64 is engaged with the lid 18. In this manner, the attachment portion 64 is snapped onto the lid 18, although other mechanisms and means for removably securing the base 62 to the lid 18 are encompassed within the scope of the invention. Projections 68, 70 are flexible and each includes a ramped portion that facilitates insertion of the waste treatment component 60 into engagement with the projections 68, 70. Removal of the waste treatment component 60 from the lid 18 involves flexing one or more of the projections 68 outward and pulling the waste treatment component 60 away from the lid 18.

Also, attachment portion 64 includes apertures 72 that are preferably equal in number to the projections 68 and have the same circumferential spacing as the projections 68. In this manner, the waste treatment component 60 may be rotated to a position in which the projections 68 cover all of the apertures 72, and thereby prevent release of deodorant, air freshener, air purifier, or disinfectant from an interior cavity 74 of the waste treatment component 60 to the space between the bag 42 and the lid 18, or allow for release of deodorant or disinfectant from the interior cavity 74 of the waste treatment component 60 to the space between the bag 42 and the lid 18. However, there may be a different number of apertures 72 on the attachment portion 64 than the number of projections 6, e.g., fewer apertures 72 than projections or greater apertures 72 than projections 68. In either of these cases, rotation of the waste treatment component 60 relative to the projections 68 vary the extent of the opening(s) between the interior cavity 74 of the waste treatment component 60 to the space between the bag 42 and the lid 18.

Rotation of the waste treatment component 60 can be effected manually depending on whether the user of the container 10 determines that there is a need to address unpleasant smells and odors between the bag 42 and the lid 18 or disinfect this area. Rotation of waste treatment component 60 therefore controls the degree to which deodorant or disinfectant is released into the space between the lid 18 and bag 42.

The base 62 tapers in a downward direction toward the bottom of the base 12 of the container 10, and preferably is provided with a vertical height such that is slightly presses against the bag 42 at a location at or around where the bag 42 contacts the membrane 36 (see FIGS. 4 and 5). The outer surface of the base 62 has staggered edges that assist in scraping clean bag 42 when the lid 18 is closed. The outer surface of the base 62 may be provided with a smooth tapering edge, or any other form or type of edge instead of the staggered edge. Otherwise, the base 62 is preferably formed such that when the lid 18 is closed, it forms a seal against the bag 42 around the bag opening 42A. Thus, the base 62 has a peripheral wall extending from a lower wall around the periphery of the lower wall.

In a preferred embodiment, the waste treatment component 60 is dimensioned so that when the lid 18 is closed, the waste treatment component 60 presses the membrane 36 slightly inward causing it to flex. This flexure serves to provide a seal to the bag 42, i.e., that portion of the bag 42 containing waste in the compartment 14 is sealed by the pressure contact between the membrane 36 and the waste treatment component 60. One of the seal's purposes is to minimize or prevent the backdraft of odor, airborne bacteria and/or fungus from escaping the waste contained inside the waste containing bag 42.

The waste treatment component 60 may house one or more of a deodorant, a disinfectant, an air freshener, an air purifier, a compound that neutralizes odor, a compound that neutralizes bacteria, and a compound that neutralizes fungus. These compounds may be solid, liquid or in powder form.

Figure 23:
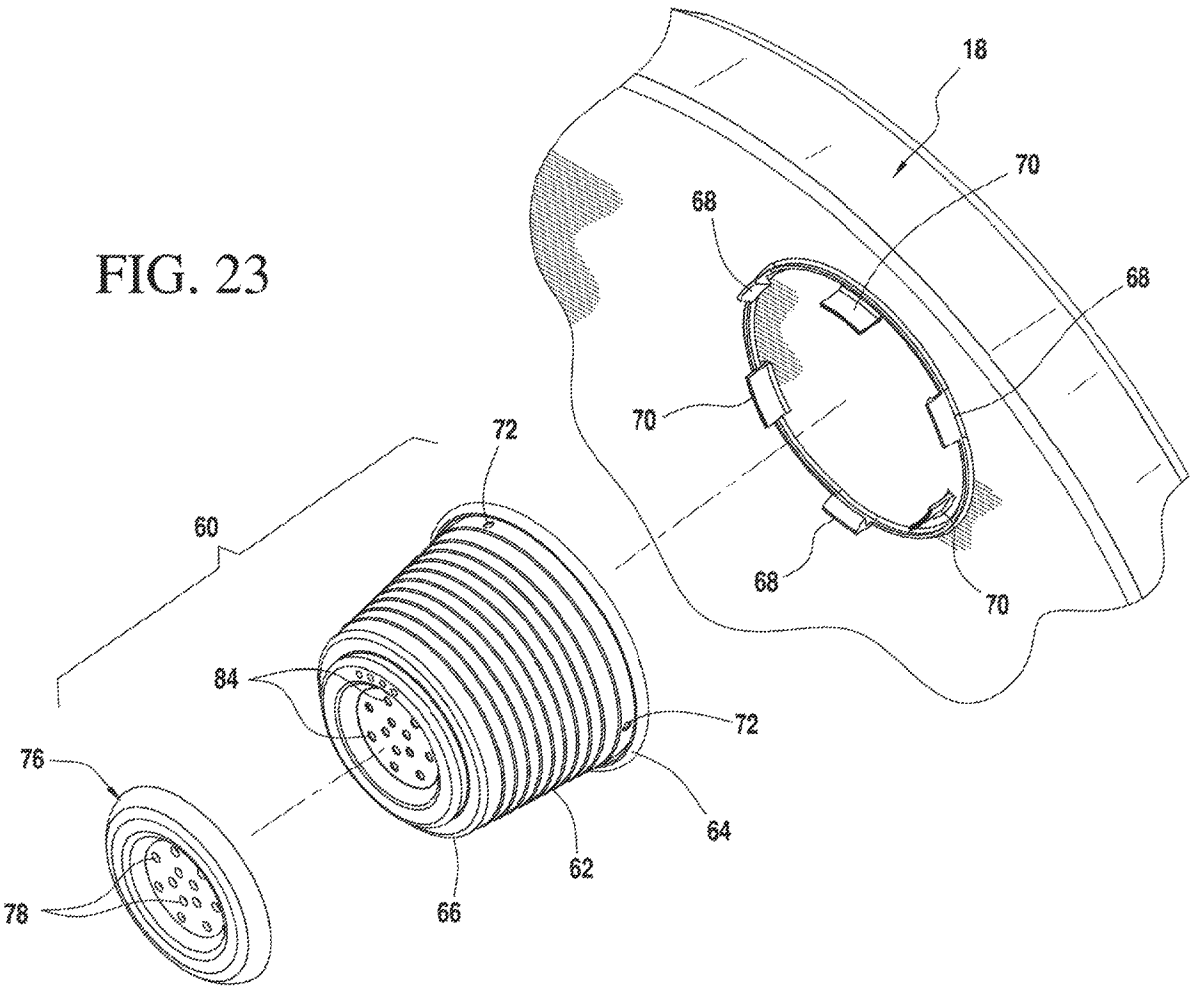
FIG. 23 is an exploded perspective view of a first embodiment of a waste treatment component used with a container in accordance with the invention.

Conduit portion 66 is formed as the bottom of the base 62 and includes a plurality of apertures 84 through which deodorant or disinfectant from the interior cavity 74 of the waste treatment component 60 is released to the interior of the bag 42 (see FIG. 23). Apertures 84 are formed in the lower wall of the base 62. However, this release is again controlled by the user by attaching a rotatable member 76 to the base 62 to selectively cover or expose the apertures 84 (see FIG. 23). This attachment may be a snap-on type of attachment, or similar. Rotatable member 76 includes apertures 78 in a portion spaced apart and/or opposite from the lower wall of the base 62 (when the member 76 is attached to the base 62) that either fully or partly align with apertures 84 on the conduit portion 66 or fully align with solid portions of the conduit portion 66 (see FIG. 5 wherein two apertures 84 align with two respective apertures 66 while other apertures 84 align with a solid portion of the conduit portion 66). Rotation of member 76 therefore controls the degree to which deodorant or disinfectant is released into the bag 42.

The conduit portion 66 includes not only the lower wall of the base 62, but also a rim surrounding and radially outward of the lower wall of the base 62. The rim is configured such that an outer facing surface of the rim is inward of the peripheral wall of the base 62, with the member 76 being configured to overlie the rim. Also, the portion of the member 76 that is spaced apart and/or opposite from the lower wall of the base 62 is recessed inward of a lower edge of the member 76 to thereby provide the member 76 with a rim that surrounds and is radially outward of the recessed portion of the member 76 that is spaced apart and/or opposite from the lower wall of the base 62. The rim of the member 76 is attached to the base 62 with the rim of the member 76 overlying the rim of the conduit portion 66.

Member 76 may be positioned to facilitate pushing of waste through the central opening 44 of the membrane. To this end, the waste treatment component mounting mechanism, i.e., projections 68, 70, are preferably positioned to align the member 76 with the central opening 44 of the membrane 36. Thus, during use of the container 10, any waste that is lodged in the bag 42 around the central opening 44 of the membrane 36 should be pushed by waste treatment component 36 into the portion of the bag 42 in the compartment 14 when the lid 18 is closed. In addition or alternatively, the member 76 will abut against the bag 42 around the opening 42A and seal the bag opening 42A, i.e., at least partly press against and/or make contact with the bag 42. The waste treatment component 60 therefore performs bag sealing, waste insertion and waste treatment.

Instead of a removable mounting mechanism for the waste treatment component 60, a waste treatment component may be permanently attached to the underside of the lid 18. It could thus be formed integral with the lid 18 and configured to allow for insertion of a new deodorant, disinfectant, etc., e.g., with a removable cartridge, access door, and the like.

Different constructions of a waste treatment component 60 are envisioned. In one embodiment, the waste treatment component 60 is a disposable, single-use deodorizer and/or disinfectant and must be replaced by a completely new deodorizer and/or disinfectant once the deodorant and/or disinfectant in the interior cavity 74 is used up. In another embodiment, the waste treatment component 60 is designed for multiple uses and allows for insertion of blocks or pellets of deodorant or disinfectant into the interior cavity 74 upon disengagement of the waste treatment component 60 from the lid 18.

Waste treatment component 60 may also be considered a canister. The canister may be made with two interior cavities, one including a disinfectant and one including a deodorant. The cavity including the disinfectant may communicate with the apertures 72 in the attachment portion 64. The cavity including the deodorant may communication with the apertures 84 in the conduit portion 66.

In use, the container 10 is placed into a use state by obtaining a bag 42, lifting the lid 18 into the state shown in FIG. 3, pushing the bag 42 through the central opening 44 of the membrane 36 into the compartment 14 and placing the upper flange of the bag 42 over the projecting wall 52 of the support portion 34 of the closure component 30. Then, the hoop 58 is placed around the projecting wall 52 to sandwich part of the bag 42 between the hoop 58 and the projecting wall 52 (providing the container 10 with the state shown in FIG. 2). The bag 42 may optionally be tied at its open end by ties or a drawstring 102 (see FIG. 3), although such tying may usually occur when the full bag 42 is removed from the container 10. The container 10 is ready for use.

For use, the lid 18 is opened by depressing the foot pedal 22 and waste is then pressed against the bag 42 in that portion overlying the membrane 36 until the waste is pressed past the membrane 36 into the compartment 14 (see FIG. 4 in which the bag 42 in the compartment 14 may contain one or more waste insertions). The lid 18 is then closed, e.g., by releasing pressure on the foot pedal 22. As desired, the rotatable member 76 and base 62 are manipulated to cause release of deodorant or disinfectant from the interior cavity 74 of the waste treatment component 60 into the bag 42 and/or into the space between the bag 42 and the lid 18.

Figure 22:
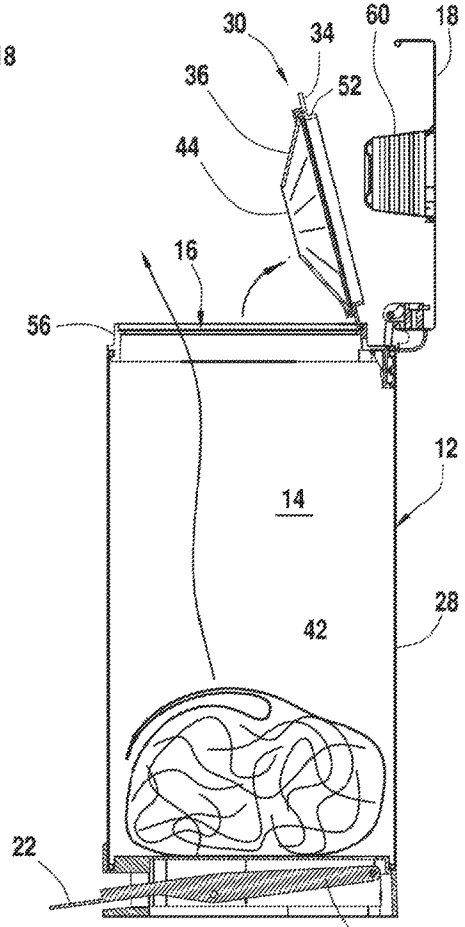
FIGS. 20, 21 and 22 show different stages in use of the waste container shown in FIG. 1 including stage during removal of a bag from the container.
Figure 21:
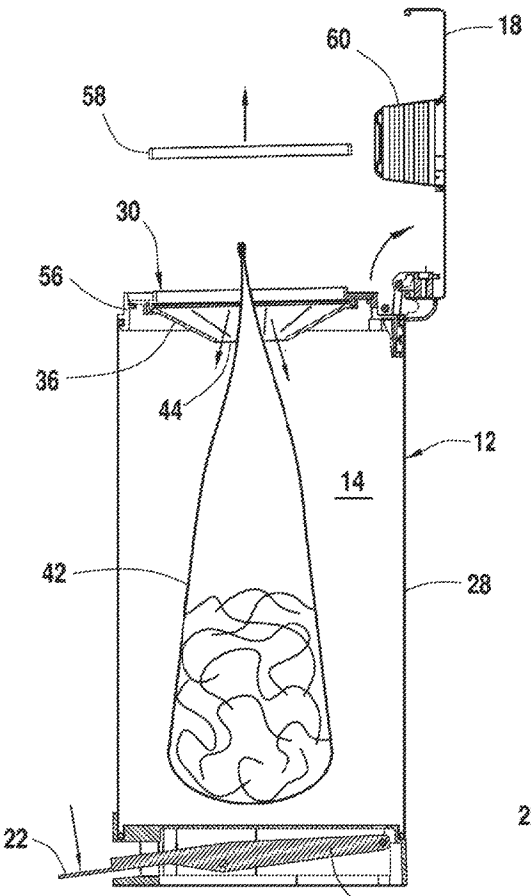
Figure 20:
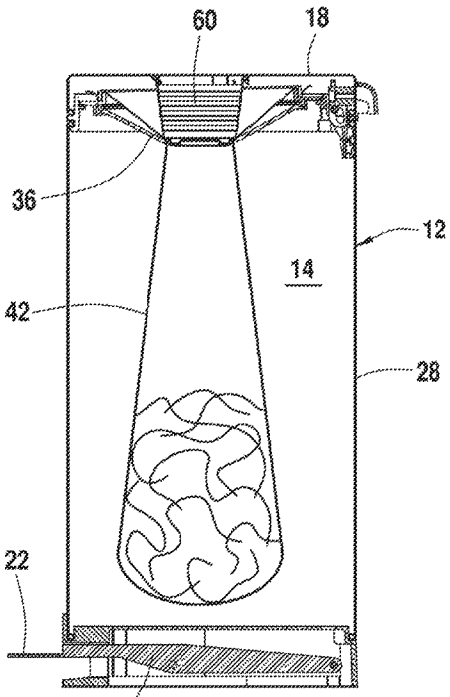

Referring now to FIGS. 20-22, when the bag 42 is full and it is desired to remove the bag 42 from the container 10 (as shown in FIG. 20), the lid 18 is lifted up by depressing the foot pedal 22, the hoop 58 is lifted up (FIG. 21) and the flange of the bag 42 inserted through the central opening 44 of the membrane 36 (see the arrows in FIG. 21 which represent this movement). The closure component 30 is lifted up (see FIG. 22) and then the flange of the bag 42 is tied or otherwise closed, e.g., with a drawstring or a bag tie known to those skilled in the art. Alternatively, the flange of the bag 42 is tied or otherwise closed before the closure component 30 is lifted up (in the position shown in FIG. 21). The full bag 42 is then lifted out of the compartment 14 (see FIG. 22) and the closure component 30 then moved back into engagement with the base 12 and readied for insertion of a new bag 42.

Figure 7:
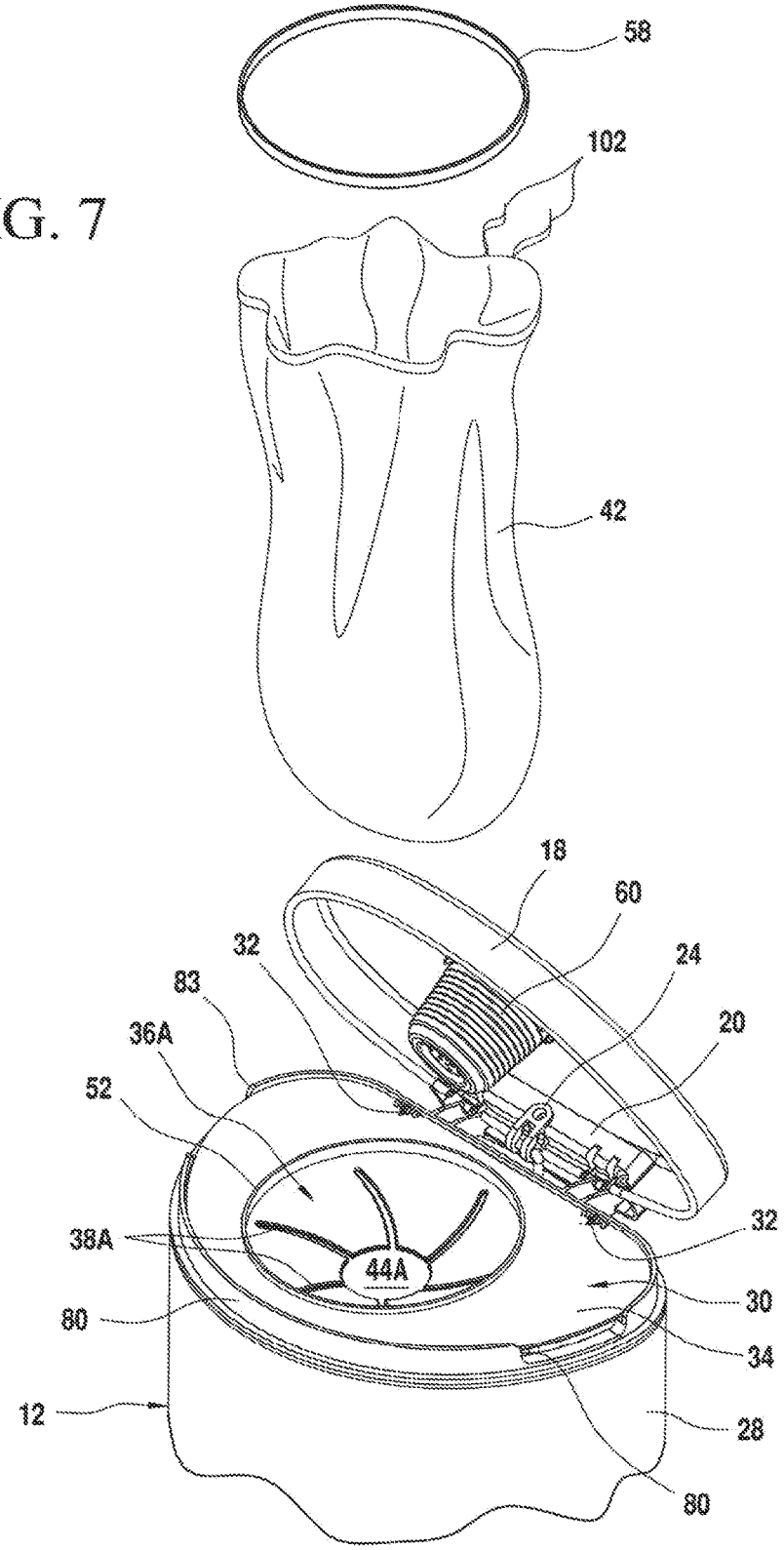
FIG. 7 is a perspective view of another embodiment of a waste container including a different membrane than that shown in FIG. 3.
Figure 8:
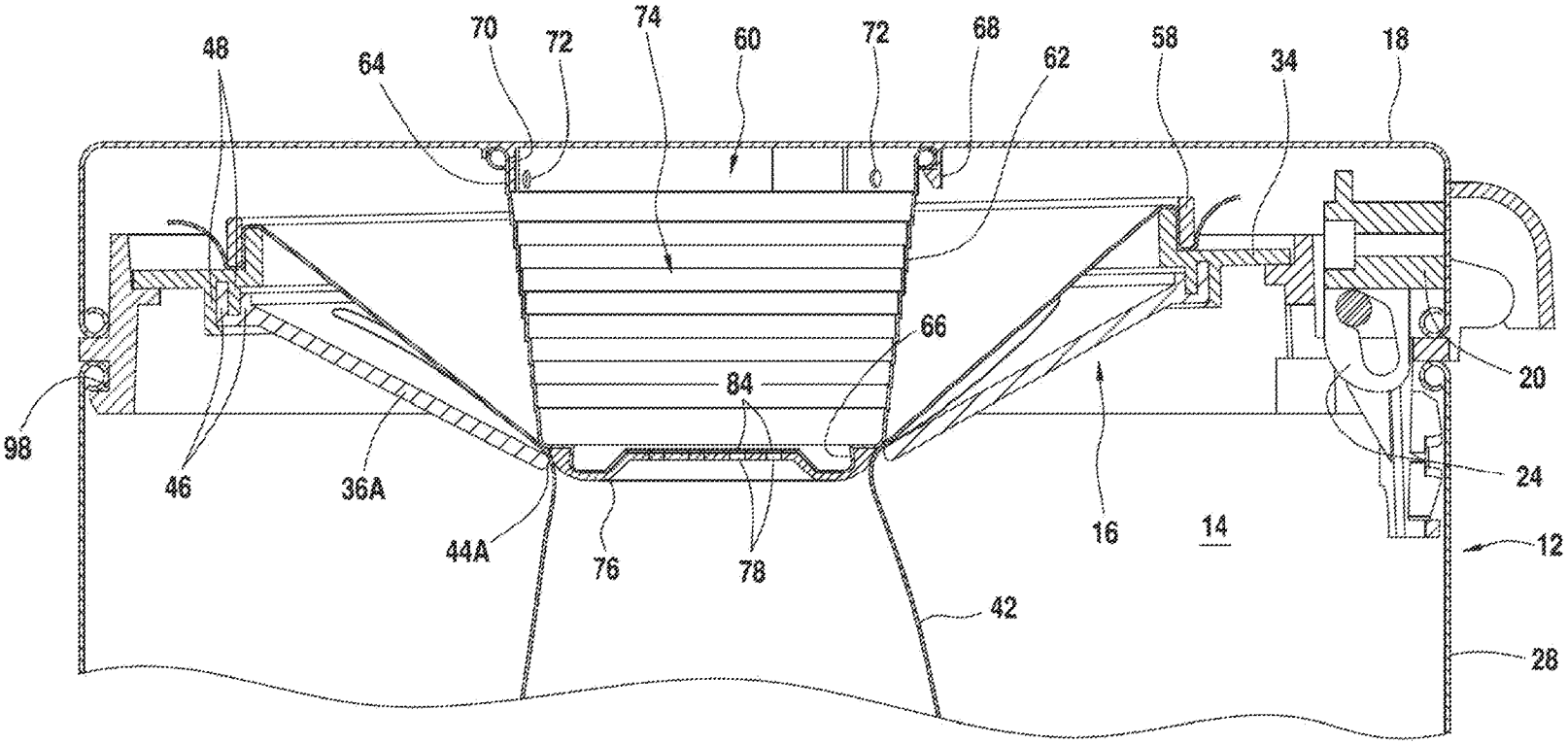
FIG. 8 is a cross-sectional view of a portion of the container shown in FIG. 7.
Figure 27:
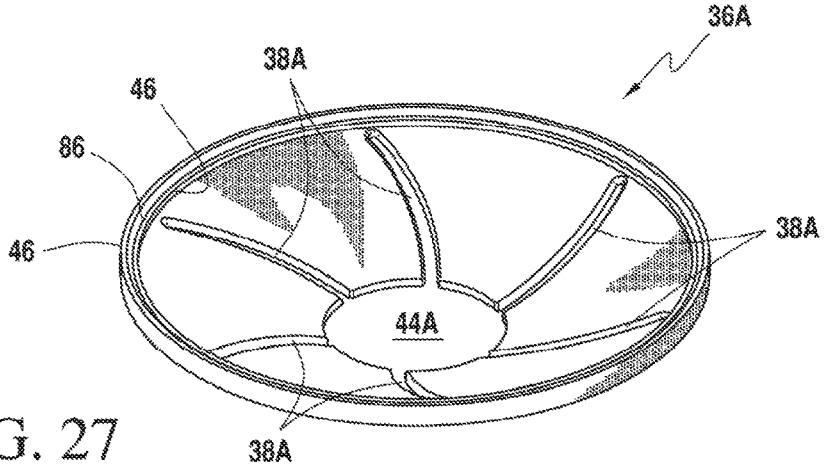

FIGS. 7 and 8 show another embodiment of container 10 with a different membrane 36A (also shown in FIG. 27). Membrane 36A has six curved slots 38A leading from the central opening 44A. Otherwise, the container with membrane 36A is used in the same manner as container 10 and membrane 36A may have the same characteristic and properties as membrane 36.

Figure 9:
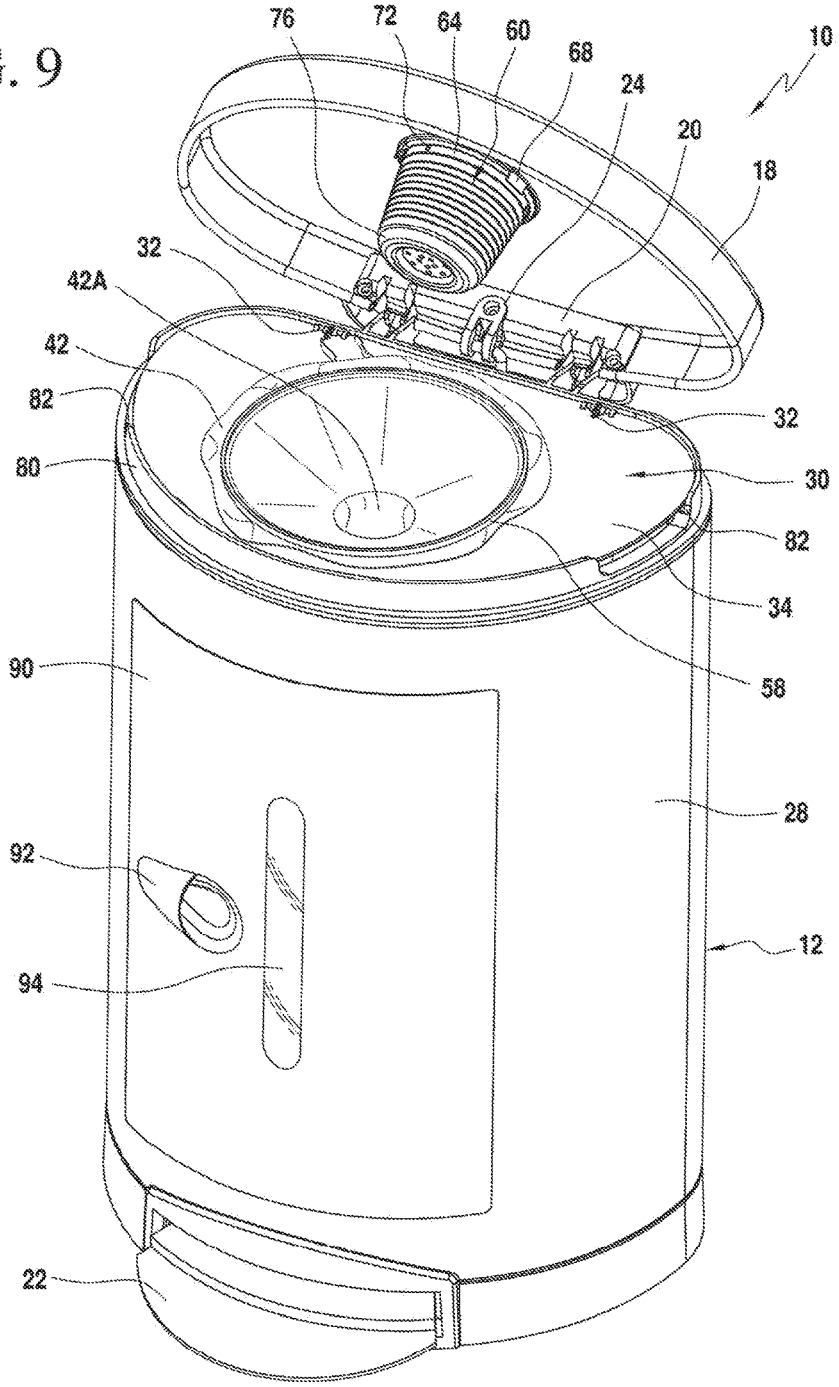
FIG. 9 is a perspective view of another embodiment of a waste container in accordance with the invention.
Figure 10:
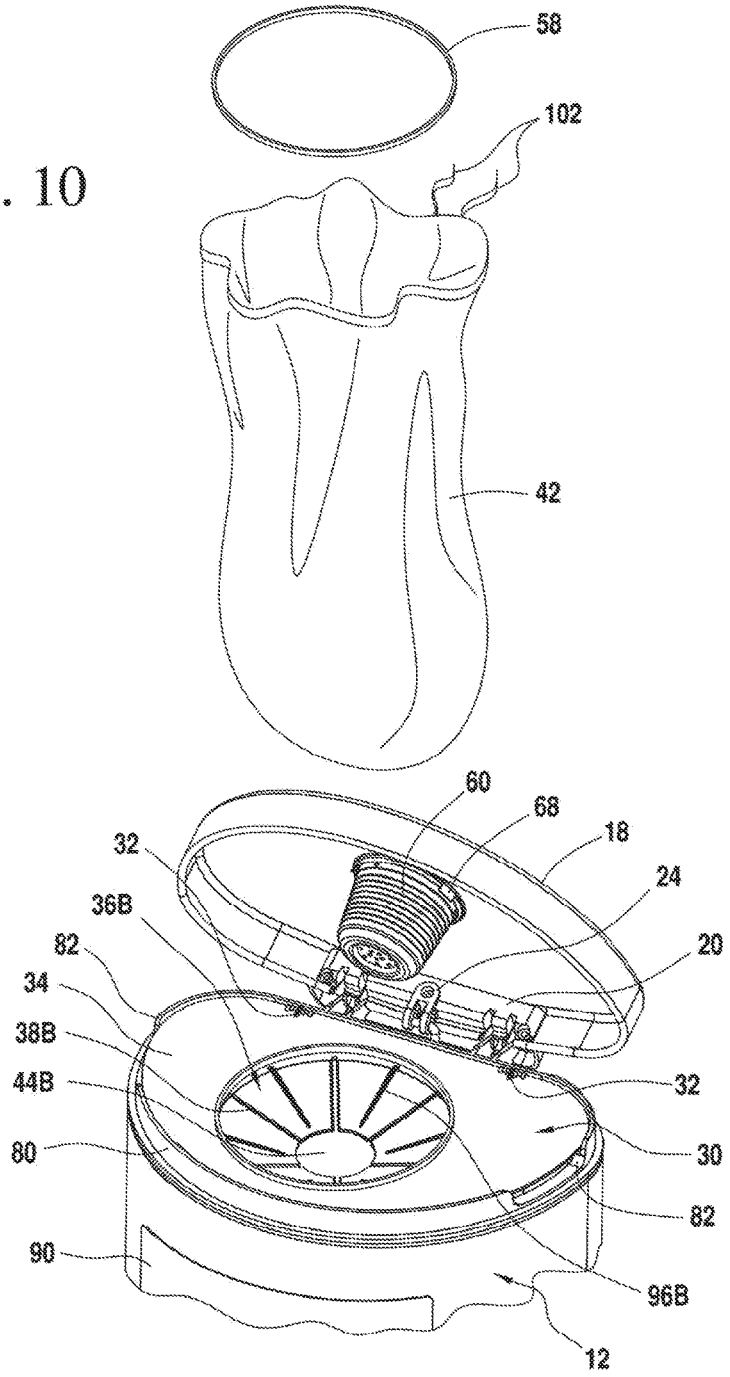
FIG. 10 is a perspective view of the container shown in FIG. 9 with the bag and hoop removed therefrom.
Figure 11:
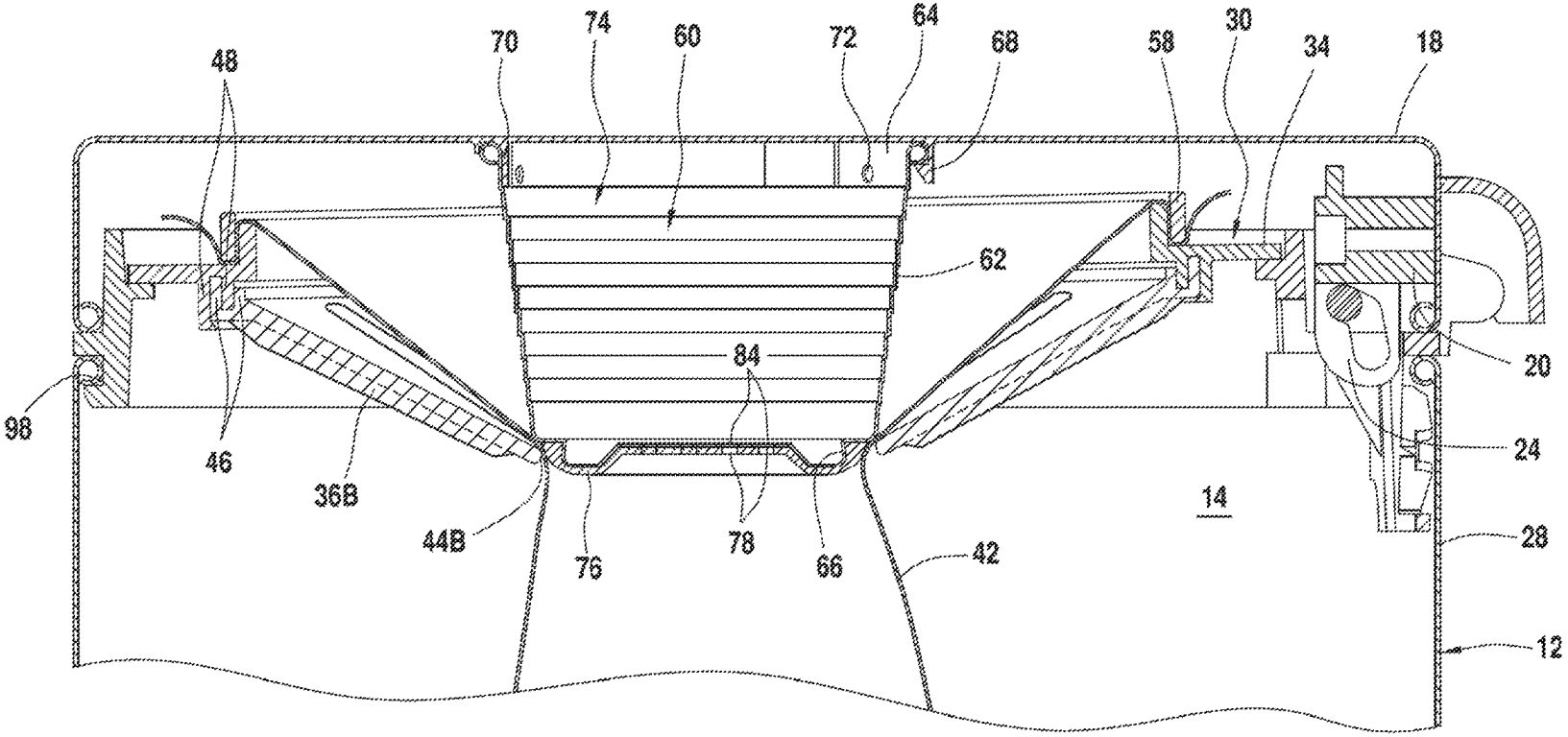
FIG. 11 is a cross-sectional view of a portion of the container shown in FIG. 9.

FIGS. 9-11 show another embodiment of container 10 wherein a door 90 is formed in the body 28 of the base 12. Door 90 is provided with a conventional attachment mechanism to enable it to be opened by pulling on a handle 92 and closed as desired, e.g., one or more hinges situated on the interior of the container 10. Door 90 also includes a window 94 that preferably extends vertically as shown to enable easy viewing of the condition of the bag 42 in the compartment 14 vis-à-vis its state of fullness. The window 94 is made of a clear or transparent material, e.g., plastic. By providing the window 94, a user has the option to view whether the bag 42 is full or not and based thereon, determine when it is appropriate to remove the bag 42 and replace it with a new bag 42.

Figure 28:
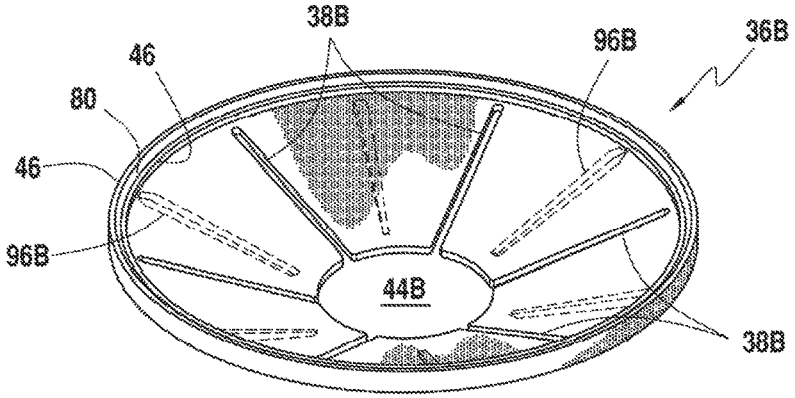
Figure 29:
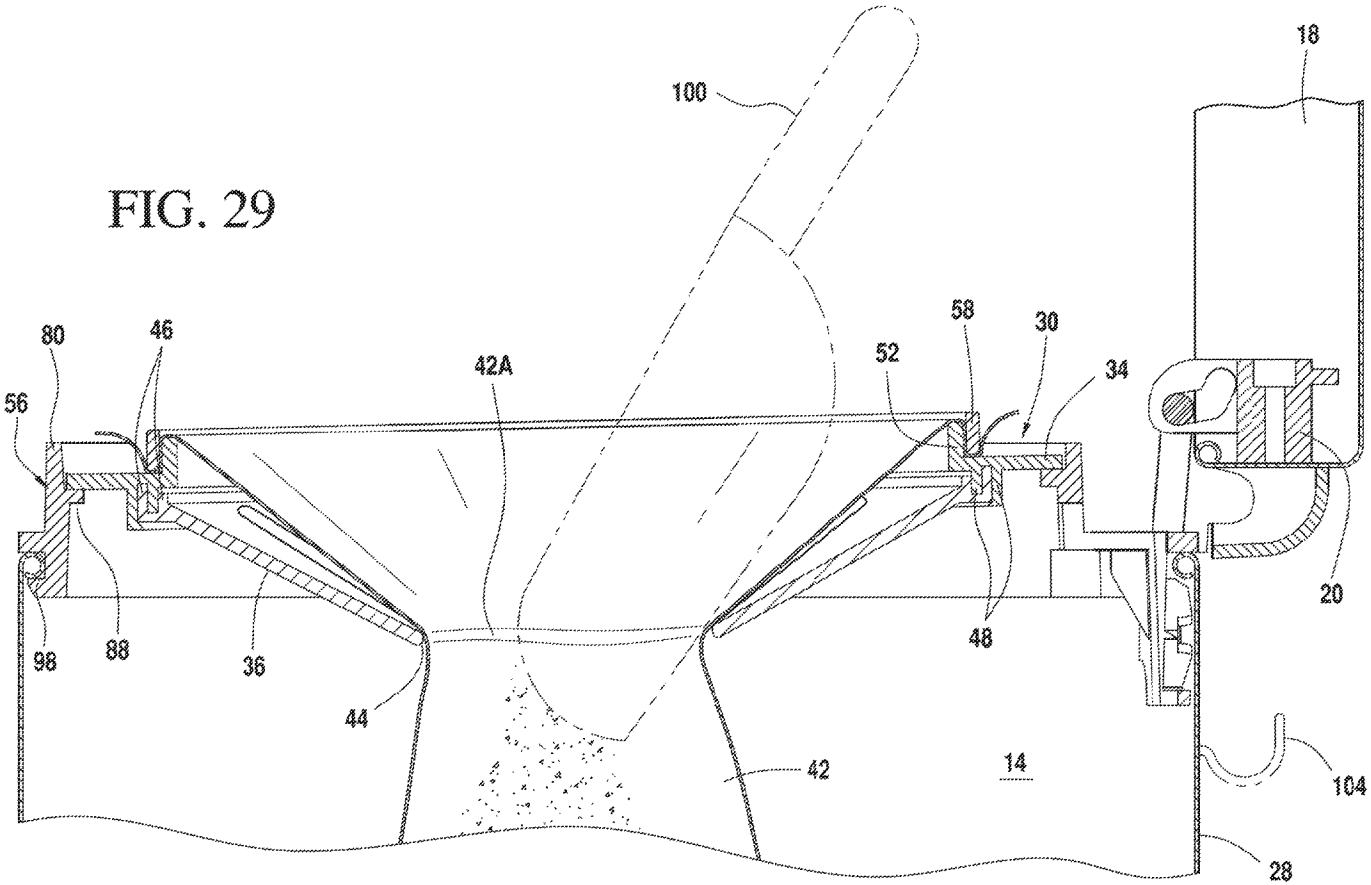
FIG. 29 is a view showing use of a container with a scoop that may be used to scoop cat litter into the bag.

The container shown in FIGS. 9-11 also includes a membrane 36B differing from membranes 36 and 36A (see also FIG. 28). Membrane 36B has slots 38B that extend from the central opening 44B to almost the periphery of the membrane 36B and also supplemental slots 96B that extend radially inward from the periphery of the membrane 36B close to but separated from the central opening 44B. Supplemental slots 96B provide the membrane 36B with additional flexibility. Also, supplemental slots 96B may not extend fully through the thickness of the membrane 36B, i.e., have a height less than the height of the membrane 36B.

Otherwise, the container with membrane 36B is used in the same manner as container 10 with either of membranes 36, 36A, and membrane 36B may have the same characteristic and properties as membrane 36.

Figure 12:
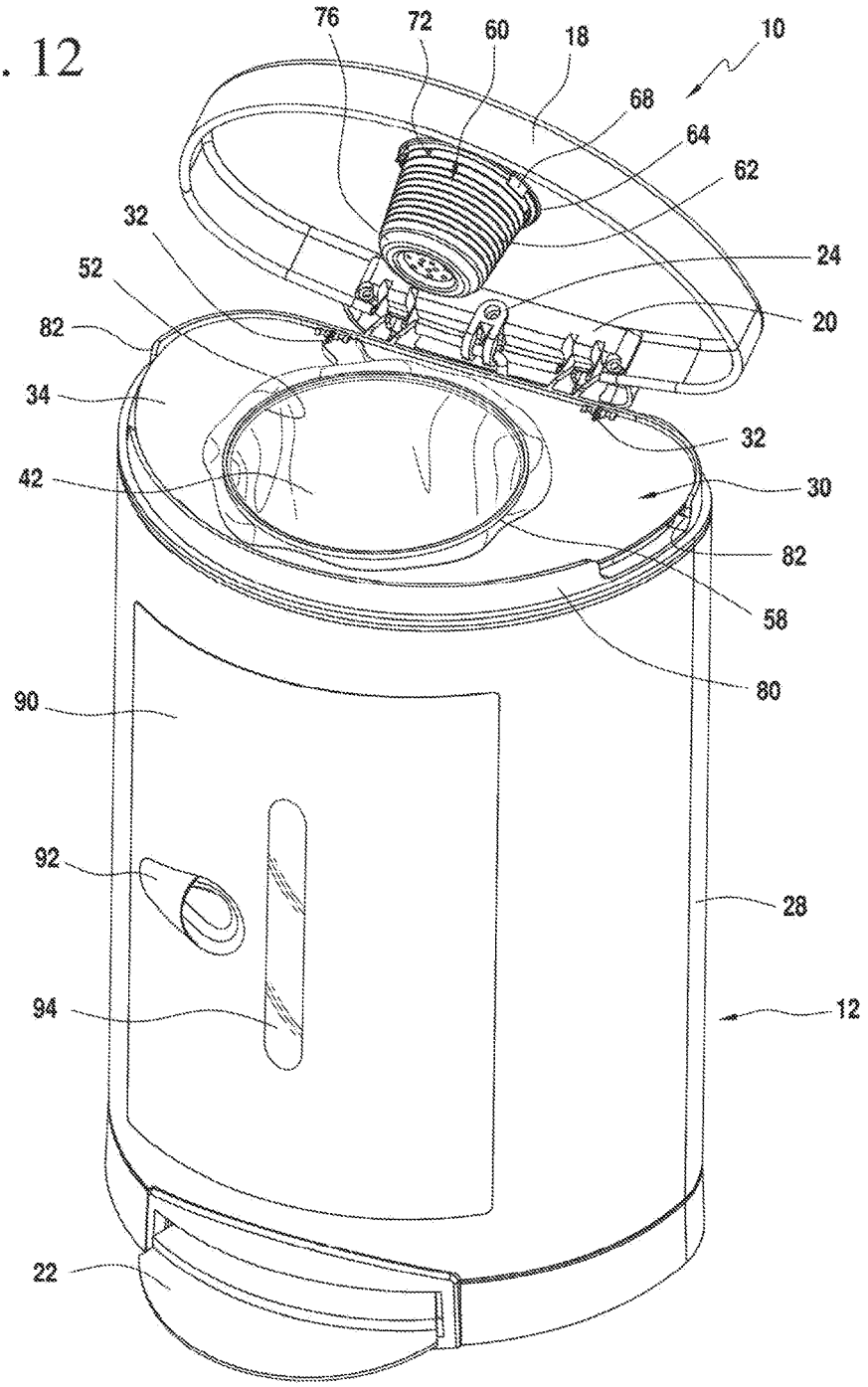
FIG. 12 is a perspective view of another embodiment of a waste container in accordance with the invention.
Figure 13:
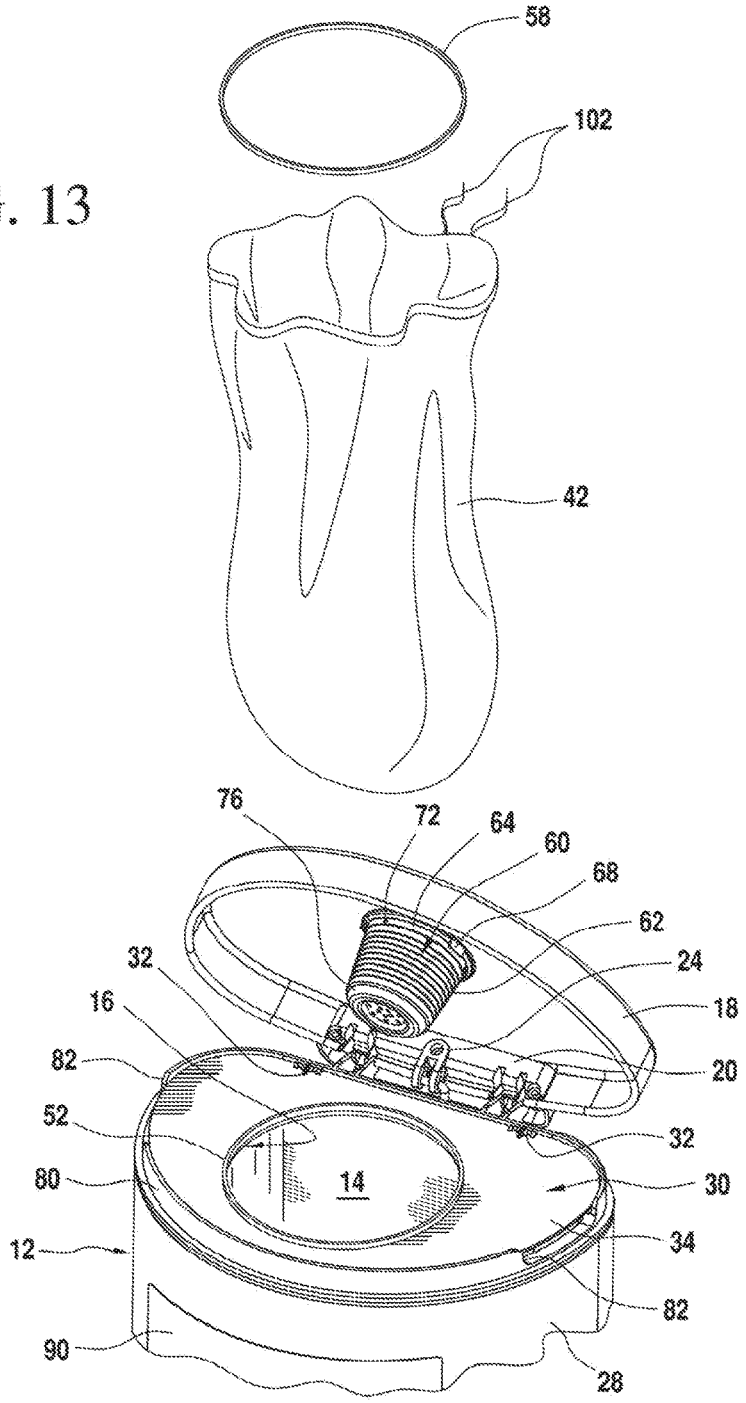
FIG. 13 is a perspective view of the container shown in FIG. 12 with the bag and hoop removed therefrom.
Figure 14:
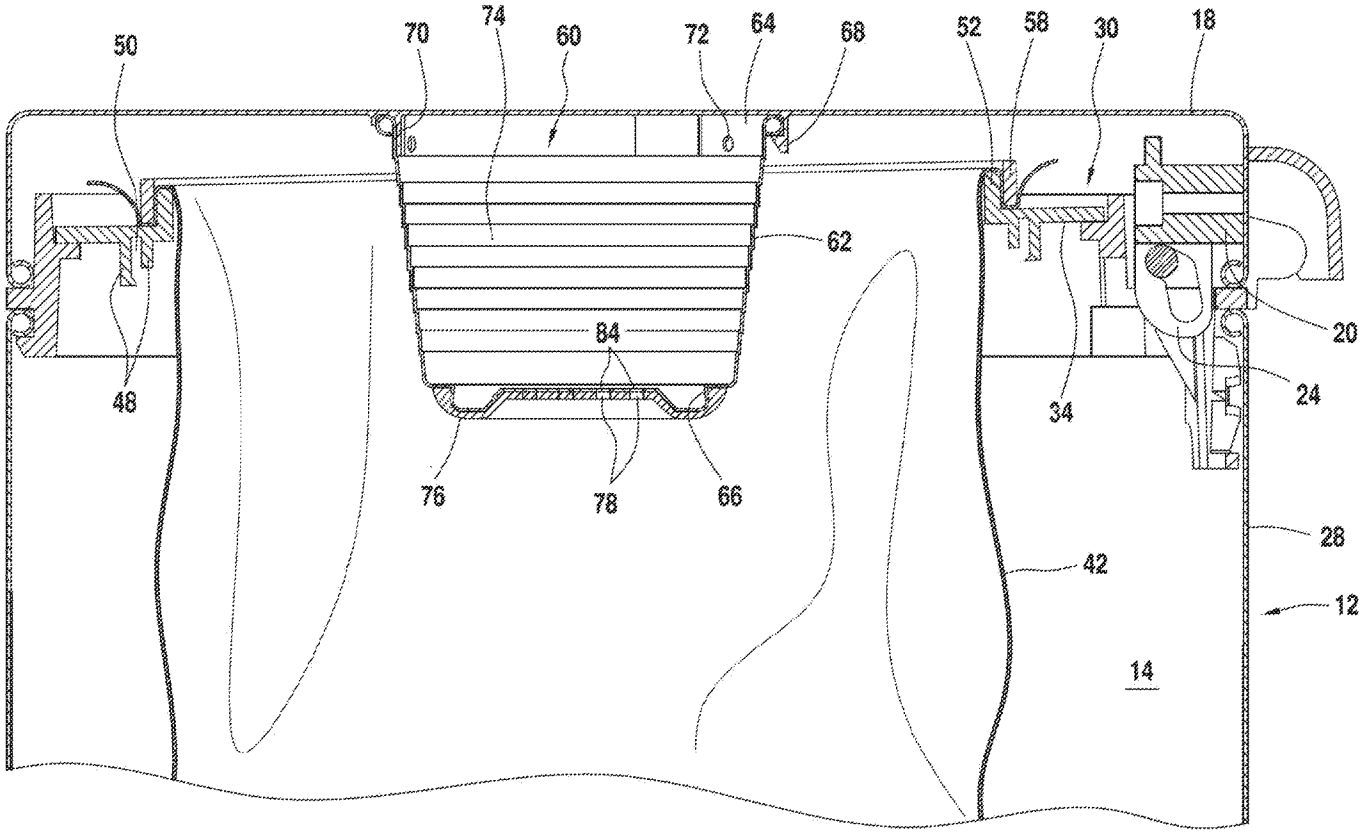
FIG. 14 is a cross-sectional view of a portion of the container shown in FIG. 12.

FIGS. 12-14 show another embodiment of container 10 wherein the closure component 30 does not retain a membrane, i.e., it is used without a membrane, and the container includes an optional side door 90 as shown in FIGS. 9-11. By virtue of the possible use of the container 10 without a membrane, the membrane is considered an optional feature. It may be attached to the closure component 30 when the user seeks to use the container for waste that is more easily insertable into the container with a membrane, yet then removed from the closure component 30 when the user seeks to use the container for waste that is more easily insertable into the container without a membrane.

In this embodiment, the base 62 of the waste treatment component 60 may be positioned such that the projections 68 on the underside of the lid 18 occlude the apertures 72 since there would be two sets of passages for deodorant or disinfectant to pass from the interior cavity 74 of the waste treatment component 60 to the bag 42, i.e., either through apertures 72 or through aligning apertures 78, 84.

The bag 42 of waste is removed from the compartment 14 either in the same manner as described above, i.e., through the top of the compartment 14 when the closure component is pivoted relative to the base 28, or simply by opening the door 90 to access the compartment 14.

Figure 15:
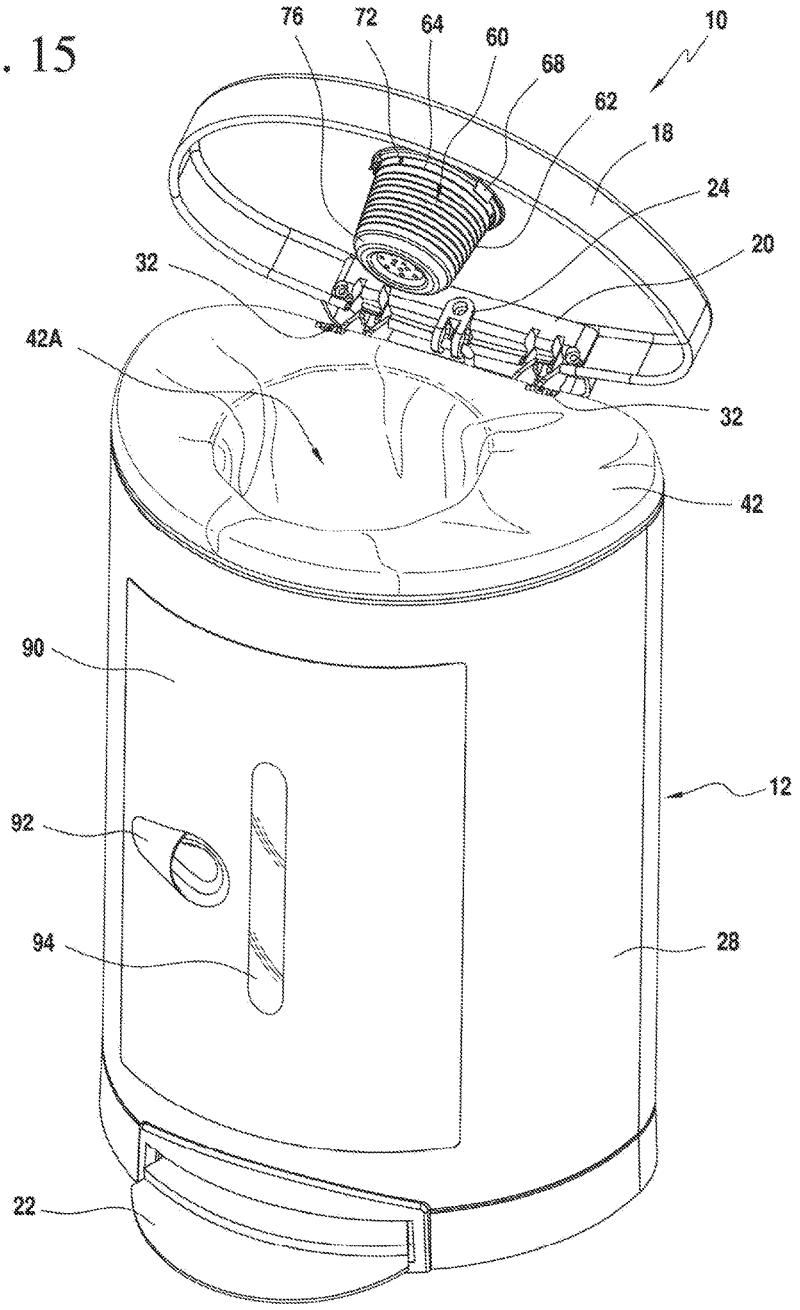
FIG. 15 is a perspective view of another embodiment of a waste container in accordance with the invention.
Figure 16:
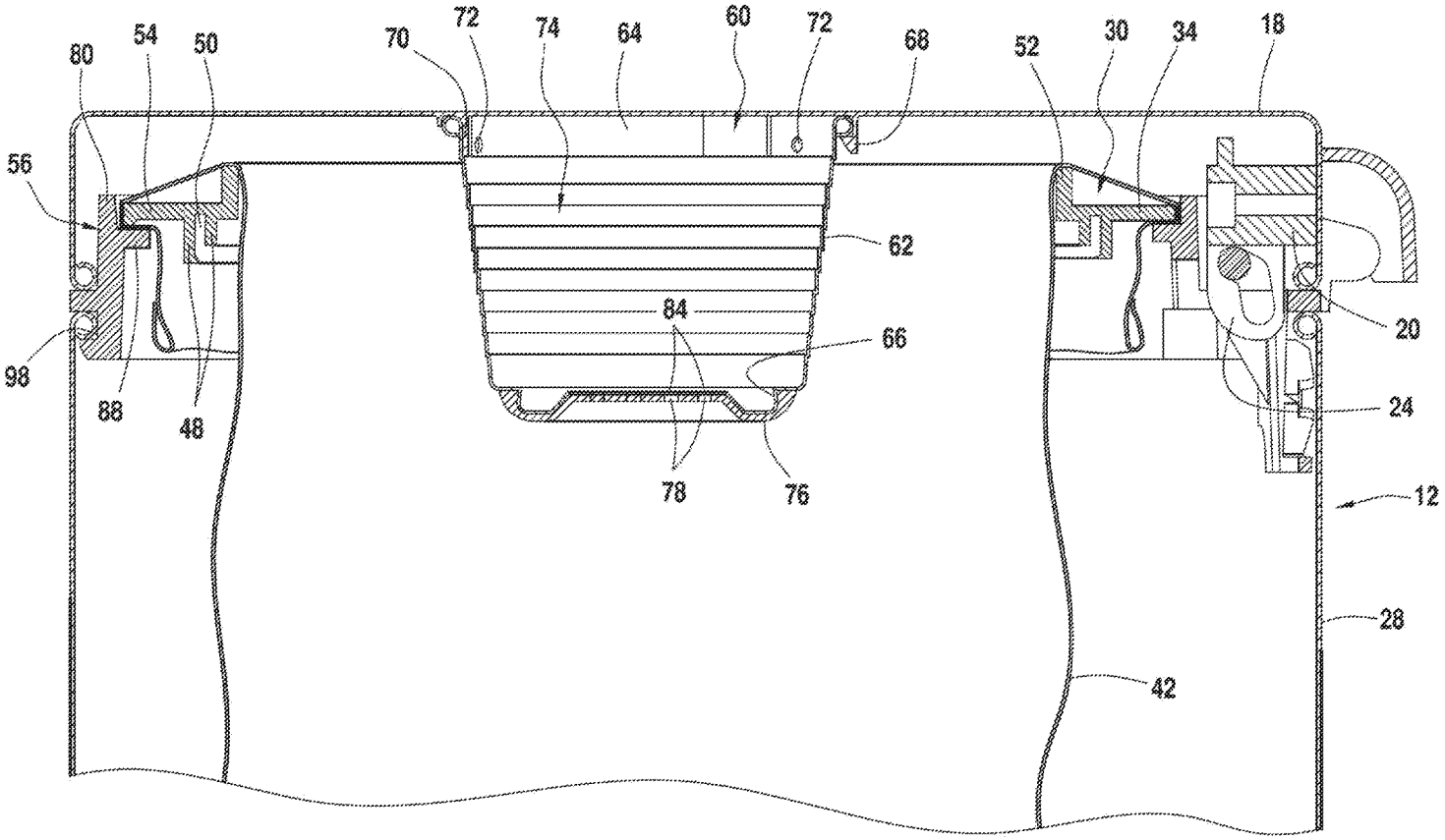
FIG. 16 is a cross-sectional view of a portion of the container shown in FIG. 14 with the lid in a closed state.
Figure 17:
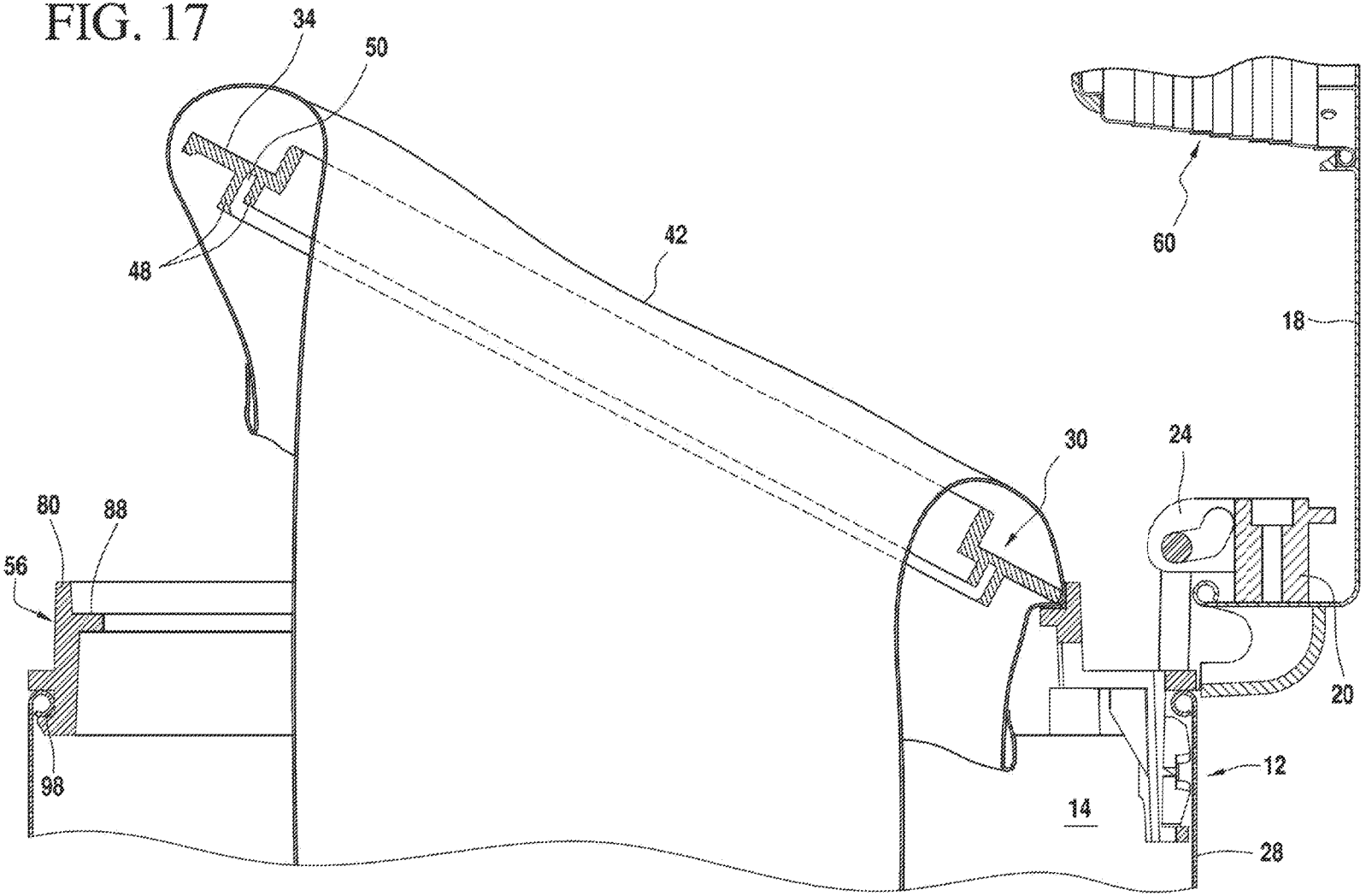
FIG. 17 is a cross-sectional view of a portion of the container shown in FIG. 14 with the lid in an open state.

FIGS. 15-17 show another embodiment of container 10 wherein the closure component 30 does not retain a membrane and is used without a hoop. The bag 42 may be placed through the opening 16 which is defined by the closure component 30 and then the flange of the bag 42 folded back on itself and around the support portion 34 of the closure component 30 (aside from the locations at which the hinges 32 are present (see FIG. 15 wherein the hinges 32 are visible when the bag 42 is in its use state). The bag 42 is thus secured between the inwardly projecting lip 58 of the closure component support portion 56 and the support portion 34 of the closure component 30 (see FIGS. 16 and 17).

In use, the container appears as shown in FIG. 15. The bag 42 is pressed downward into the compartment 14 until it is tightly drawn over the closure component 30.

Removal of the bag 42 when full is achieved, when the lid 18 is open, by lifting the front side of the closure component 30 upward relative to the hinged rear side to remove the flange of one part of the bag 42 from its securing between the closure component 30 and the closure component support portion 56 (see FIG. 17). The released flange of the bag 42 may then be inserted through the opening 16 and the closure component 30 removed to enable the flange of the bag 42 to be closed and lifted out of the compartment 14.

Figure 18:
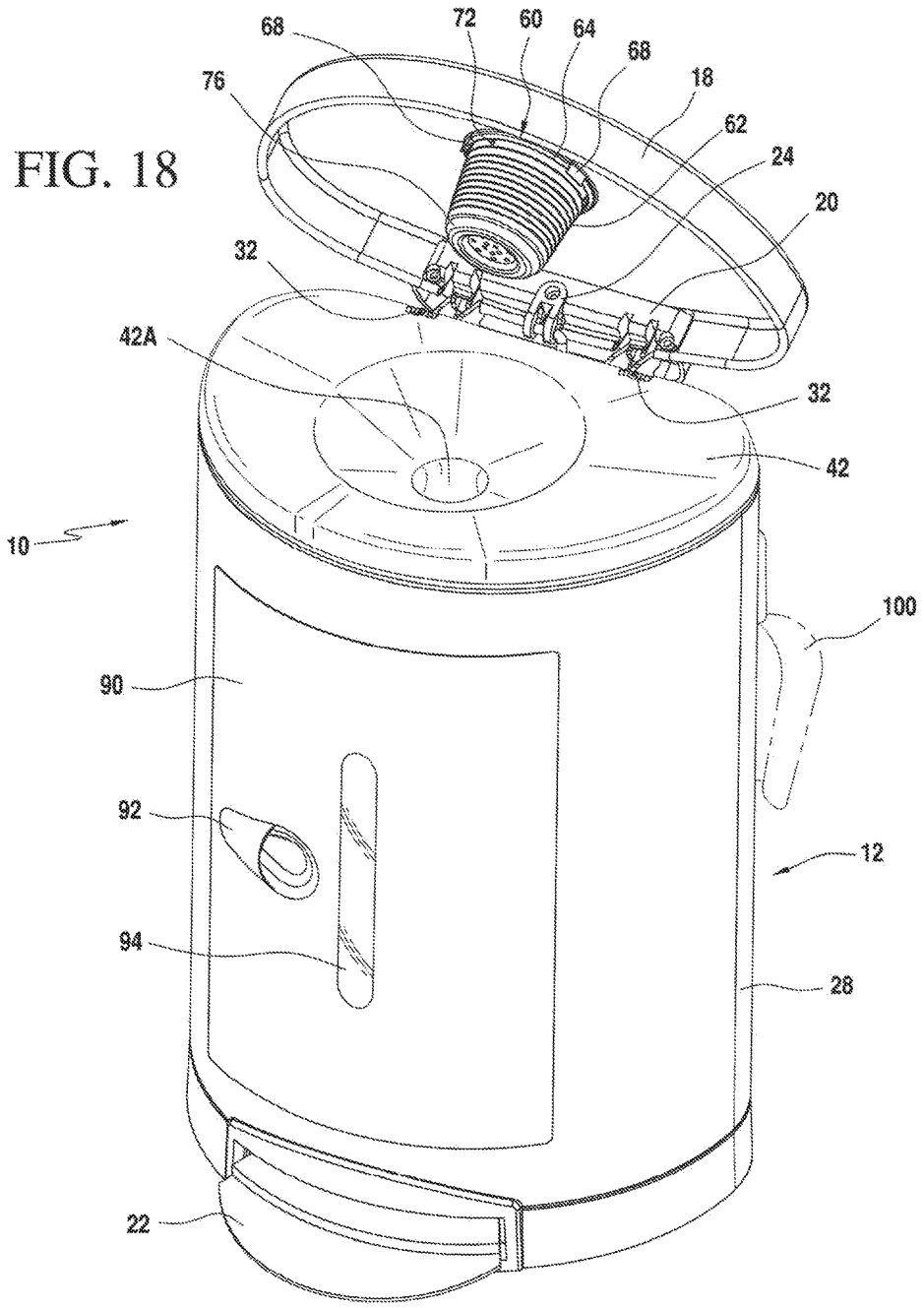
FIG. 18 is a perspective view of another embodiment of a waste container in accordance with the invention.
Figure 19:
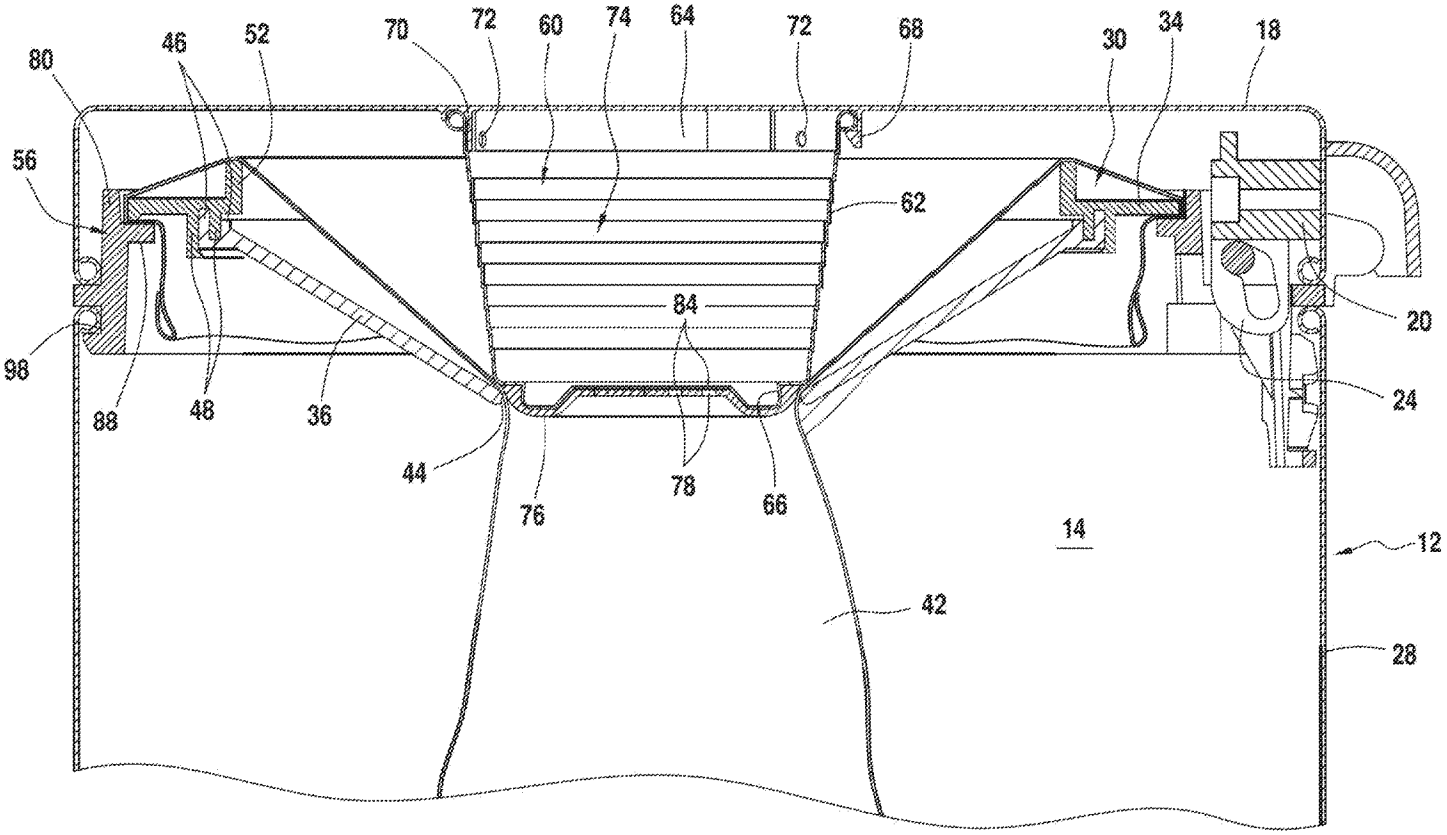
FIG. 19 is a cross-sectional view of a portion of the container shown in FIG. 18 with the lid in a closed state.

FIGS. 18 and 19 show another embodiment of container 10 wherein the closure component 30 retains a membrane 36 but is used without a hoop. As in the embodiment shown in FIGS. 15-17, the closure component 30 is pivotally attached to the base 12 of the container 10 via hinges 32 (see FIG. 18). For use, the bag 42 may be placed through the central opening 44 of the membrane 36 and then the flange of the bag 42 folded back on itself and around the support portion 34 of the closure component 30. The bag 42 and the closure component 30 are then placed on the closure component support portion 56 such that the bag 42 is secured between the inwardly projecting lip 58 of the closure component support portion 56 and the support portion 34 of the closure component 30 (see FIG. 19).

In use, the container appears as shown in FIG. 18 and is used in a similar manner as the container shown in FIGS. 15-17.

Figures 24, 25:
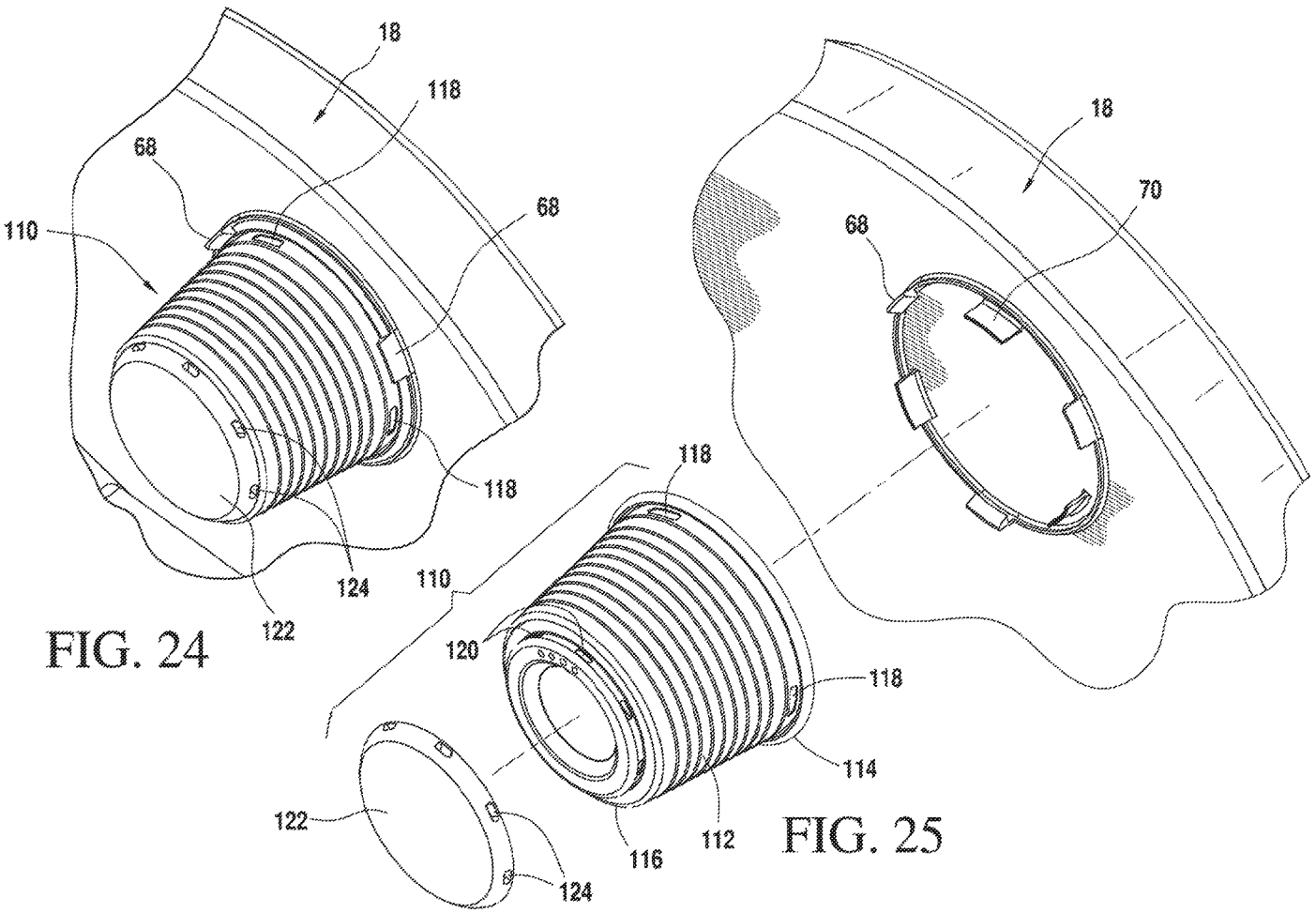
FIG. 24 is a perspective view of a second embodiment of a waste treatment component in accordance with the invention.
FIG. 25 is an exploded perspective view of the waste treatment component shown in FIG. 24.

Referring now to FIGS. 24 and 25, another embodiment of a waste treatment component that may be used in any of the embodiments disclosed herein is designated generally as 110 and includes a base 112 having an attachment portion 114 at an upper end and a conduit portion 116 at a lower end. Attachment portion 114 may comprise an enlarged rim that is designed to be positioned between projections 68, 70 on the underside of the lid 18 (see FIG. 25). Waste treatment component 110 may have features that are the same as or similar to those in waste treatment component 60, and vice versa, to the extent possible.

Also, attachment portion 114 includes apertures 118 that are preferably equal in number to the projections 68 and have the same circumferential spacing as the projections 68. In this manner, the waste treatment component 110 may be rotated to a position in which the projections 68 cover the apertures 118, and thereby prevent release of deodorant or disinfectant from an interior cavity of the waste treatment component 110 to the space between the bag 42 and the lid 18, or allow for release of deodorant or disinfectant from the interior cavity of the waste treatment component 110 to the space between the bag 42 and the lid 18 (this latter position being shown in FIG. 24). Like for attachment portion 64 as mentioned above, the number of apertures 118 in attachment portion 114 may be different than the number of projections 68.

Rotation of the waste treatment component 110 can be effected manually depending on whether the user of the container 10 determines that there is a need to address unpleasant smells and odors between the bag 42 and the lid 18 or disinfect this area (or to neutralize bacteria, fungus, etc. or whatever treatment is being effected by the material in the waste treatment component 110). Rotation of waste treatment component 110 therefore controls the degree to which deodorant, disinfectant, air freshener, air purifier, antibacterial material, etc. is dispensed, released, distributed or disseminated into the space between the lid 18 and bag 42.

In contrast to the waste treatment component 60, in waste treatment component 110, the apertures 118 have a generally oval shape instead of a circular shape of apertures 72 (compare FIGS. 23 and 25). An oval shape for the apertures 118 generally allows for more deodorant, disinfectant or other waste treatment material in gaseous or powdered form, to pass therethrough.

Conduit portion 116 is formed as the bottom of the base 112 and includes a plurality of apertures 120 on and extending through a side face or surface through which deodorant or disinfectant from the interior cavity of the waste treatment component 110 is released to the interior of the bag 42 (see FIGS. 24 and 25). This side face may be part of a peripheral wall of the base 112. This is in contrast to waste treatment component 60 wherein the conduit portion 66 includes apertures 84 on a bottom surface (see FIG. 23). In further contrast, apertures 120 are oval shape as opposed to circular apertures 84 (see FIG. 25). Otherwise, waste treatment component 110 also includes a lower solid (lacking apertures) wall and the peripheral wall extending to one side of and from the lower wall. The interior cavity of the waste treatment component 110 is formed on one side of the lower wall and another cavity or compartment is formed on the opposite side of the lower wall (which is also receivable of waste treatment material (see FIGS. 32A-32C). The conduit portion 116 thus includes the solid, lower wall of the base 112 and a rim surrounding and radially outward of this solid, lower wall, with the apertures 120 in the peripheral wall of the base 112 being situated on an outer surface of the rim, Release of deodorant or disinfectant is controlled by the user by a rotatable member 122 attached to the base 112 to selectively cover or expose the apertures 120 (see FIGS. 24 and 25). Rotatable member 122 includes oval-shaped apertures 124 that selectively align with apertures 120 on the conduit portion 116 and/or solid portions of the conduit portion 116. To this end, the apertures 124 are situated in a side portion of the member 122 that is opposite and/or spaced apart from the portion of the peripheral wall of the base 112 having the apertures 120. There may be an equal number of apertures 124 as apertures 120 and they may have the same spacing to provide a relative positioning between the member 122 and the base 112 in which all of apertures 120 align with a respective aperture 124 (maximum outflow of waste treatment material) and a relative positioning between the member 122 and the base 112 in which all of apertures 120 are occluded by a solid portion of the member 122 (minimum or no outflow of waste treatment material). A different number of apertures 124 than apertures 120 may also be provided. When attached to the base 112, the member 122 at least partly and, as shown, fully, overlies the conduit portion 116, see FIG. 24, thus covering the rim of the base 112. The apertures 124 extend around the periphery of the member 122, close to the outer radial edge of the member 122.

One or more click stops may also be integrated into the waste treatment component 110 to guide the alignment of the apertures 124 relative to apertures 120. One embodiment includes four click stop detents that go from full opening (superimpose one over the other) to full closing.

Rotation of member 122 therefore controls the degree to which deodorant, disinfectant or other waste treatment material is released into the bag 42 from waste treatment component 110.

Member 122 may be provided with a bull nose or rounded face, or rounded portion that is opposite to the lower wall of the base 112, to facilitate pushing of waste through the bag aperture 42A. To this end, the waste treatment component mounting mechanism, i.e., projections 68, 70, are preferably positioned to align the member 122 with the central opening 44 of the membrane 36. Thus, during use of the container 10, any waste that is lodged in the bag 42 around the central opening 44 of the membrane 36 should be pushed by waste treatment component 110 into the portion of the bag 42 in the compartment 14 when the lid 18 is closed.

The presence of the bull nose on member 122 also improves the ability to clean the member 122 since it will likely come into contact with waste and be dirtied thereby during use of the container 10.

Instead of a removable mounting mechanism for the waste treatment component 110, a waste treatment component may be permanently attached to the underside of the lid 18.

Different constructions of a waste treatment component 110 are envisioned, in a similar manner as described above for waste treatment component 60.

Waste treatment components 60 and 110 may be used with waste disposal devices as described herein and shown in the drawings. However, waste treatment components 60, 110 are not limited to such uses and can be used in other waste disposal devices, for example, ones that do not include a membrane. Moreover, the base and member of these waste treatment components may be configured such that the space between the aligning apertures in the member and the base is sufficient to allow for placement of another, optional waste treatment material (additional to that placed into the between the apertures, or in the alternative, close to one another to preclude placement of waste treatment material therebetween.

Figure 30:
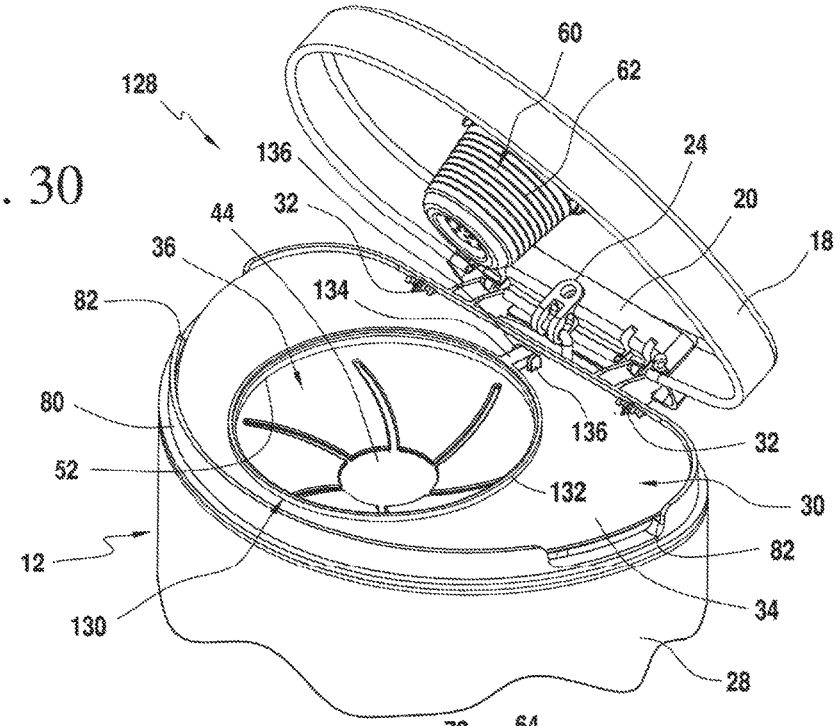
FIG. 30 is a partial view of a waste container in accordance with the invention showing a hoop is pivotally attached to the membrane support portion.

Referring now to FIG. 30, in this embodiment of a waste container, designated generally as 128, a hoop 130 is pivotally attached to the support portion 34 of the closure component 30 by a pivotal support mechanism, also referred to as pivotal mounting means. More specifically, the hoop 130 includes a substantially circular portion 132 and a flange 134 projecting outward from the circular portion 132, i.e., in a direction toward the rear side of the container as shown in FIG. 30. Two mounting projections 136 are arranged on the upper surface of the support portion 34. One or more pins (not shown) are then used to connect the flange 134 to the projections 136 to facilitate pivotal movement of the hoop 132 about a pivot axis defined by the pin(s).

This pivotal mounting of the hoop to the support portion 34, or more generally to the closure component 30, may be applied in any of the embodiments of a waste container disclosed herein.

It is possible to remove the hoop 132 from the projections 136 and store the hoop 132 on the underside of the lid 18, as described above. Thus, the waste container 128 may be used with or without the hoop 132. For example, different uses may be optimal for different sizes of the bag 42. For use with a relatively smaller bag, the hoop 132 would be installed and the bag secured between the hoop 132 and the projecting wall 58. For a relatively larger bag, the hoop 132 would be removed and the bag secured between the closure component 30 and the body 28, as described above.

Figure 31:
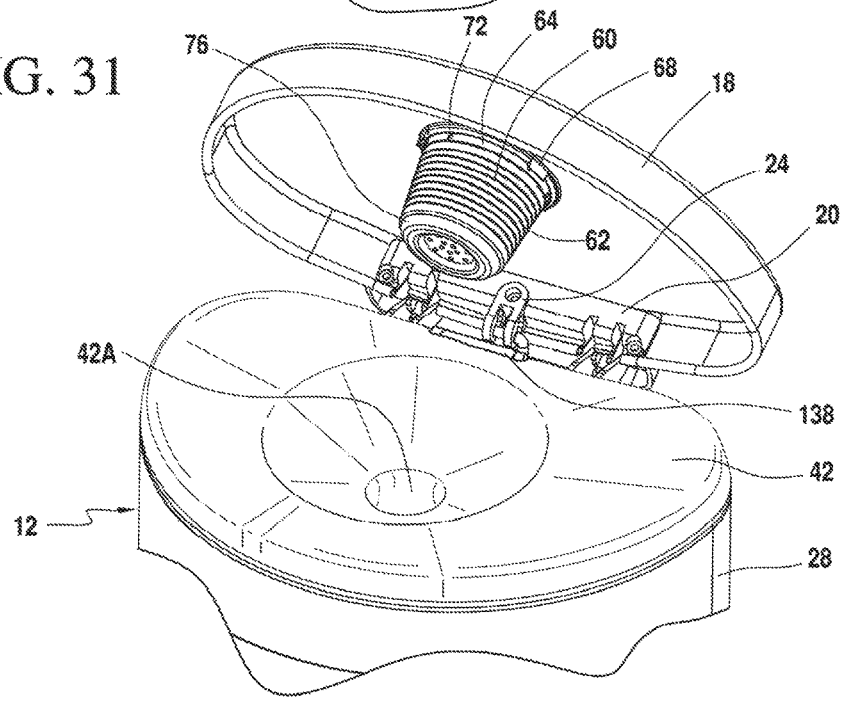
FIG. 31 is a partial view of a waste container in accordance with the invention showing a single hinge attached the membrane support portion to the base of the waste container.

Referring now to FIG. 31, another variation of the closure component 30 that may be applied to any of the embodiments of the waste container disclosed herein is to provide a single hinge 138 at the rear of the waste container. This single hinge 138 replaces the pair of spaced apart hinges 32 in some of the embodiments disclosed above. By providing a single hinge 138, instead of a pair of hinges 32, an advantage obtained when the bag 42 is installed is that the bag 42 may be more securely attached to the waste container 10 generally and more specifically to the closure component 30. Moreover, in this embodiment, the only pivotal connection between the body 28 and the closure component 30 is the single hinge 138, one part of which is connected to the body 28 and another, complementary part of which is connected to the closure component 30.

In the illustrated embodiments, the cross-sectional shape of the container taken in a horizontal plane when the container rests on a horizontal surface has a generally D-shape, i.e., may be referred to as a D-shaped container. The foot pedal 22 is situated at a central region of the curved edge of the D-shape and the lid mounting means are situated along the straight edge of the D-shape. The lid 18 therefore pivots about a horizontal axis extending in a direction substantially parallel to the straight edge of the container 10.

The waste containers in accordance with the invention optionally include a membrane which may be any of those shown in FIGS. 26-28. Each membrane 36, 36A, 36B may be used in any of the embodiments described herein, when a membrane is used (since some embodiments of the waste container described herein do not include a membrane). Alternatively, other membranes, such as disclosed in U.S. Pat. No. 8,215,089 (Stravitz) and U.S. Pat. No. 8,266,871 (Stravitz), both of which are incorporated by reference herein, may be used in the invention.

An advantage of the embodiments of the waste container described herein is that an inner liner for the base 12 is not required. Rather, the bag 42 serves as the liner for the base 12 and prevents waste from coming into contact with the inner surfaces of the body 28 of the base 12.

The type of bag 42 used in the containers disclosed herein may be any type of bag known to those in the waste disposal art. Any type of commercial garbage bag may be used. Deodorizing garbage bags may be used, e.g., a bag made of 7 layer EVOH and serves as an oxygen barrier. For some uses of the container 10, e.g., for cat litter and medical waste, it is preferable that the bag 42 not touch the bottom of the compartment 14 to allow for a cleaner funnel for gravity related substrates. This will insure a better tapered opening to receive the waste, especially as the bag 42 takes on weight from accumulating waste.

On the other hand, for waste that is urged into the bag aperture 42A, such as for example diapers, the bag can be longer to rest on the bottom of the compartment 14 or just touch the bottom, or be shorter than the bottom. The funneling (directing) and hands-free operations that are more necessary in cat litter and medical waste applications, are less prevalent for diaper disposal which requires urging or forced insertion of the waste through the bag aperture 42A and the central opening 44 of the membrane 36 into the portion of the bag 42 in the compartment 14.

If the bag 42 has a drawstring, the drawstring may be accessed and pulled to close the bag 42, either before or after the bag 42 is removed from engagement with the closure component 30 or membrane 36. In the former case, the pulled drawstring may be tied and then pushed into the compartment 14 so that when the closure component 30 is lifted up, the bag 42 is already closed. Alternatively, when a door 90 is provided, the door 90 may be opened to access and remove the closed bag 42.

The containers described above are not limited to use for any particular type of waste. The containers may be used for cat litter, diapers for children or adults, kitchen products, bathroom waste, medical waste, general waste and the like.

For medical use, it is possible to use the container in a hands-free mode whereby the user with medical waste uses their foot to open the lid 18 by depressing the foot pedal 22 and then drops the medical waste into the bag aperture 42A or along the portion of the bag 42 that overlies the funnel-shaped membrane 36. By the effect of gravity, the waste falls through the bag aperture 42A into the portion of the bag 42 in the compartment 14. For bio-hazardous waste, a red-colored bag 42 may be used. The lid 18 remains open as long as the user keeps their foot on the foot pedal 22. When pressure on the foot pedal 22 is released, the lid 18 closes and the waste treatment component 60, 110 forms a comfortable, temporary seal keeping bacteria and fungus and smell from migrating upward from the waste in the bag 42 in the compartment 14.

This should prevent potentially harmful airborne fungus and bacteria from finding their way up to the inside top and edges of the lid 18, and thus prevent the release of these organisms to enter the room in which the container is situated and find their way up through vents in hospitals and nursing homes and doctor's offices, etc.

Thus, the waste treatment components 60, 110 when used in the container 10 in accordance with the invention provide three important functions, control of odor below the lid 18 (i.e., in the space between the lid 18 and the portion of the bag 42 that overlies the membrane 36), control of odor below the membrane 36 (inside the portion of the bag 42 in the compartment 14 in which waste is retained), and seal in offensive and potentially harmful odor when the lid 18 is closed. This combination of three features renders the container 10 including the waste treatment component 60, 110 extremely useful for all types of waste as described above.

An important feature of the invention that arises from the fact that the membrane 36 does not rotate relative to the base, as is common in some prior art waste disposal devices (e.g., in the U.S. patents mentioned above). Since the membrane 36 does not rotate, there is no restriction or limitation on the size and shape of the membrane 36, which are often present when a membrane has to rotate for operation of a waste disposal device.

Figure 32A:
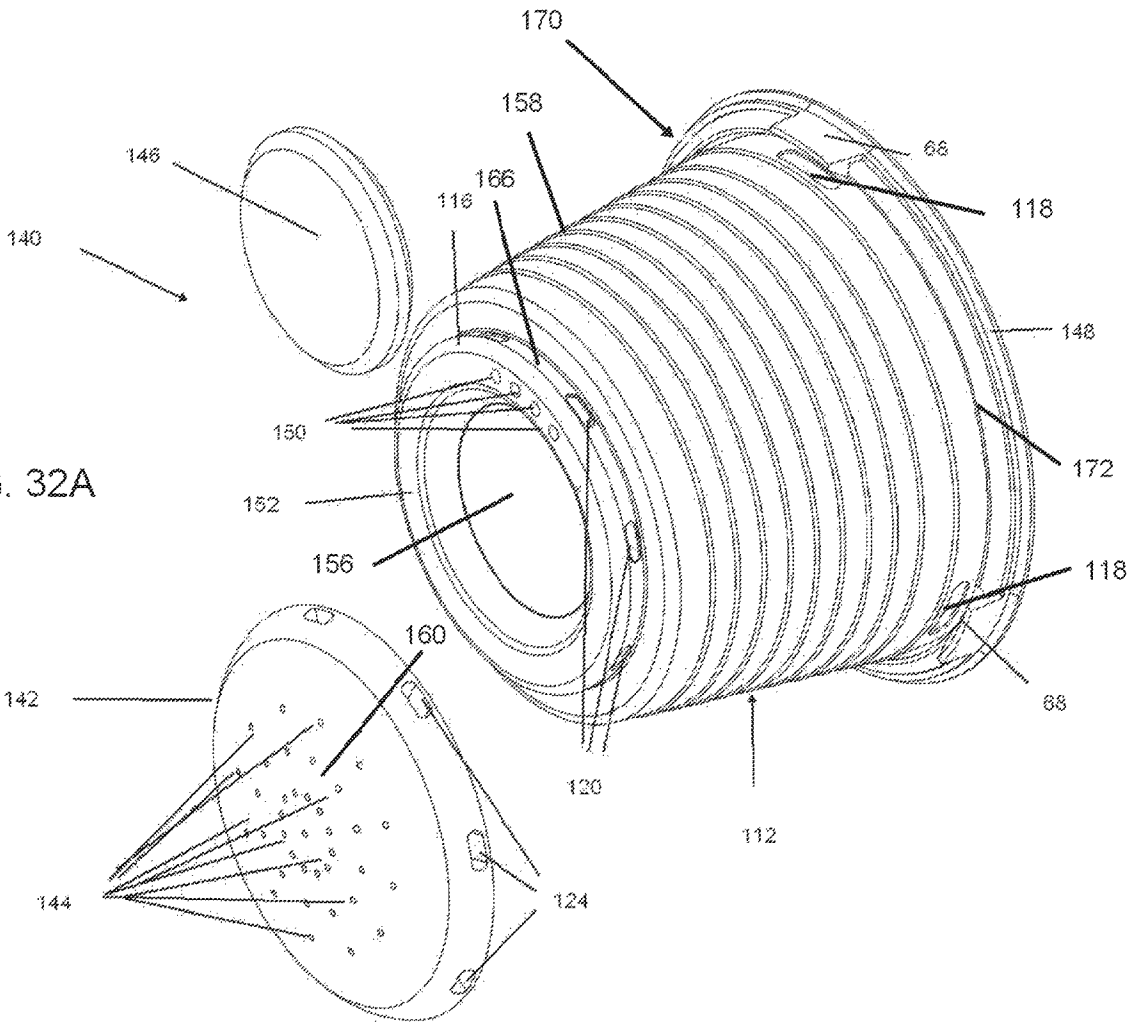
FIG. 32A is a perspective view of another embodiment of a waste treatment component in accordance with the invention.
Figure 32B:
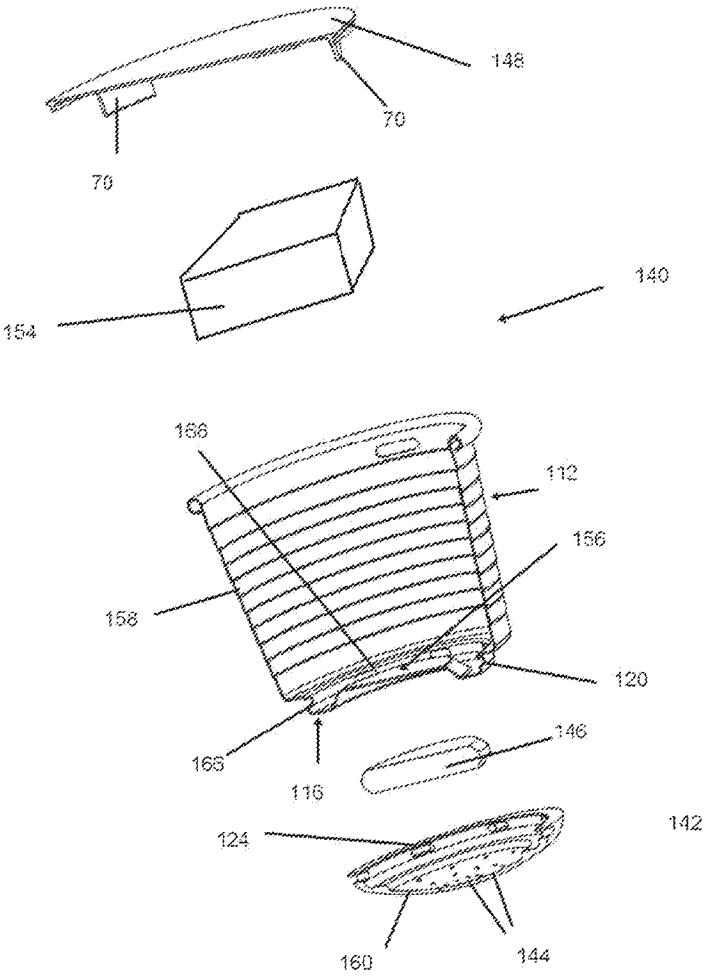
FIG. 32B is an exploded cross-sectional view of the waste treatment component of FIG. 32A.
Figure 32C:
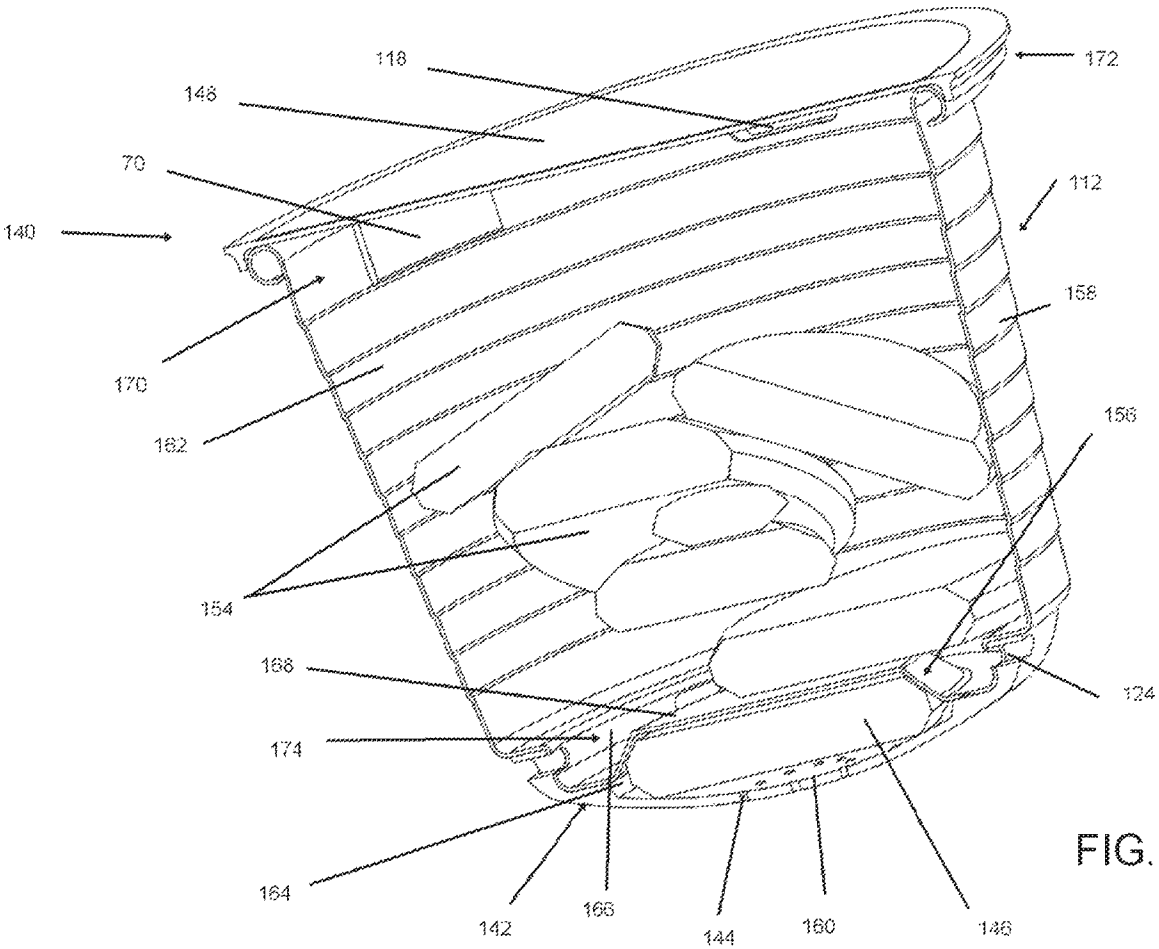
FIG. 32C is a cross-sectional view of the waste treatment component of FIG. 32A.

Referring to FIGS. 32A-32C, another embodiment of a waste treatment component 140 in accordance with the invention is shown. Waste treatment component 140 includes components similar to waste treatment component 110, namely the base 112 and a rotatable member 142 that is similar to rotatable member 122 except that it includes apertures 144 in a portion 160 opposite to the (first) lower wall 156 of the base 112. Rotatable member 142 is attached to the base 112 to at least partly cover the (first) lower end 174 of the base 112, e.g., partly or completely cover the lower wall 156 of the base 112.

A gel bar 146 or other form of deodorant or disinfectant may be optionally positioned in the space between the wall 156 of the conduit portion 116 of the base 112 and a portion 160 of the rotatable member 142 spaced apart from the wall 156, and thus the apertures 144 facilitate enable release of the deodorant or disinfectant for gel bar 146. This space defines a second or additional compartment 164 receivable of waste treatment material (gel bar 146, see FIG. 32C), whose dispersal is effected via the pattern of apertures 144 in the portion 160 of the member 142 that is opposite (faces) the solid lower wall 156 of the base 112. The solid lower wall 156 of the base 112 therefore separates two waste treatment material-receivable compartments, i.e., has one compartment 162 formed on one side 168 and another compartment 164 formed on the other, opposite side (see FIG. 32C).

Waste treatment component 140 can be a stand-alone unit, and to this end, includes a cover 148 that covers the open upper end 170 of the base 112. Thus, there is a lower, solid wall 156, a peripheral wall 158 extending to one side 168 of and from the lower wall 156 (both defined by the base 112) and an upper wall defined by the cover 148 that removably engages with the base 112. Cover 148 includes the projections 68, 70 shown in FIG. 23 (the purpose, function and location of which are described above). Cover 148 is provided with an attachment device (not shown) to attach the cover 148, and thus the waste treatment component 140 when the base 112 is attached to the cover 148, to for example, the underside of a lid of a waste container. Since this embodiment is not required to be used for a waste container, the waste treatment component 140 can also be considered a deodorant or disinfectant and attached to other surfaces, whether a vertical surface in a closet or on a wall or a horizontal surface such as a ceiling or floor. The attachment device may be adhesive tape, hook and loop fasteners and the like.

Another advantage of this embodiment is that it is possible to place different compounds in the base 112 (in compartment 162) and between the base 112 and the rotatable member 142 (in compartment 164). Distribution of each compound is independent, i.e., distribution of the material of the gel bar 146 is through the apertures 144, and distribution of the compounds 154 in the base 112 is through the aligning apertures 120, 124 and selectively closed apertures 118 in attachment portion 172 (see FIGS. 32A and 32C). Alternatively, a compound may be placed only in the upper compartment 162 defined by the base 112, as described above, without use of the gel bar 146 Alternatively, it is possible to cause mixture of two compounds, with the compound in the upper compartment 162 defined by the base 112 passing into the compartment 164 defined between the base 112 and the rotatable member 142 through apertures (e.g., like apertures 84 defined in the bottom of the base 112 as shown in FIG. 23), mixing therewith and then being dispensed through apertures 144. Click stops 150 are formed in the rim 152 to control rotation of the member 142.

Referring now to FIGS. 33-36, other embodiments of the invention use a component similar to the hoop 58 to secure an upper portion of a bag to prevent rotation of the top of the bag. These embodiments may be used in a variety of different waste containers and the arrangement of the bag securing assemblies or components is not limited to any specific waste container. For example, the waste container may be a basic waste container with a lid that closes or opens the opening into the bag. The bag may or may not rotate. The bag is preferably secured against falling into the waste-receiving space of the waste container.

The waste container may be one that has a rotation mechanism operative against a portion of the bag above the bottom or a hanging portion of the bag. With this type of waste container, the bag is prevented from rotating at its upper region when a lower portion of the bag is being operatively rotated by the rotation mechanism, thereby enabling formation of a twist in the bag or the bag to be untwisted, depending on the direction of rotation and the configuration of the rotation mechanism. Advantages of the twist to prevent egress of odor and bacteria are known to those skilled in the art to which this invention pertains, and disclosed in patents mentioned above.

Another possible waste container that may utilize the bag securing assembly or component of the invention is one in which the bag securing assembly or component itself is rotated to cause the formation of a twist in the bag, or to untwist the bag, again depending on the direction of rotation and the configuration of the rotation mechanism. In this case, the waste is held against rotation while the upper region of the bag is rotated.

Thus, in general, the bag securing assembly and component embodiments described below may be used in various waste containers, or waste disposal devices.

In a first one of these embodiments, in FIGS. 33-36, a waste container 200 receives an insert 202 to which a bag 204 is attached, and also includes a base 196 and a lid 198 operative to control access to a waste insertion opening, and having structure as described in any of the embodiments herein. The insert 202 rests on a support 206 in the waste container 200. The insert 202 may have a form similar to the form of cartridges conventionally used in waste disposal devices. However, the insert 202 differs from cartridges in that it does not include pleated tubing (conventional cartridges have accordion-folded or pleated continuous tubing). Rather, the insert 202 has a single bag 204 attached to it. This attachment may be by means of adhesive or other comparable attachment structure. Alternatively, the bag 204 may be wrapped around the insert 202, or part thereof, and then trapped so as to be prevented from being dragged into the waste container.

In one particular embodiment, a bag will be slipped through the opening defined by the insert, and/or through an optional membrane 194 (see FIG. 35), and while empty, wrapped around the insert 202 or part thereof sufficiently such that the bag is then trapped at or against at least one bag-engagement surface (such as at a top edge of the insert over which the bag 204 is draped). This trapping technique, or a comparable attachment mechanism, functions to attach the bag 204 around its periphery to an annular surface of the insert 202, possibly a radially outward facing surface of an inner wall of the insert 202.

Figure 36:
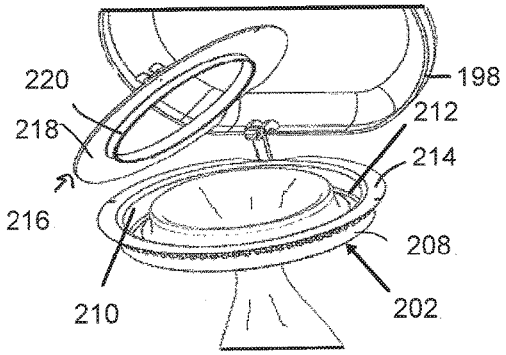
FIG. 36 is a view showing internal parts of the waste container shown in FIG. 33.

For example, as shown in FIG. 36, the insert 202 includes a vertically oriented outer peripheral, circular wall 208, a vertically oriented inner peripheral, circular wall 210, a horizontal annular bottom wall 212 extending between lower edge regions of the outer wall 208 and the inner wall 210, and a support flange or lip 214 extending radially outward from an upper edge region of the outer wall 208. The insert 202 is supported on the support 206 by the support lip 214 that rests on the support 206 of the waste container 200, whether in contact therewith or with an interposition.

Figure 33:
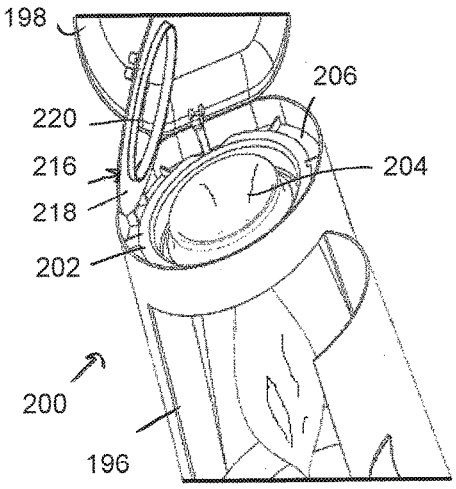
FIG. 33 shows another embodiment of a waste container in accordance with the invention with a closure component in a non-engagement position.
Figure 34:
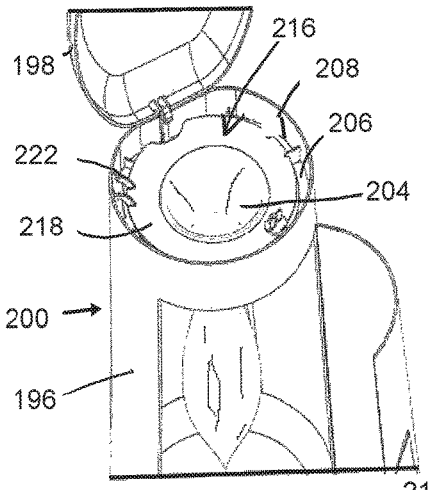
FIG. 34 shows the embodiment of a waste container in accordance with the invention as shown in FIG. 33 with the closure component in an engagement position.

The bag 204 may be trapped against or attached to the radially outward facing surface of the inner wall 210 so that the bag 204 passes over the upper edge of the inner wall 210 and then into the interior waste-receiving space of the container 200 (see FIG. 33). A bag-engagement surface is thus formed by the inner wall 210 at or around its top edge, and on the radially outward facing surface and on the radially inward facing surface.

To maintain the upper region of the bag 204 fixed against rotation and prevented from being dragged down into the waste container when waste is introduced, a closure component 216 may be pivotally attached to the waste container 200, e.g., to the support 206 of the waste container 200. Closure component 216 includes a horizontal annular disc portion 218 and a vertically oriented rim 220 extending downward from the inner edge of the disc portion 218 (see FIG. 36) to provide the closure component 216 with an "L"-shaped cross-section. The rim 220 serves to engage the bag 204 securely at at least one edge. It is possible that engagement here can be on up to three sides of the bag, i.e., the top, side and bottom edge, if the rim 220 has a channel accommodating the top edge of the insert 202.

Figure 35:
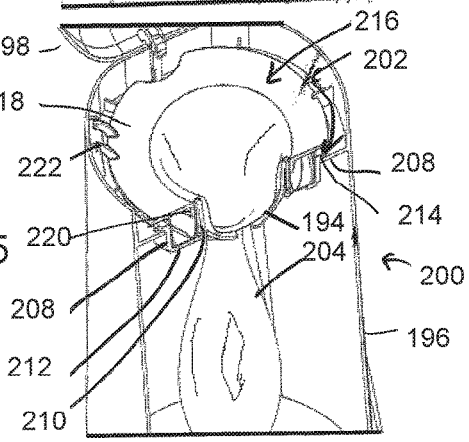
FIG. 35 is a partial cross-section of FIG. 34.

In the embodiment with only a single bag-engagement surface being provided, the location of the rim 220 is coordinated to the dimensions of the insert 202 to cause the rim 220 to fit slightly inward of the inner wall 210 with the result that the bag 204 is sandwiched with tight fit between the rim 220 and the inner wall 210 (see FIG. 35). This tight fit, e.g., with the rim exerting outward pressure toward the inner wall 210 and thus pressing the bag 204 against the outer surface of the inner wall 210, prevents movement of the upper region of the bag 204, e.g., in the event of rotation of a lower region of the bag or waste therein. While not shown, it is possible for the rim 220 to engage the inner wall 210 on the inner portion of the inner wall 210. Here engagement can be in up to two places, namely, with the rim 220 exerting inward pressure toward the inner wall 210 and thus pressing the bag 204 against the inner surface of the inner wall 210, and also with the horizontal portion 218 of the closure component 216 pressing against the top edge of the insert 210.

In the illustrated embodiment, by virtue of the "L"-shaped cross-section of the closure component and the design to provide the rim 220 inward of the inner wall 210 of the insert 202, causes engagement between the closure component 216 when in an engagement position and the insert 202 at only a single bag-engagement surface, i.e., the radially inward facing surface of the rim 220 presses the bag 204 against the radially outward facing surface of the inner wall 210. As mentioned above, it is also possible to provide an embodiment, although not shown, in which the radially outward facing surface of the rim 220 presses the bag 204 against the radially inward facing surface of the inner wall 210. In this case, the bag would be trapped equally as well, although you are closing the opening being provided by the bag 204 by a wall thickness of the rim 220. One advantage here might be that the upper area of the bag is being protected from possibly stretching or even tearing, since it is under the rim 220.

The structure 222 that pivotally attaches the disc portion 218 to the support 206 may be any known pivotal attachment structure.

FIGS. 37-39 show another embodiment wherein a waste container 224 includes a support 226 having recesses 228 and that is designed to receive an insert 230. Insert 230 includes an annular disc 232 and projections 234 projecting from an outer peripheral edge thereof, the projections 234 being received in the recesses 228. To this end, the projections 234 preferably have a shape, size and position to enable them to fit into the one or more recesses 228. By providing recesses 228 on the waste container 224 and projections 234 on the insert 230, rotation of the insert 230 relative to the waste container 224 is prevented. This rotation may arise if the waste container 224 is provided with a rotation mechanism to rotate the waste or bag in order to form a twist. However, if the waste container does not include a rotation mechanism, then the recesses 228 and projections 234 on the insert 230 are unnecessary, and a comfortable interference fit may be provided between the insert 230 and the waste container 224. Moreover, the projections 234 could be inward recesses if the waste container has inwardly oriented projections. Instead of multiple projections 234, a single projection 234 may be provided. Also, anti-rotation of the insert 230 may be provided by suitable shaping of the annular disc in an alternative shape to generally round, e.g., square-shaped.

Annular disc 232 also includes a vertically oriented inner peripheral, circular wall 236, a horizontal ledge 238 extending radially inward from the upper edge of the inner wall 236 and a small vertically oriented annular wall 240 extending from the inner edge of the ledge 238 (see FIG. 39). The ledge 238 and annular wall 240 may be omitted and an annular disc provided with only the inner wall 236.

Insert 230 also includes a closure component 242 that is pivotally connected to an upper surface of the annular disc 232 by an attachment structure 244 known to those skilled in the art to which this invention pertains. For example, attachment structure 244 includes a pivot pin 298 mounted between a first support part of the closure component 242 and a second support part of the annular disc 232 elevated from the upper surface of the annular disc 232. Attachment structure 244 is thus elevated in a common direction from the annular disc 232 as the bag-engagement edge(s), i.e., the one or more edges defined by the circular wall 236, ledge 238 and/or annular wall 240 at the inner bag-engagement edge region of the annular disc 232. Also, attachment structure 244 is shown between an exposed outer edge 276 of the annular disc 232, which is defined by an outer edge region and faces away from the aperture defined by the insert 230, so that the attachment structure 244 is situated between the exposed outer edge 276 of the annular disc 232 and the bag-engagement edge(s) defined by the annular disc 232.

Closure component 242 serves to fix the bag 204 to the inner wall 236, ledge 238 and annular wall 240, providing three bag-engagement surfaces. To this end, the closure component 242 includes an annular portion 246 having a U-shape cross-section (see FIG. 38). The cross-section includes a vertically oriented outer wall 248, a vertically oriented inner wall 250 and a horizontal transverse wall 252 which together define a channel 254 oriented downward. When engaged with the annular disc 232, the outer wall 248 surrounds and presses the bag 204 against the inner wall 236 of the annular disc 232 (a first bag-engagement surface), the inner wall 250 is inward of and presses the bag 204 against the annular wall 240 of the annular disc 232 (a second bag-engagement surface) and the transverse wall 252 presses the bag 204 against the ledge 238 (a third bag-engagement surface, as shown in FIG. 39.

It is possible for the closure component 242 to have an "L"-shaped cross-section, and designed to overlie the inner wall 236 with slight clearance to thereby provide a two bag-engagement surface embodiment, i.e., along the top of the inner wall 236 and along its radially inward facing surface which would be pressed by the top of the closure component and the radially outward facing surface of the rim of the downwardly facing rim of the closure component.

With this construction of the annular disc 232 and the closure component 242, the bag 204 can be secured by the closure component 242 to the annular disc 232 with three bag-engagement surfaces. Alternatively, if the closure component is "L"-shaped, the bag 204 would be secured by the closure component 242 to the annular disc 232 with two bag-engagement surfaces.

Closure component 242 also includes a tab 256, e.g., opposite the pivotal attachment point, to facilitate easy lifting of the closure component 242. Instead of a tab 256, a small raised rib may be provided, which is pinched to lift it along with the closure component 242. Generally, the tab 256 represents means for enabling lifting of the closure component.

In use, a bag may be obtained and inserted into the opening defined by the insert 230 into the waste-receiving compartment of the waste container 224 while the closure component 242 is pivoted into an upper, non-engagement position. An upper edge region of the bag 204 is held, and placed around the inner wall 236, overlying the ledge 238. The closure component 242 is then pivoted onto the annular disc 232 to cause the bag 204 to enter into the channel 254 and be pressed by the outer wall 248, inner wall 250 and transverse wall 252 against opposite portions of the annular disc 232. The bag 204 is thus secured in placed with the closure component 242 in an engagement position with the annular disc 232.

When the bag 204 is full of waste and it is desired to remove the bag 204, the closure component 242 is pivoted upward by grasping the tab 256 and lifting it upward, the open end of the bag 204 may be sealed, tied or clasped close and urged or inserted through the opening into the waste container with the bag 204 being removed from the waste container 224 through a front or side door. The insert 230 could also be designed to pivot upward to expose the interior of the waste container and then allow for removal of the bag 204 full of waste.

This embodiment also includes an optional membrane 194 below the insert 230, which membrane may be as disclosed above.

FIG. 40 shows a variant of the insert, designated insert 230A wherein the base portion of the insert is made of two parts (the closure component 242 being a third part of the insert 230A). Insert 230A includes an annular disc 232 with optional projections 234, and a separate wall portion 270 that has the inner wall 236, ledge 238 and annular wall 240 (see also FIG. 47). Moreover, the wall portion 270 includes an attachment structure 272 to enable the wall portion 270 to be attached to an inner edge of the disc 232. The attachment structure 272 may be an indentation that snap-fits to the inner edge of the disc portion 270, or is attached thereto by an interference fit, or by threads. Otherwise, the same features of insert 230 are present in insert 230A.

FIG. 41 shows a variant of the insert 230A, designated 230B, wherein elongate detents or ridges 258 are formed on the outer surface of the inner wall 236 of the wall portion 270. These detents 258 aid in the engagement of the closure component 242 with the annular disc 232. Detents may be provided on any of the inserts or closure components disclosed herein. Otherwise, the same features of insert 230 and/or insert 230A are present in insert 230B.

Figure 41A:
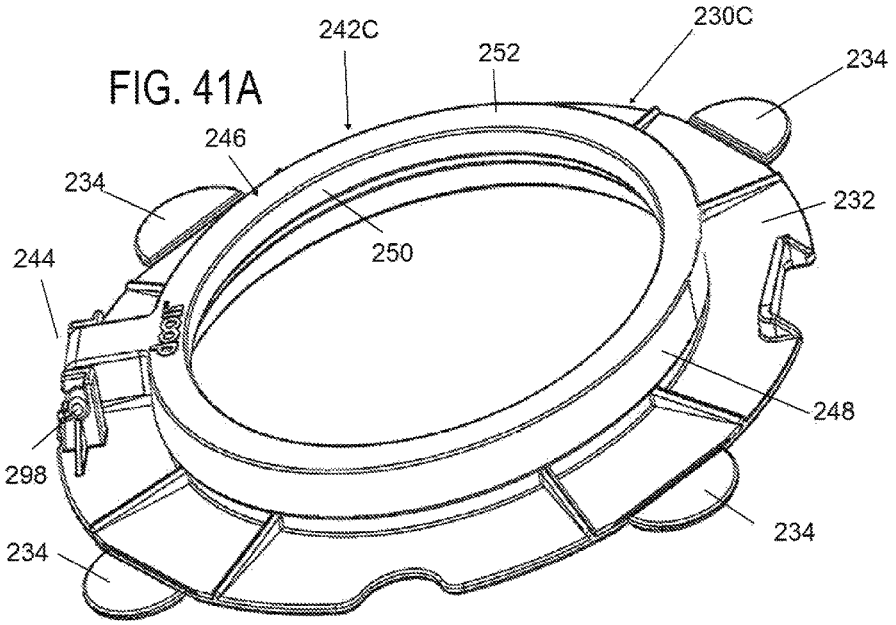
FIG. 41A is a perspective view of an alternative embodiment of an insert for a waste container in accordance with the invention.

FIG. 41A shows another variant of an insert for a waste container, designated 230C, which has the same features as any of insert 230 shown in FIGS. 37-39, insert 230A shown in FIG. 40, and insert 230B shown in FIG. 41, but insert 230C differs from these inserts 230, 230A, 230B in that its closure component 242C lacks the tab 256 as in inserts 230, 230A and 230B. Otherwise, closure component 242C may include the same features as closure component 242, which are not detailed here, but discussed elsewhere, e.g., those disclosed in FIG. 37-41. Projections 234 and the ridges on the upper surface of the planar portion of the disc 232 are optional. The tab 256 is an optional feature of the closure component 242 in inserts 230, 230A and 230B, and for the embodiment in FIG. 41A, it is omitted. Without the tab 256 on closure component 242C, the outer wall 248 has a circular outer edge aside from a location at which the attachment structure 244 is located. Even without the tab 256, it is possible to handle the closure component 242C to lift it up out of engagement with the disc 232 by, for example, grasping opposite sides of the closure component 242C, exerting pressure and lifting up. It is possible to handle the closure component 242C to press it into engagement with the disc 232 by pushing it down against the disc 232. The annular disc 232, attachment structure 244 and closure component 242C may have a unitary structure, i.e., form a single unit that is removable from or insertable onto the base of the waste container as a unit. The disc 232 and closure component 242C are not required to be circular and can have different shapes (see FIG. 61A).

With reference to FIG. 41A, another way to view the invention is with the annular disc 232 constituting a lower bag support structure defining an aperture and having a substantially planar portion around the aperture, and at least one bag-engagement edge or surface on an upper side of the planar portion, e.g., those defined by inner wall 236, ledge 238 and annular wall 240 (see FIG. 39). The closure component 242C constitutes an upper bag support structure having a first state in which it is connected to the lower bag support along a periphery of the planar portion thereof (via attachment structure 244 including pivot pin 298) and also engages with the inner wall 236, ledge 238 and/or annular wall 240 inward of the periphery of the planar portion. This provides multiple engagement locations between the upper and lower bag support structures when the upper bag support structure in is the first state (as shown in FIG. 41A). A bag can be pressed between the upper and lower bag support structure in this use state (see FIG. 39).

The upper bag support structure has a second state in which it is still connected to the lower bag support along the periphery of the planar portion thereof via the attachment structure including pivot pin 298, and does not engage with inner wall 236, ledge 238 and/or annular wall 240 inward of the periphery of the lower bag support structure (see FIG. 41). This enables insertion and removal of a bag between the upper and lower bag support structures inward of the periphery of the planar portion of the lower bag support structure when the upper bag support structure is in the second state. Insert 230C exerts pressure to retain the bag between the upper and lower bag support structures when the upper bag support structure is in the first state with the upper bag support structure (namely, the outer wall 248, inner wall 250 and/or transverse wall 252) engaging with the at least one bag-engagement surface of the lower bag support structure (inner wall 236, ledge 238 and/or annular wall 240) inward of the periphery of the planar portion of the lower bag support structure. As in other embodiments, the upper and lower bag support structure are a unitary structure when the upper bag support structure is connected to the lower bag support along the periphery of the planar portion of the lower bag support structure by the attachment structure 244 which enables the upper bag support structure to move between the first and second states, i.e., pivot upward relative to the lower bag support structure.

It can be seen from FIG. 41A that the attachment structure 244 and the bag engagement edge(s), i.e., inner wall 236, ledge 238 and annular wall 240, are elevated in a common direction from the planar portion of the lower bag support structure, disc 232. Also, the disc 232 includes an outer edge region defining an exposed outer edge facing away from the aperture in which the attachment structure 244.

Another way to consider the cooperation of the inner wall 236, ledge 238 and/or annular wall 240 of the disc 232 with the outer wall 248, inner wall 250 and transverse wall 252 to enable pressing of a bag between the disc 232 and the closure component 242C is that the closure component 242C includes first and second walls at different radial distances from a center of the aperture and separated by a space, with the disc 232 including first and second bag engagement edges configured to face a respective first and second wall of the closure component 242C when the closure component 242C is in the first state to thereby press the bag when present between the disc 232 and the closure component 242C. Yet another way is to consider that the closure component 242C includes first and second walls defining a channel 254 therebetween with disc 232 including first and second bag engagement edges (defined by inner wall 236, ledge 238 and/or annular wall 240, that enter into the channel to face a respective first and second walls when the closure component 242C is in the first state to thereby press the bag when present between the disc 232 and the closure component 242C.

FIG. 42 shows an embodiment wherein the closure component 242 is attached to the support 226 of the waste container 224 by an attachment structure 260, instead of being attached to the annular disc 232.

Figure 43A:
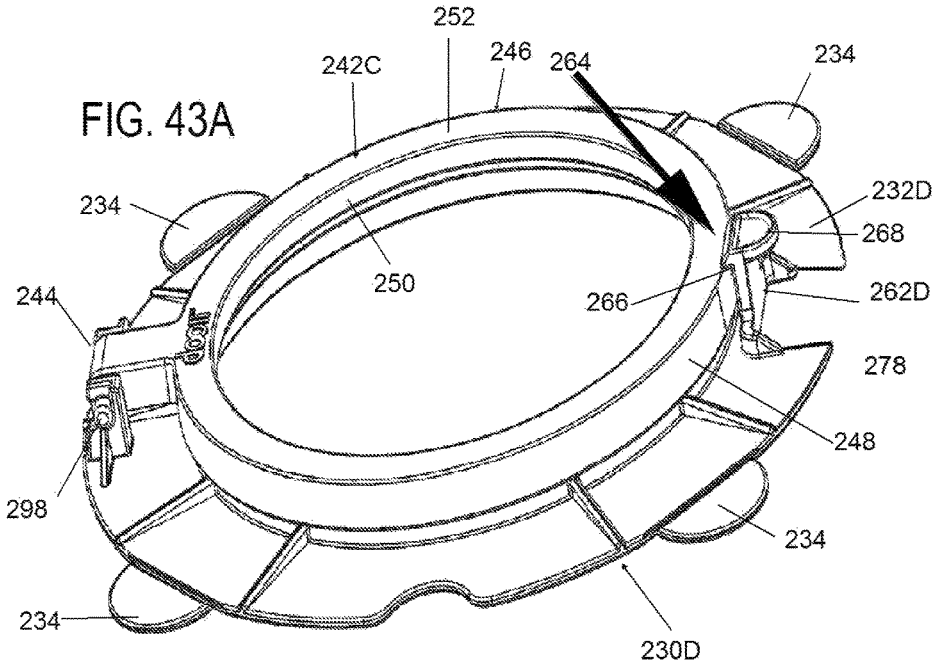
FIG. 43A is a perspective view of an alternative embodiment of an insert for a waste container in accordance with the invention.
Figure 43:
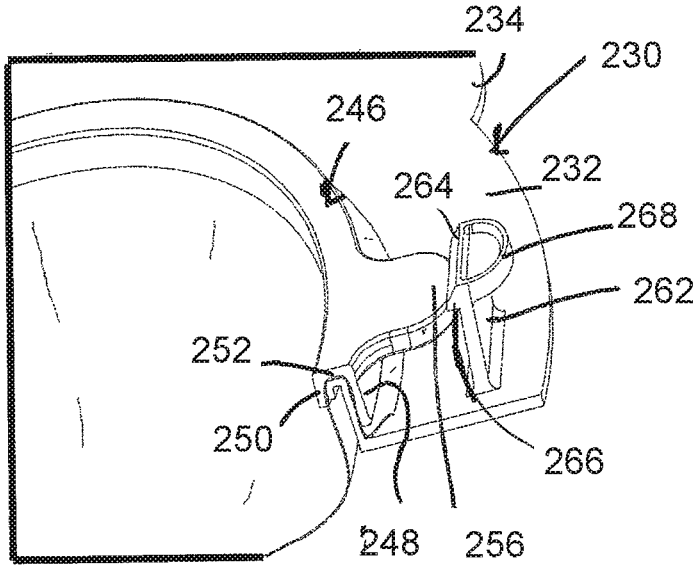
FIG. 43 is a partial cross-section showing a retainer for a tab.

FIG. 43 shows an embodiment wherein an optional retainer 262 is arranged on the annular disc 232, elevated in a common direction from the annular disc 232 like the structure that defines the bag-engagement edge(s), and engages with the tab 256 on the closure component 242 to prevent inadvertent disengagement of the closure component 242 from the annular disc 232. Retainer 262 may be provided in any embodiment disclosed herein wherein there is a tab 256. The retainer 262 is shown mounted on the upper surface of the annular disc 232. Alternatively, it may be integrated into the annular disc 232, or it may be arranged on or integrated with the support 226 of the waste container 224 or with another part of the waste container 224.

The primary change in use of this embodiment is only that when engaging the closure component 242 with the annular disc 232, the tab 256 is pressed downward against the angled surface 264 of the retainer 262 to cause the retainer 262 to flex rearward slightly and allow the tab 256 to be pressed into a position below the lip 266 when the retainer 262 returns to its initial position. The tab 256 could be rounded to make it easier to snap in and out without having to move the retainer 262 out of the way first. A half round profile for the tab 256 would allow you to lift the tab 256 and therefore urge the retainer 262 to spring away. Release of the tab 256 when seeking to disengage the closure component 242 from the annular disc 232 entails flexing the flange 268 of the retainer 262 rearward to allow the tab 256 to be released from its position below the lip 266.

FIG. 43A shows a variant of an insert, designated 230D. Insert 230D includes the closure component 242C shown in FIG. 41A and thus the same features of this closure component 242C are present in insert 230D. The insert 230D also includes an annular disc 232D that includes the same features as annular disc 232, unless different features are identified. The main difference between annular disc 232 and annular disc 232D is that the retainer 262D is arranged on the annular disc 232D in a position to engage with the horizontal wall 252 (since there is no tab to engage with the retainer 262 as shown in FIG. 43). Retainer 262D otherwise has the same features as retainer 262. In view of placement of retainer 262D to engage with the wall 252, a cutout 278 is formed in the annular disc 232D inward from the outer circumference of the annular portion of disc 232D. Thus, retainer 262D is elevated in the same direction from the annular disc 232D as the attachment structure 244 and the structure that defines the bag-engagement edge(s) at the inner bag-engagement edge region of the annular disc 232D.

Retainer 262D cooperates with the wall 252, or more generally, with the annular portion of the closure component 242C to prevent inadvertent disengagement of the closure component 242C from the annular disc 232D. Retainer 262D may be provided in any embodiment disclosed herein wherein there is no tab projecting outward from the circular portion of the closure component. The retainer 262D is shown mounted on the upper surface of the annular disc 232D. Alternatively, it may be integrated into the annular disc 232D. The annular disc 232D, attachment structure 244 and closure component 242C may have a unitary structure, i.e., form a single unit that is removable from or insertable onto the base of the waste container as a unit.

As with the embodiment of FIG. 43, the primary change in use of this embodiment is that when engaging the closure component 242C with the annular disc 232D, the closure component 242C is pressed downward against the angled surface 264 of the retainer 262D to cause the retainer 262D to flex rearward slightly and allow the wall 252 of the closure component 242C to be pressed into a position below the lip 266 when the retainer 262D returns to its initial position. Release of the closure component 242C when seeking to disengage it from the annular disc 232D entails flexing the flange 268 of the retainer 262D rearward to allow closure component 242C to be released from its position below the lip 266.

Figure 44:
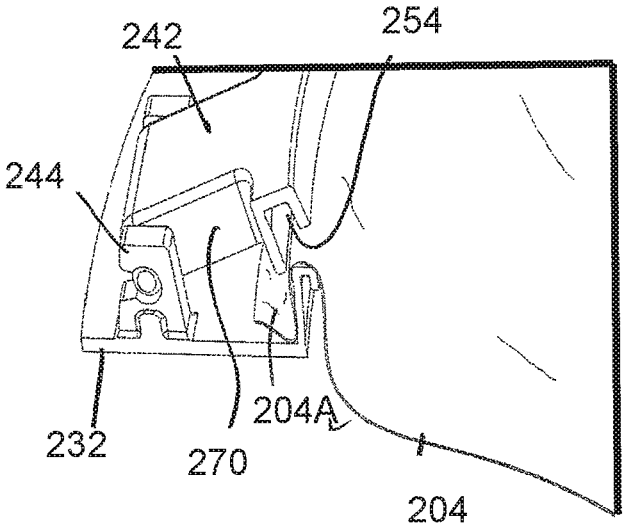
FIG. 44 is a partial cross-section showing a closure component that is capable of providing four bag-engagement surfaces.

FIG. 44 shows a variant wherein the closure component 242 provides four bag-engagement surfaces. In this embodiment, an extension portion 270 of the closure component 242, that extends between the annular portion 246 and the attachment structure 244, has a lower edge or surface that presses a portion 204A of the bag 204 that rests on the annular disc 232. This excess portion of the bag 204 is draped over the insert 230 and size-permitting, can be pressed against the annular disc 232 by the extension portion 270. In the same manner, if the closure component 242 were "L" shaped and provided two bag-engagement surfaces, then when the extension portion 270 presses the bag 204 against the annular disc 232, there would be three bag-engagement surfaces of the closure component 242.

FIGS. 45-48 show an embodiment wherein a closure component 242A is not pivotally attached to the waste container 224 or to the insert 232. Rather, the closure component 242A is free standing. Otherwise, closure component 242A has the same or similar structure and features as closure component 242.

This embodiment also shows an alternative insert, designated 230C. Insert 230C includes an annular disc 232 with optional projections 234, and a separate wall portion 270 that has the inner wall 236, ledge 238 and annular wall 240. Moreover, the wall portion 270 includes an attachment structure 272 to enable the wall portion 270 to be attached to an inner edge of the disc 232. The attachment structure 272 may be an indentation that snap-fits to the inner edge of the disc portion 270, or is attached thereto by an interference fit, or by threads.

FIGS. 49-51 show another embodiment of a bag securing assembly 280 including an insert 282 that rests on a support in a waste container and a closure component 284 attached to the insert 282. The insert 282 is circular and has a bottom wall 286, an outer annular wall 288 extending upward from a radially outer edge of the annular wall 286 and an inner annular wall 290 extending upward from a radially inner edge of the annular wall 286. Inner wall 290 has a larger height than the outer wall 288.

An attachment structure 292 is arranged on the upper surface of the bottom wall 286 and pivotally supports the closure component 284 (see FIGS. 49 and 50). The closure component 284 may have the same structure and features as closure components disclosed elsewhere herein, and when in an engaged position, fits the bag 204 into its channel to thereby secure the bag 204 against rotation.

Bag securing assembly 280 is used in the same manner as the other bag securing assemblies disclosed herein. To wit, the insert 282 is placed onto a support of a waste container, a bag 204 is inserted through the opening defined by the insert 282 into the waste-receiving compartment defined by the waste container with an upper edge region remaining above the insert 282, and with the closure component 284 in a non-engagement position. This upper edge region is then extended over the inner wall 290 and pulled downward toward the bottom wall 286. The closure component 284 is then pivoted downward, e.g., by pressing the tab 256, to cause the bag 204 to be pressed into the channel 254 and against the inner wall 290 by the closure component 284.

Removal of the bag 204 is facilitated by lifting the closure component 284 out of engagement with the insert 282 thereby releasing the upper edge region of the bag 204, and allowing it to be tied and the bag removed from the waste container in a manner described above.

As shown in FIG. 51, the attachment structure 292 is not required and may be eliminated. In this embodiment, the closure component 284 is not connected to the insert 282 when in its disengagement position.

Referring to FIGS. 52-55, in this embodiment, the bag securing assembly also allows the bag to be rotated. The bag securing assembly 300 includes an insert 302 with an annular disc 304 having projections 306, and a closure component 308 that is not attached to the insert 302. The annular disc 304 also includes an inner peripheral, circular wall 310, a ledge 312 extending radially inward from the upper edge of the inner wall 310 and a small downwardly directed annular wall 314 extending from the inner edge of the ledge 312 (see FIG. 55).

Figure 55:
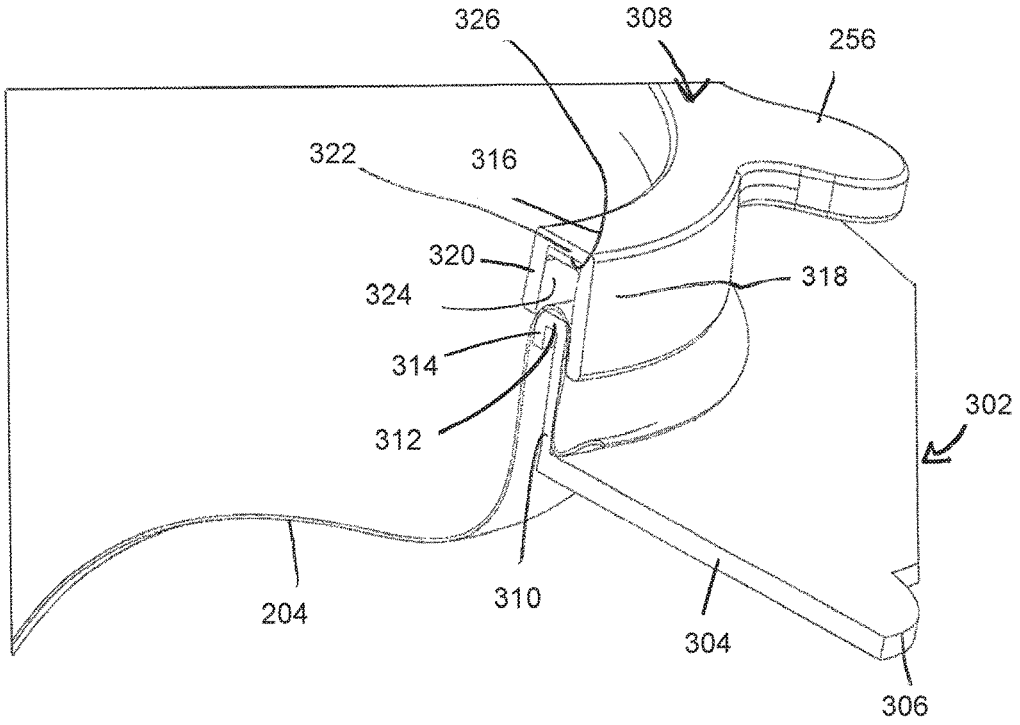
FIG. 55 is an enlarged view of the engagement between the closure component and the insert of the bag securing assembly of FIGS. 52-54.

The closure component 308 includes an annular portion 316 having a U-shape cross-section (see FIG. 55). The cross-section includes an outer wall 318, an inner wall 320 and a transverse wall 322 which together define a channel 324 oriented downward. When engaged with the annular disc 304, the outer wall 318 surrounds and presses the bag 204 against the inner wall 310 of the annular disc 304, the inner wall 320 is inward of and presses the bag 204 against the annular wall 314 of the annular disc 192 and the transverse wall 322 presses the bag 204 against the ledge 312 (see FIG. 55). This thus provides three bag-engagement surfaces or points of pressure of the closure component 308 against the insert 302.

FIG. 55 also shows a gasket 326 arranged in the channel 324. The closure component 308 may be over-molded or in-molded with this gasket 326, e.g., with the gasket 326 generally being considered a rubberized or plasticized gasket-like material. A benefit of the gasket 326 is that it can reduce the slippage of the bag 204 and allows rotational movement of the closure component 308 to cause rotation of the bag 204. (The gasket 326 may be provided in other closure components having a channel as disclosed herein.)

As shown, the gasket 326 is on the underside of the transverse wall 322. However, a gasket may additionally or alternatively be provided on the inner side of the outer wall 318 and/or on the inner side of the inner wall 320 defining the channel 324.

Figure 52:
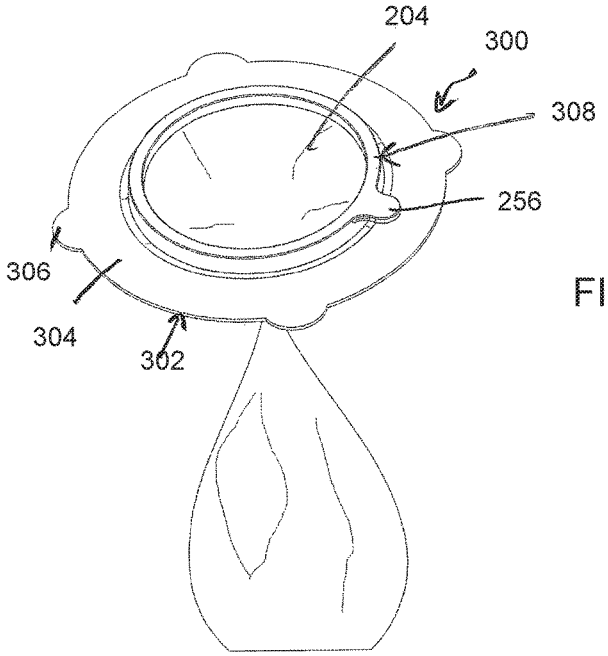
FIG. 52 is a view of another bag securing assembly with a bag in accordance with the invention with its closure component in a position in which the bag is not twisted.

In this embodiment, the bag 204 is rotated by rotating the closure component 308. For example, the closure component 308 may be in an initial position as shown in FIG. 52, the position of the tab 256 indicates this position. Then, by rotating the closure component 308 clockwise to the position shown in FIG. 53 or counterclockwise to the position shown in FIG. 54, e.g., by grasping the tab 256, a twist is formed in the bag 204 (assuming the waste in the bag is held against rotation, the relative movement of the upper region of the bag 204 relative to the waste held stationary causes formation of a twist). This clockwise rotation would be effected after insertion of a waste object into the bag 204.

Figure 53:
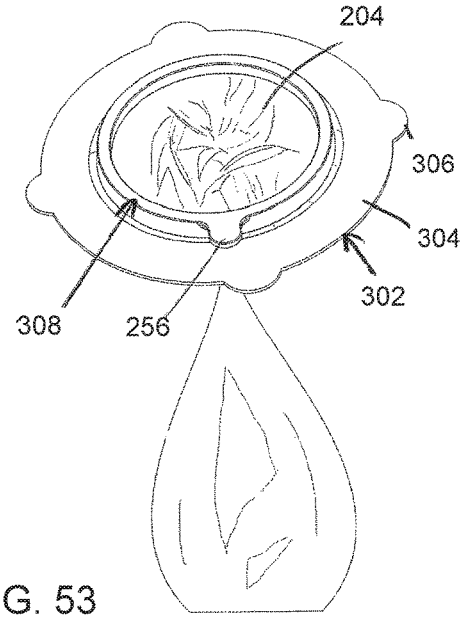
FIGS. 53 and 54 are view of the bag securing assembly of FIG. 52 with its closure component in a position in which the bag is twisted.
Figure 54:
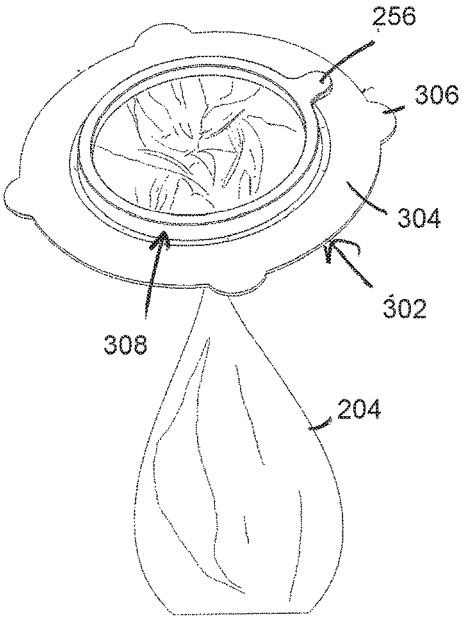

To open the bag to prepare for insertion of waste, the closure component 308 is rotated counterclockwise from the position shown in FIG. 53 to the position shown in FIG. 52 and clockwise from the position shown in FIG. 54 to the position shown in FIG. 52, to untwist the previously formed twist (assuming the waste in the bag is held against rotation, the relative movement of the upper region of the bag 204 relative to the waste held stationary causes the previously formed twist to untwist). The waste is then inserted and thereafter, the closure component 308 is again rotated clockwise. The reverse rotational movement may be provided, i.e., clockwise to untwist the bag and counterclockwise to form a twist in the bag.

When it is desired to remove the bag 204 of waste, it is often desirable to avoid exposure to offensive odors as the bag is lifted and a knot is tied at the end. By twisting the upper region of the open bag to form a twist with the closure component 308, upward draft of odors from the waste below is prevented. After removal of the closure component 308, it is possible to tie a knot above the temporary twist and have a better chance to keep the offensive odor or bacteria contained. Thus, a temporary knot or twist may be formed by using the least amount of the open bag. Actually, the twist material is likely to come from the bag below fractionally, since the upper region is secured by the closure component 308.

The embodiments in FIGS. 33-55 generally represent a bag securing assembly for use in any number of different types of waste disposal devices or waste containers, and that has a first part, a base or bag support, having a rim over which a bag is draped and a second part, a trapping, closure or securing component, that selectively traps or secures the bag to the base to prevent relative movement between the secured part of the bag and the base when engaging therewith. The base may be movable relative to the waste container or fixed in position, e.g., via projections on the base. The base may be a unitary component or have two parts that are connected together. The trapping component may be pivotally attached to the base or to the waste container.

The trapping component is configured to trap the bag against the base in a variety of different ways. In a first manner, the trapping component traps the bag only at the top edge of the bag, e.g., by pressing the part of the bag overlying a top edge of the base against the top edge of the base. This pressure prevents the bag from being drawn down into the waste-receiving compartment of the waste disposal device as the bag fills with waste.

In another configuration, the trapping component traps the bag on the top and at least one side edge (the outside or inside edge) thus adding an additional level of surface engagement which makes the bag even more secure. To this end, the trapping component may have an annular portion that has a T-shaped or L-shaped cross-section (to provide one or two sides or surfaces of engagement against the bag), or a U-shaped cross-section (to provide three sides or surfaces of engagement against the bag), In the latter case, the channel of the annular portion defining the U-shaped may be tapered to accommodate a potentially required draft required to pull the trapping component out of an injection molding device (which is the preferred process). This three-surface engagement of the trapping component with the bag serves to envelop the bag that increases the force preventing the bag from being dragging down into the waste-receiving compartment of the waste disposal device as the bag fills with waste.

When the trapping component is not attached to the base or to the waste disposal device, it may be in the form of a free standing (non-pivotable) pinch ring. Such a pinch ring may be configured to trap the bag with an interference engagement like a hoop (as disclosed above, e.g., in FIG. 30). A free-standing, non-pivotable hoop may also be provided with inner or outer wall engagements (detents) for improving securing of the bag. Alternatively, the "L", "T" or "U"-shaped channel trapping component may be configured to provide an interference fit.

Preferably, the trapping component has a tab that eases removal of the trapping component when the bag is full and must be changed. Multiple tabs may be provided. The tab also may aid in pressing the trapping component against the base. The trapping component may also be considered as a pivotable pinch ring that is connected to either the waste disposal device or be part of the base. The tab in this embodiment will assist in securing a new bag, as well as enable quick release of the trapping component from the base for bag removal.

Another engagement that should trap the bag utilizes the pivotable point and an opposing end point to trap the pinch ring in at least two points (preferably at opposing ends). One end of the pinch ring may thus be trapped by a retainer situated opposite the location at which the pinch ring is pivotally attached to the base or waste disposal device. A quick release of the tab is accomplished by moving the tab release end, which may be flexible, whereby the pivotable pinch ring can either be released or if cocked at a slight angle it may spring up. For springing up or be released, it is preferable, although not inoperative, for the pinch ring to be free of detents that might impede its release. A two-part entrapment is sufficient to keep the bag from creeping as long as engagement is a secure fit.

It is, in some embodiments, to configure the trapping component to further engage with a bag along that portion of the trapping component extending between an annular part that overlies a top edge of the base and an attachment portion. This extension portion may press the bag since its bottom edge can rest on an excess portion of the bag that is draped over the top edge of the base. This thus provides four points of pressure of the trapping component against the base. If the bag is not draped sufficiently over the top edge of the base, yet the annular part of the trapping component has a "U"-shaped channel, then there would only be three points of pressure of the trapping component against the base. Similarly, for a "T"-shaped channel, there would only be two points of pressure of the trapping component against the base, and for an "L"-shaped channel, then there would only be one point of pressure of the trapping component against the base.

If the bag is shorter than the inner length of the waste disposal device and hangs, as in a conventional waste disposal device that forms twists in the hanging portion of the bag, securing the bag at the upper region from being dragged down by weight is critical. Whereas, in other conventional waste disposal device, it is preferable that the bag have slack. Yet, this too requires that the upper region holding the bag be secure. For conventional waste pails for general use in households, offices, etc., it is preferable for the bag to be substantially the same interior volume or larger than the interior volume of the waste disposal device.

In some embodiments, it is possible to provide drop-in inserts to retrofit existing pails with conventional inner liners that require lifting up the liner and wrapping a substantially larger bag opening to struggle to wrap it outside the upper region of the insert (e.g., the embodiment shown in FIGS. 33-36 wherein the base has the same form as a conventional liner support). Often, this requires more than one attempt to accomplish the task. An insert such as shown in FIGS. 33-36 should provide a more manageable fitted bag and at the same time eliminate the redundant inner liner. The inner liner can here be looked at as substantially a pail within a pail. A sturdy, tear resistant bag will accomplish the same task. An inner liner will often need to be thoroughly washed.

As shown in FIGS. 47 and 48, the base may be made of multiple parts, e.g., two parts, instead of having a unitary or integral construction as in other disclosed embodiments. When having a unitary construction, the base may be provided with an attachment structure to enable attachment of the trapping component to the base, or without such an attachment structure, e.g., when the trapping component is attached to the waste disposal device. When having a multi-part construction, an inner insert may fit interchangeably in conventional waste disposal device, such as waste disposal device sold by Munchkin Inc. The insert may be configured to fit the inner opening of a foldable header of the Munchkin waste disposal device. Different size inner inserts may be provided with different height to accommodate different pail designs.

It is also possible to configure the bag securing assembly as a retrofit for other existing waste disposal devices, such as the Playtex Diaper Genie™, the Munchkin Arm & Hammer™, the Munchkin, and other pails of other manufacturers. Whereas Diaper Genie™ has a cartridge of continuous tubing in its operation, one such design using the invention mimics the outer dimensions and would fit into the Diaper Genie™ pail and would not interrupt the current functionality of the way the pail works. An advantage of the bag securing assembly of the invention is that there would be no more need to cut the continuous tubing. Also, there would be fewer odors from inner open bags that need tying and contain strong odor when doing so.

To tie a full bag, the bag securing assembly may include a tie string, or a press and seal end, or be configured to allow tying of the top of the bag. An inner cutting blade built into the Diaper Genie™ pails is not needed. Since over time, the blade dulls and is not changeable and cutting can become an unpleasant struggling task in lengthening the time to cut the bag and tie a knot on the filled bag with dirty smelly diapers, this issue is avoided with the invention. Another issue avoided is that when starting a new bag in the Diaper Genie™, one needs to tie a new knot on the open flexible tubing and then drag it down for the bag to begin the filling cycle again. The required time to accomplish this cumbersome task is far longer than utilizing a single bag that is already sealed at the bottom and quickly mounted in the upper open region as in the invention.

Another advantage is, whereas in the Diaper Genie™ cartridge, you never know when it is empty until you discover, often, there is not enough left to make one last bag. Also, tying a Diaper Genie inner tubing to form a knot on the lower region for waste containment requires quite a bit more bag than a simple seal which has no waste. The upper region will also require tying two more knots after cutting the bag with the built in inserted blade: one for the bag to be removed and the other to start a new bag. Over the length of the entire tubing contained in the Diaper Genie™ refill canister, one can assume that several usable lengths of tubing are sacrificed by the consumer's liberal use of tying knots. Liberal or conservative, you use accumulated lengths of tubing that add to costs and shorten the cycle of usability in a cartridge. There are several companies offering replacement cartridges for the Diaper Genie™ system(s). Target and Munchkin are two that are offering cartridges. While they may have cartridges at somewhat lower prices, they nevertheless suffer with the same wasteful and expensive characteristics. The consumer pays dearly for convenience.

It is possible to retrofit the invention to work with the Munchkin Arm & Hammer, or Munchkin Diaper pails by either replacing their current bag that is welded to an expensive foldable polypropylene injection molded header which folds to a handle for removal of the bag. The current bag is generally considered to be a single use bag which is pleated and adds yet more expense for production and to the end user. The invention can either utilize the polypropylene ring (after removing the pleated bag) and insert an inner ring insert that will permanently engage the inner ridge of the Munchkin Arm & Hammer Diaper Pail™ opening. This inner ring can now accept a single use bag, one that would cost far less than a complicated bag with costly header. It is possible, and for convenience, to replace Munchkin's pivotable foldable polypropylene header which is welded to a folded and pleated bag with a one piece unit with a potentially built-in pivotable pinch ring which will now accept single use bags for far less than existing diaper pail refills. These refills can cost many dollars for a box containing just a few bags. By using an insert and closure component according to any of the embodiments disclosed herein, a suitable product is provided and at the same time, a non-biodegradable carbon footprint is reduced.

The bag securing assembly may be used with or without the membranes as in some of the embodiments disclosed above. It may be used with any conventional waste disposal device. The shape of the bag securing assembly may be conformed to the shape of existing or newly designed waste disposal devices. Also, any inner liners of such existing waste disposal devices are rendered unnecessary.

Referring now to FIGS. 56-63, in this embodiment, a waste container 330 includes a base 332, an access door 334 for accessing an interior waste compartment 336 defined by the base 332, a support member 338 that rests on the base 332, a bag closing assembly 340 for closing the open upper end of a bag 344, an insert 342 for supporting the bag 344, and a lid 346 having an optional waste treatment component 348 attached thereto.

The base 332 may be similar to or the same as any of the other bases for waste containers disclosed herein, e.g., have a generally cylindrical, square or D-shaped cross-sectional form. The access door 334 may be similar to or the same as any of the other access doors for waste containers disclosed herein, e.g., be hingedly connected along one side to the base 332.

In the exemplifying, non-limiting illustrated embodiment, support member 338 has a generally cylindrical form and includes a lower rim that is seated inside an upper rim of the base 332. Support member 338 also includes an upper support surface 350 having a rim 352 and raised positioning ridges 354 (see FIG. 58). The rim 352 is circular as this shape arises from the cylindrical form of the support member 338. Other cross-sectional shapes of the support member 338 will result in different shaped rims. As shown, there are two raised positioning ridges 354 that have an arcuate form and are spaced apart from one another on approximately opposite sides of the area in which the insert 342 will be positioned. Their purpose is to aid in positioning of the insert 342 on the upper support surface 350 in a position in which the bag 344 retained by the insert 342 can easily pass through an aperture defined by the support member 338 into the waste compartment 336. Alternatively or additionally, the insert 342 may have some slight detents or be configured to provide an interference fit with the insert 342 to improve or further keep insert 342 securely in place.

Figure 57:
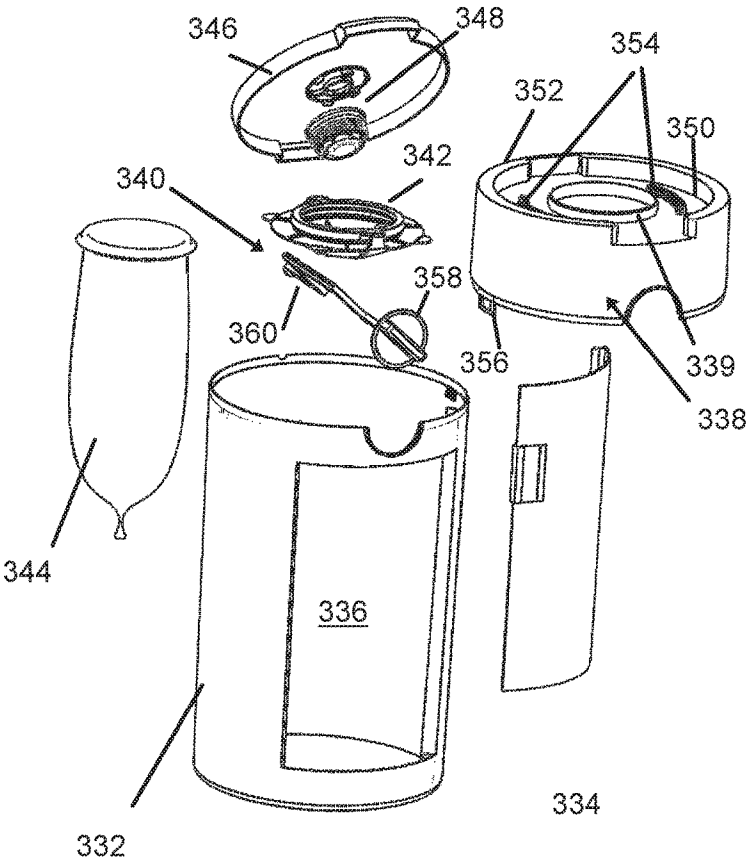
FIG. 57 is a view showing parts of the waste container of FIG. 56.
Figure 56:
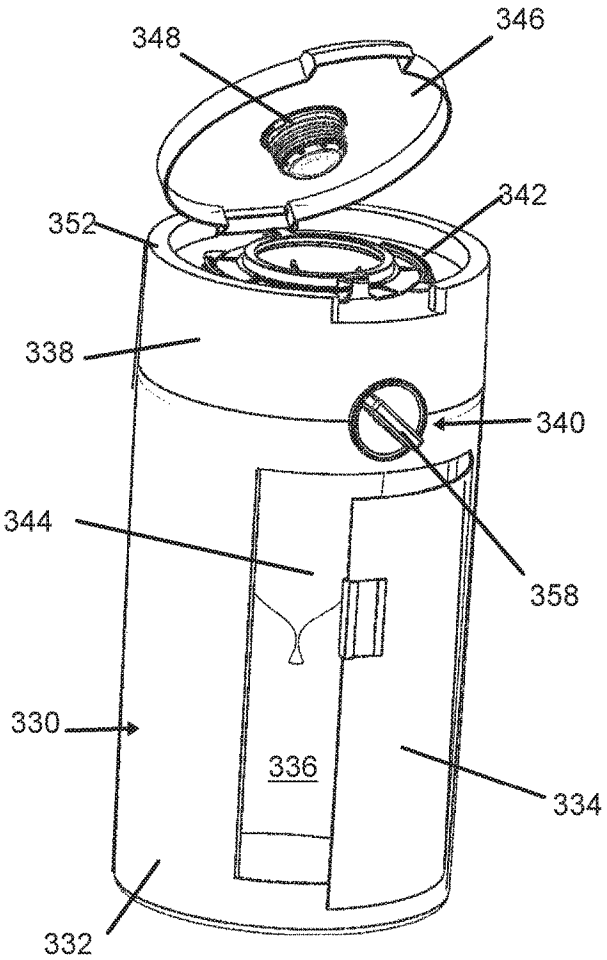
FIG. 56 is a perspective view of a waste container including an insert in accordance with the invention.

One or more cooperative securing or locking mechanisms 356 may be provided to secure or temporarily lock the support member 338 to the base 332 (see FIG. 57). Securing mechanisms 356 may have many different forms known to those skilled in the art, including any type of construction that serves to connect one part to another.

Figures 58, 59:
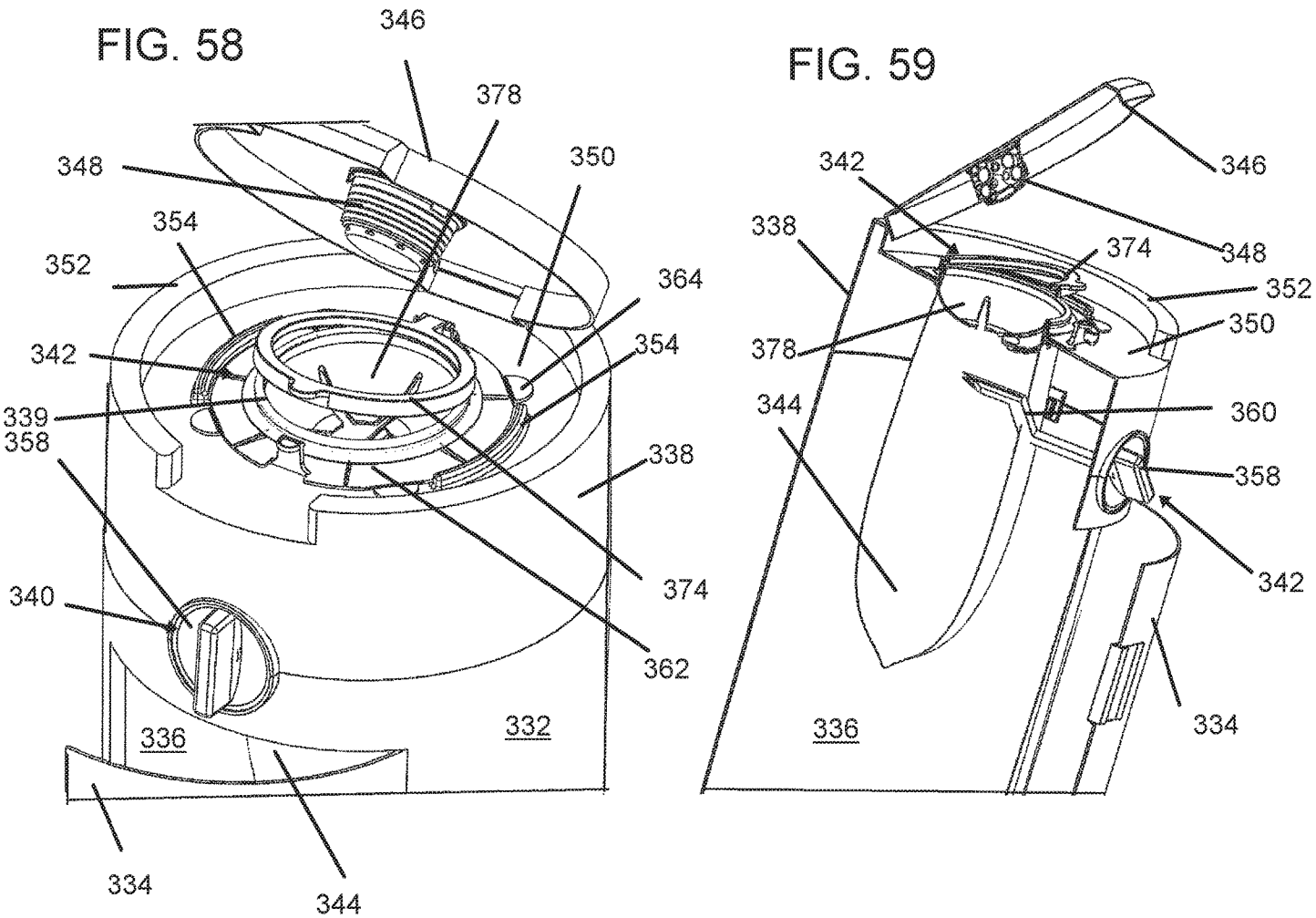
FIG. 58 is an enlarged view of the upper region of the waste container shown in FIG. 56.
FIG. 59 is a cross-sectional view of the waste container shown in FIG. 56.

Bag closing assembly 340 is a component that causes the bag to be pressed against itself within the waste compartment 336 to trap odor emanating from waste in the bag 344. Bag closing assembly 340 includes a manually accessible handle 358 and a bag engagement part 360, and may be referred to as a bag obstruction mechanism. Manually turning handle 358 causes rotation of the bag engagement part 360, that engages the bag 344 at at least one part, to either allow insertion of waste into the bag 344 to close a previously open upper end of the bag 344, preventing entry of waste but also preventing discharge of odor from waste previously inserted into the bag 344. FIG. 59 shows the bag closing assembly 340 in a position in which the bag engagement part 360 does not close the upper end of the bag 344 and therefore allows for waste insertion.

Such bag closing assemblies or bag obstruction mechanisms are disclosed in other patent applications by the inventor, some of which are mentioned above and incorporated by reference herein. Particularly, handle 358 and bag engagement part 360 form a bag obstruction mechanism for which additional details are found in U.S. Pat. Nos. 8,973,744 and 9,056,716, incorporated by reference herein. Bag engagement part 360 may have any of the forms disclosed in these two patents.

The bag obstruction mechanism may be used manually by turning handle 358, while an opposite end of the bag engagement part 360 is rotatably attached to the opposite, inner surface of the base 332. In some embodiments, a linking arm 359 is connected at one end region to the lid 346 and at an opposite end region to a mounting member 357 which is rotatably mounted on the inner surface of the base 332 (see FIGS. 59A and 59B). The linking arm 359 provides for automatic actuation of the bag engagement part 360, and may be provided independently of or additionally to the manual handle 358.

With linking arm 359, the movement of the lid 346 is converted to rotation of the bag engagement part 360. Specifically, when the lid 346 is opened, the bag engagement part 360 rotates in one direction to open the upper end of the bag 344 for waste insertion, and when the lid 346 is closed, the bag engagement part 360 rotates in the opposite direction to close the upper end of the bag 344 and prevent waste insertion and odor dispersal.

Figure 60:
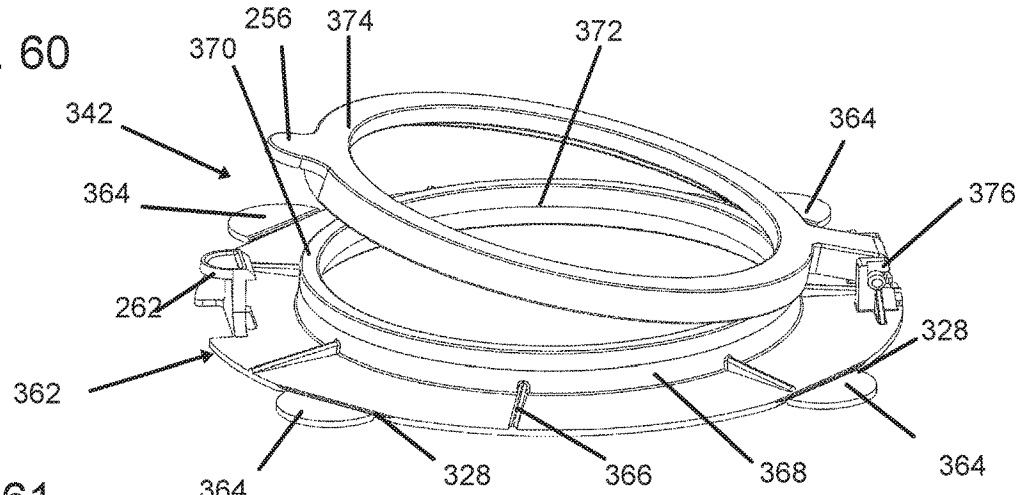
FIG. 60 is a view of the insert of the waste container shown in FIG. 56.
Figure 61:
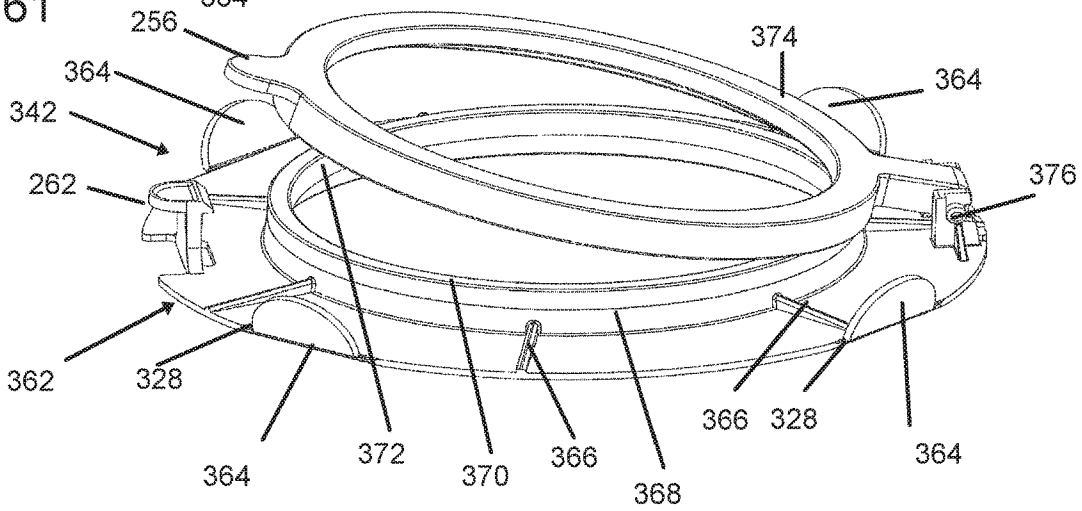
FIG. 61 is a view of the insert of the waste container shown in FIG. 56 with tabs pushed up.

Insert 342 is shown more clearly in FIGS. 60 and 61, and is designed for use in a variety of different waste disposal devices, not limited to the illustrated embodiment in FIGS. 56-59. Insert 342 includes an annular disc 362 and flaps or projections 364 projecting radially outward from an outer peripheral edge thereof. Ridges 366 also project upward from the upper surface of the disc 362 (see FIGS. 60 and 61). Annular disc 362 also includes a vertically oriented inner peripheral, circular wall 368, a horizontal ledge 370 extending radially inward from the upper edge of the inner wall 368 and a small vertically oriented annular wall 372 extending from the inner edge of the ledge 370. The ledge 370 and annular wall 372 may be omitted and an annular disc provided with only the inner wall 368. Also, annular wall 372 may be the same length as that of horizontal wall 370.

Figure 63:
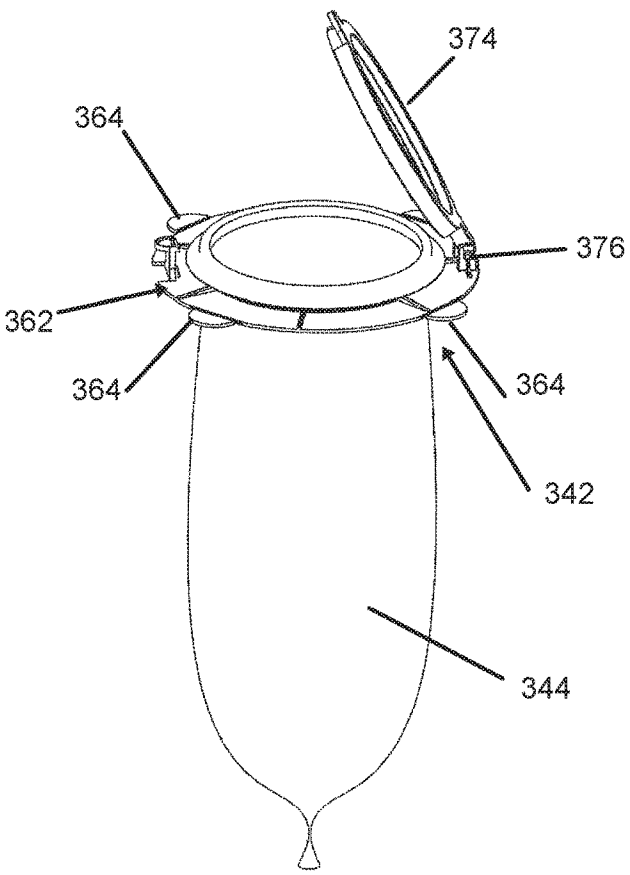
FIG. 63 is a view of the insert having the configuration shown in FIG. 60 engaged with a bag.

Projections 364 differ from projections 234 in embodiments described above in that they are foldable at least in both upward and downward directions. It is possible for the living hinge to be practical when folded upward as well as downward or even folded entirely 180 degrees back on itself so it rests flat on the disc 362. FIG. 60 shows the projections 364 in their flat position, generally coplanar with the remaining annular portion of the disc 362. In this position, the insert 342 would be used with waste disposal devices that have, for example, an upper support surface defined by the support member 338 and do not include an entirely circular rim in which the disc 362 is retained. The combination of the insert 342 in this position and the bag 344 would appear as shown in FIG. 63.

There may be any number of projections 364 projecting from the outer peripheral edge of the disc 362. As shown, there are four spaced around the circumference of the disc 362.

Figure 59A:
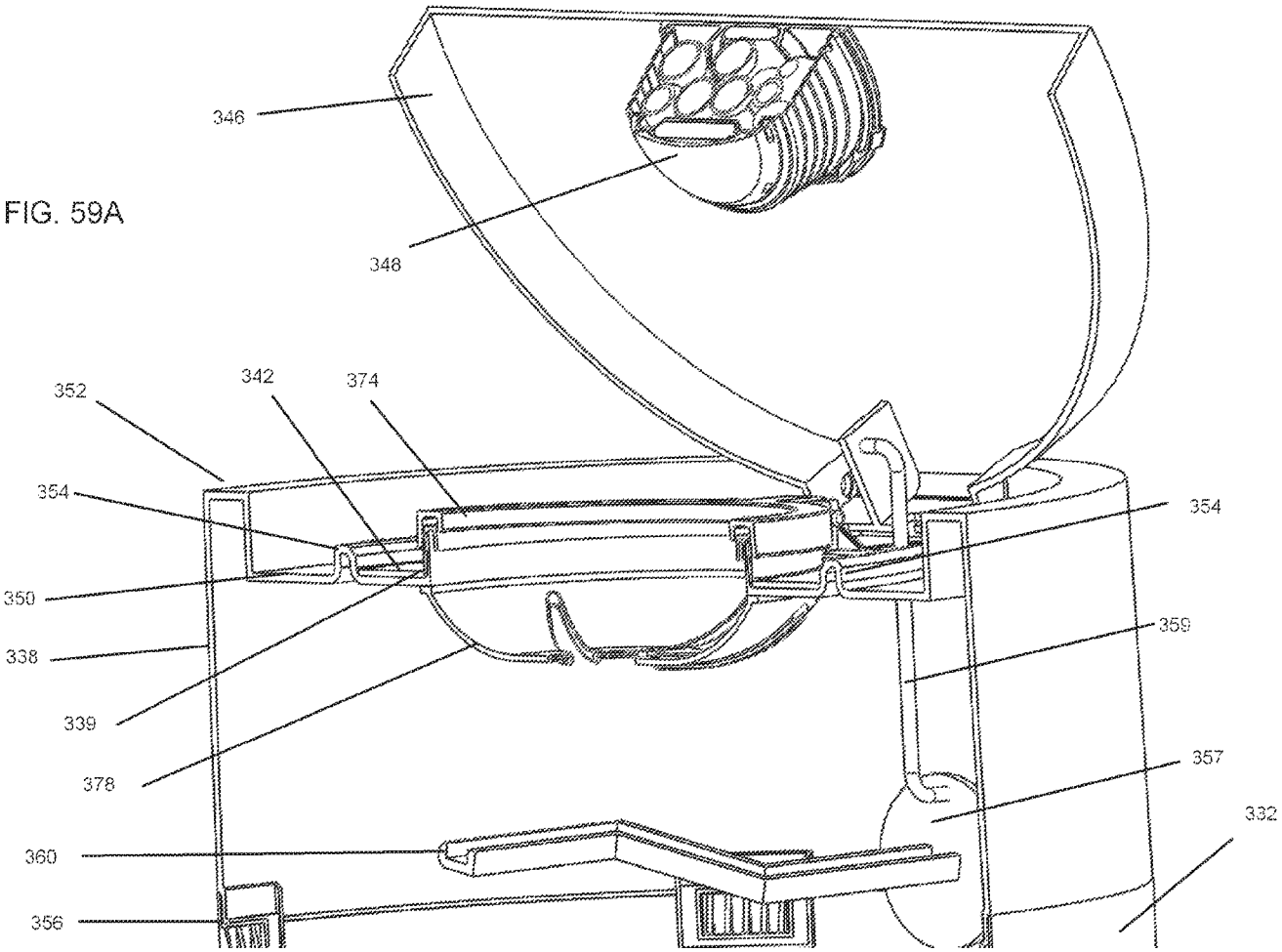
FIG. 59A is another cross-sectional view of the waste container shown in FIG. 56.
Figure 59B:
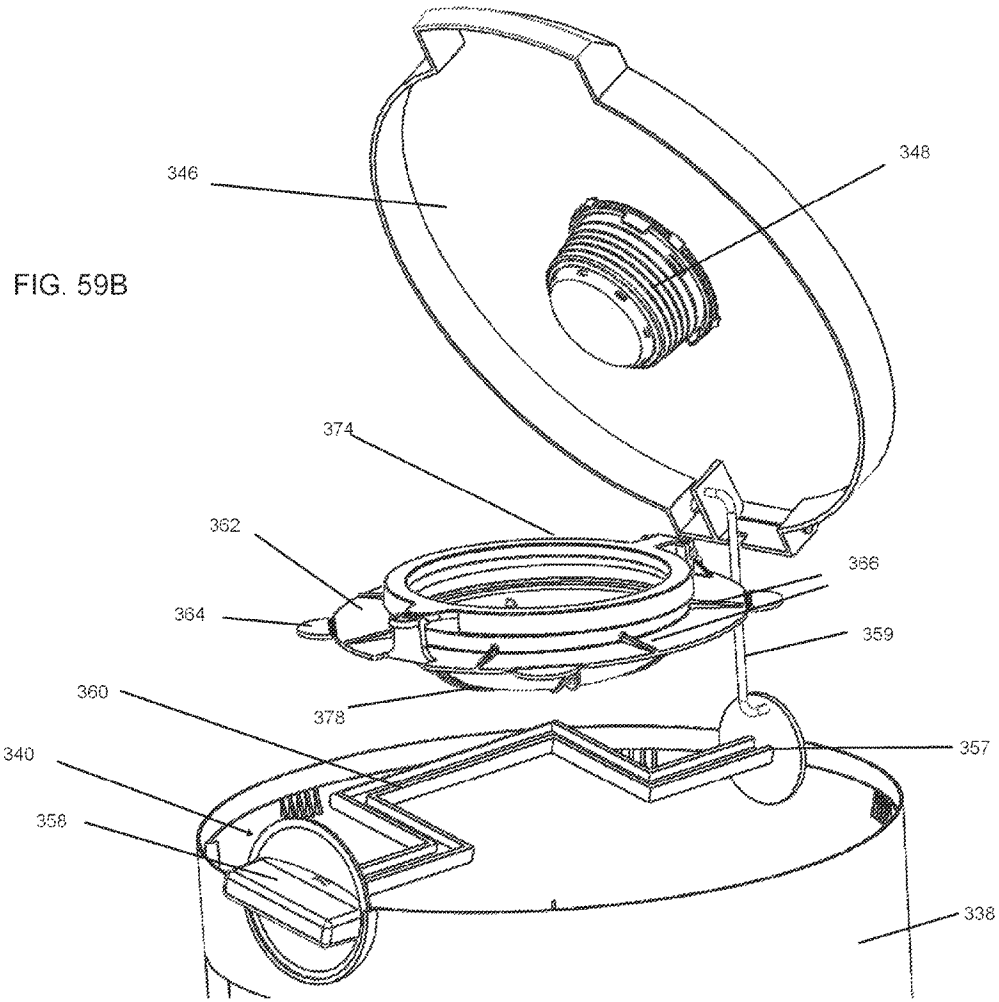
FIG. 59B is a view showing the inside of the waste container shown in FIG. 56.

The positioning ridges 354 in FIGS. 57 and 59A have a size to fit between projections 364 and possibly with only a slight clearance, i.e., the circumferential distance between the projections 364 is the same as or only slightly greater than the circumferential length of each of the ridges 354. In this manner, the insert 342 is securely retained on the support surface by the ridges 354. Ridges 354 may be made wider to fit nicely between projections 364 and have an interference fit or a slight detent so the top portion of the ridges 354 snaps a tad over the edge of the disc 362 then the insert 342 will stay nicely in place. Also, the insert 342 fits on a raised round rib 339 on the top of support member 338 between ridges 354 (see FIG. 57) and can be made to be a snug fit with the annular wall 372, ledge 370 and circular wall 368 engaging it.

Figure 62:
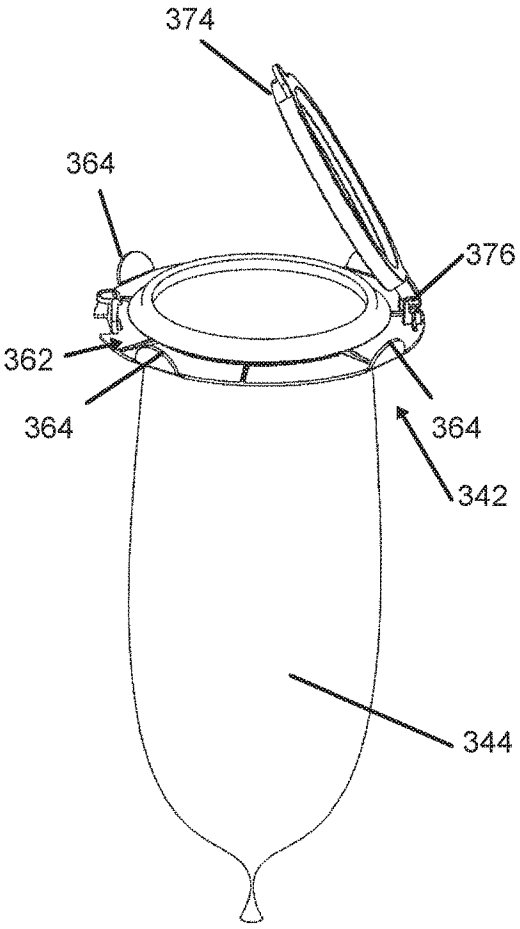
FIG. 62 is a view of the insert having the configuration shown in FIG. 61 engaged with a bag.

FIG. 61 shows the projections 364 in their upraised position, generally perpendicular to the remaining annular portion of the disc 362. In this position, the insert 342 would be used with waste disposal devices that have, for example, an entirely circular rim in which the disc 362 is retained. Such a rim does not allow for structure of an insert to project beyond the outer peripheral edge of the disc 362. Thus, for use in these waste disposal devices, the projections 364 would be bent upward. The combination of the insert 342 in this position and the bag 344 would appear as shown in FIG. 62.

Another advantage of the use of projections 364 in their upraised position, in which they may be perpendicular to the disc 362 or slightly less than perpendicular to the disc 362, is the projections 364 are biased to flatten to their flat resting state in the same plane as the disc 362, i.e., to their original state in which they came out of a mold. As such, an advantage is achieved that when inserted into some pails, such as the Playtex Diaper Genie™, the projections 364 will press against the inner wall of the pail in their attempt to flatten, and engage the inner wall with a biasing force to thereby further secure the insert 342 to the pail. While not shown, if the projections 364 were to be over-molded with a rubberized thermoplastic, this construction would provide even greater biasing force against the inner walls.

To allow for bending of the projections 364, the area between the projections 364 and the outer peripheral edge of the annular portion of the disc 362 is provided with or as a weakened area, designated 328 (see FIGS. 60 and 61). For example, a living hinge may be formed at this area 328. Other means for enabling the projections 364 to bend or flex relative to the outer peripheral edge of the annular portion of the disc 362 can also be used in the invention without deviating from the scope and spirit thereof.

Thus, it is contemplated that insert 342 would be manufactured and, in one implementation, sold with the bendable projections 364 extending radially outward and instructions provided to the users to maintain the projections 364 extending radially outward for waste disposal devices on a list. For these listed waste disposal devices, bending of the projections 364 upward is not required to enable use of the insert 342. On the other hand, the instructions provided to the users include how to bend the projections 364 upward for waste disposal devices on a different list for which the radially outward extending projections would preclude use of the insert for these waste disposal devices. Thus, for these listed waste disposal devices, bending of the projections 364 upward is required to enable use of the insert 342.

Insert 342 also includes a closure component 374 that is pivotally connected to an upper surface of the annular disc 362 by an attachment structure 376 known to those skilled in the art to which this invention pertains, or otherwise easily constructible in view of the disclosure herein. Closure component 374 serves to fix the bag 344 to the inner wall 368, ledge 370 and annular wall 372, providing three bag-engagement surfaces. To this end, the closure component 374 is similar in construction and function to closure component 242 described above, including its possible variations.

With this construction of the annular disc 362 and the closure component 374, the bag 344 can be secured by the closure component 374 to the annular disc 362 with three bag-engagement surfaces. Alternatively, if the closure component is "L"-shaped, the bag 344 would be secured by the closure component 374 to the annular disc 362 with two bag-engagement surfaces. Also, the insert 342 includes the tab 256 on the closure component 374 and the retainer 262 on the disc 362, which tab 256 and retainer 262 are described above (see FIGS. 60 and 61).

In use, a bag may be obtained and inserted into the opening defined by the insert 342 into the waste-receiving compartment 336 of the waste container 330 while the closure component 374 is pivoted into an upper, non-engagement position. An upper edge region of the bag 344 is held, and placed around the inner wall 368, overlying the ledge 370. The closure component 374 is then pivoted onto the annular disc 362 to cause the bag 344 to enter into the channel and be pressed against opposite portions of the annular disc 362. The bag 344 is thus secured in placed with the closure component 374 in an engagement position with the annular disc 362.

During use, for waste insertion, the handle 358 is manually rotated to cause the bag engagement part 360 to rotate from a position closing the bag 344 to a position opening the bag 344 and the lid 346 is opened (in any order). If the linking arm 357 is provided, manual turning of handle 358 is eliminated by opening of the lid 346. The waste is then inserted into the bag 344, and then the handle 358 is rotated to cause the bag engagement part 360 to rotate from to the position closing the bag 344 in which it will prevent release of odor, bacteria, and the like from the waste in the bag 344 (if the linking arm 357 is provided, the lid 346 is simply closed). For the next waste insertion, the handle 358 is again rotated to open the bag 344 (of the lid 346 opened).

When the bag 344 is full of waste and it is desired to remove the bag 344, the closure component 374 is pivoted upward by grasping its tab and lifting it upward, the open end of the bag 344 may be sealed, tied or clasped close and urged or inserted through the opening into the waste container with the bag 344 being removed from the waste container 330 through a front or side door 334. The insert 342 could also be designed to pivot upward to expose the interior of the waste container and then allow for removal of the bag 344 full of waste.

Although not shown in the insert in FIGS. 60 and 61 but shown in FIGS. 56-59, this embodiment also includes an optional membrane 378 below the insert 342, which membrane may be as disclosed above.

The lid 346 has essentially the same structure as any of the other lids disclosed herein. The waste treatment component 348 also may have any construction of a waste treatment component disclosed herein.

It is possible to construct the base portion of the insert 342 from two pieces, in a similar manner as the base portion of the insert 230A is constructed of two pieces (see FIG. 40). One piece would be the annular disc 362 with the projections 364 and the other piece would include the inner wall 368, the ledge 370, the annular wall 372 and the attachment structure 376.

Any of the other inserts disclosed herein may be provided with the bendable projections 364. If the insert already has projections, then the projections may be made bendable by constructing the insert with a flexible portion between the projections and the remaining annular portion of the disc of the insert, e.g., a living hinge.

It is alternatively possible to use any of the inserts disclosed herein with the waste container 330 shown in FIGS. 56-59 instead of the insert 342. The insert 342 is independent of its use in the waste disposal device 330.

Referring again to FIG. 62, this drawing shows the combination of the insert 342 when in the position shown in FIG. 61 along with bag 344. The bag 344 is a single use bag sealed at the bottom and open at the top. The bag 344 may be dimensioned to fit existing waste disposal devices, including those specifically adapted for diapers, such as the Playtex Diaper Genie™ pail, the Playtex Litter Genie™ pail and the Munchkin Arm & Hammer™ pail. The combination of the insert 342 and bag 344 would effectively replace a cartridge or canister of continuous tubing used with such waste disposal devices, as well as replace the foldable single use polypropylene header welded to a single use pleated bag used in some of those waste disposal devices.

Figure 62A:
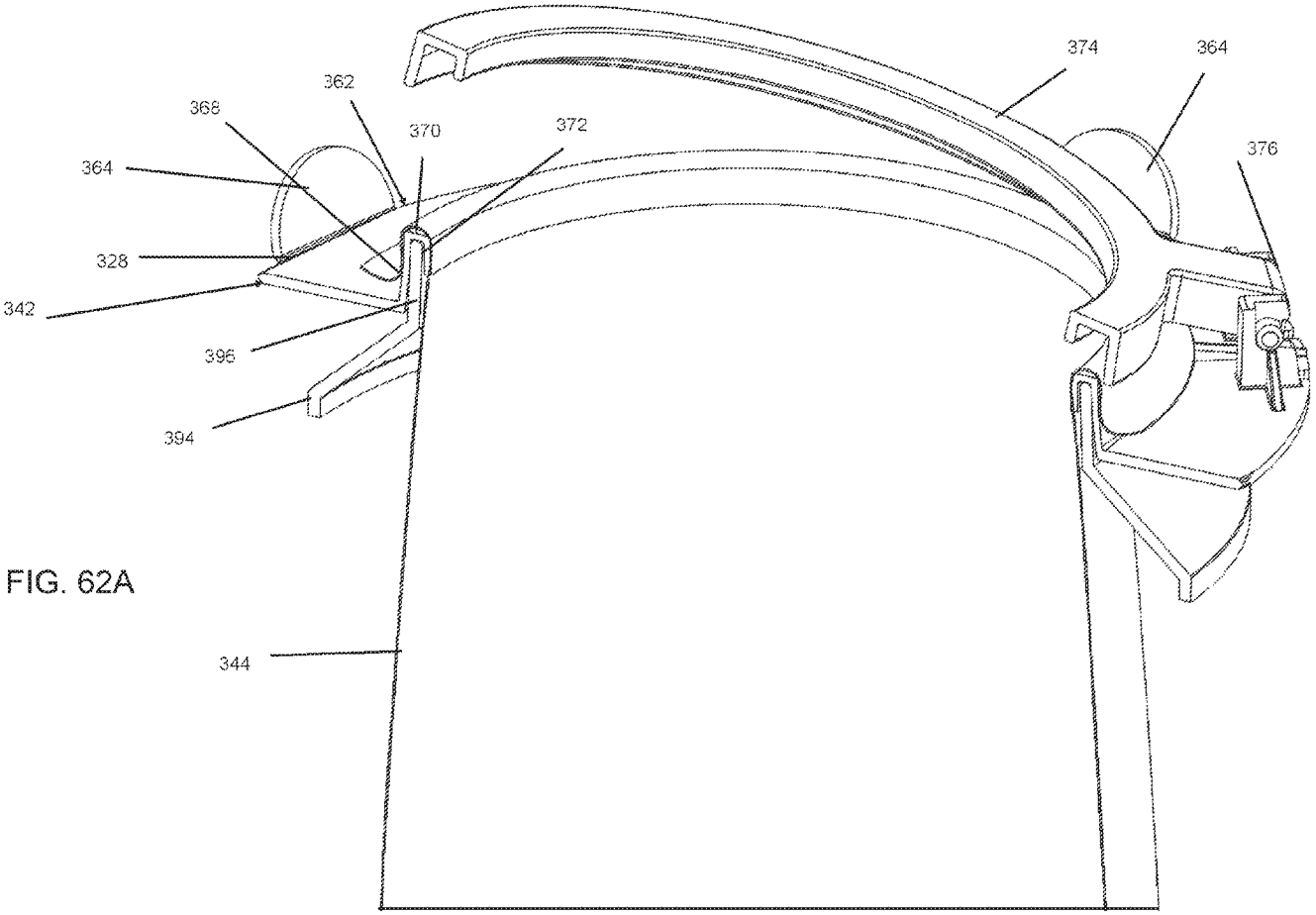
FIG. 62A is a perspective view, partly cut-away, showing the insert and bag shown in FIG. 62 used with an existing waste disposal device.

By folding the projections 364 upward, it is possible to introduce the insert 342 into the Diaper Genie™ pail to a position in which it rests on a cartridge support component 394 of the pail (see FIG. 62A). The cartridge support component 394 is normally used to support a Diaper Genie™ cartridge and the insert 342 is configured to enable it to similarly rest on the cartridge support component 394. The cartridge support component 394 has a top ridge 396 that is able to be situated, for example, inward of the inner wall 368 of the insert 342.

Replacement of the canister of continuous tubing by a single use bag is advantageous because it eliminates the need to repeatedly cut and tie the tubing after the waste compartment is full. When using tubing, after the waste compartment is full, the user must cut the tubing, tie the cut end of the tubing to close the tubing with waste in it, and tie the other cut end of the tubing to form a new bottom of a bag, This must occur as long as there is tubing in the canister. The invention alters this by replacing tubing with single use bags 344, and the multi-use, long-lasting insert 342. Indeed, it is expected that the insert 342 might be used with hundred or even thousands of bags 344 before it is no longer usable. This also eliminates waste from replacing canisters of tubing.

When used with such prior art waste disposal devices, the disc 362 would rest on part of the device that is designed to retain the canister. There is usually an inner support component on which the canister rests and this same inner support component would support the insert 362. The outer dimension of the insert 342, i.e., that of the disc 362 with the projections bent upward, would be essentially the same as the outer dimension of the canister to allow for substitute use of the insert and bag 344 for the canister.

Referring again to FIG. 63, the combination of the insert 342 when in the position shown in FIG. 60 along with bag 344 is shown. The bag 344 is a single use bag sealed at the bottom and open at the top. The bag 344 may be dimensioned to fit existing waste disposal devices, including those specifically adapted for diapers, such as the Munchkin Arm & Hammer pail. Such waste disposal devices often include a header that retains a bag and is foldable, after the bag is full, into a handle to be tossed away with the bag. Another header and bag is then inserted into the waste disposal device. The invention is advantageous over such waste disposal devices because it does not require a single use header connected to a bag but rather provides for multiple single use bags and a single insert.

When used with such prior art waste disposal devices, the disc 362 would rest on part of the device that is designed to retain the canister. There is usually an inner support component on which the canister rests and this same inner support component would support the insert 362. The outer dimension of the insert 342, i.e., that of the disc 362 with the projections bent upward, would be essentially the same as the outer dimension of the canister to allow for substitute use of the insert and bag 344 for the canister.

Although the insert 342 is shown with a circular disc 362, it can be made with different shaped bases as a substitute for the disc. Whatever shape is selected must include an aperture for passage of a bag therethrough. The circular shape was selected for possible use with prior art waste disposal devices, especially those for diaper disposal. The shape may conform to different waste disposal device, or as desired by the manufacturer. Thus, as used herein, a disc is not limited to having a circular form.

FIGS. 64 and 65 show an insert assembly 380 configured to fit into existing waste disposal devices, including a Playtex Litter Genie™ pail. Insert assembly 380 includes a body 382 having a shape that allows it to replace the canister in the Litter Genie™ pail, and also a ridge 384 that allows the insert assembly 380 to rest on the same support surface of the pail on which the canister rests. Ridge 384 extends outward from an outer peripheral surface of the body 382. By virtue of having the same shape and the ridge 384, the insert assembly 380 can be dropped into the Litter Genie pail in the same manner as canister typically used with the Litter Genie™ is dropped in.

However, differing from the typical canister, the insert assembly 380 is designed for multiple uses each time with a single use bag 386. To this end, the insert assembly 380 releasably retains the bag 386 using structure similar to that described above. Specifically, the body 382 of the insert assembly 380 includes an inner wall 388 over which the open end of the bag 386 is placed, and the insert assembly 380 also includes a closure component 390, which is pivotally attached to attachment structure 392 on the body 382, is pivoted to a position against the inner wall 388 to press the bag 386 (see FIG. 65).

The closure component 390 defines a channel on an underside that is receivable of the inner wall 388 of the body 382 such that upon pivoting of the closure component 390 into engagement with the inner wall 388, the bag when present is clamped between the closure component 390 and the inner wall 388. Closure component 390 thus has a generally square shape like the shape of the inner wall 388, although their shapes may vary.

Body 382 therefore serves two functions, first to provide the ridge 384 to enable use of the insert 380 as a replacement for the Litter Genie™ canister, and second to provide an inner wall 388 to allow for selective clamping of an open end of the bag 386. With the former feature, the body 382 must have a shape to enable the ridge 354 to securely rest on the same structure that the Litter Genie canister rests on. With the latter feature, once the bag 386 is full, the closure component 390 is pivoted upward, the end of the bag 386 is grasped, possibly tied, and then removed from the waste disposal device. A new, single use bag is then procured, placed into the waste compartment with its open end draped over the wall 388 and then the closure component 390 is pivoted against the wall 388 to secure this new bag 386 is a position ready for use.

This embodiment thus replaces the canister with a single insert body 382 that can be used many times with single use bags.

Other features of the insert assembly 380 and its components may be the same or similar to those described for other inserts herein. For example, closure component 390 includes a tab 450, similar to tab 256, and an annular part or portion 452 of the body 382 includes a retainer 454, similar to retainer 262, and which cooperate with one another in a similar manner as tab 256 and retainer 262 cooperate, as described above.

Figure 65A:
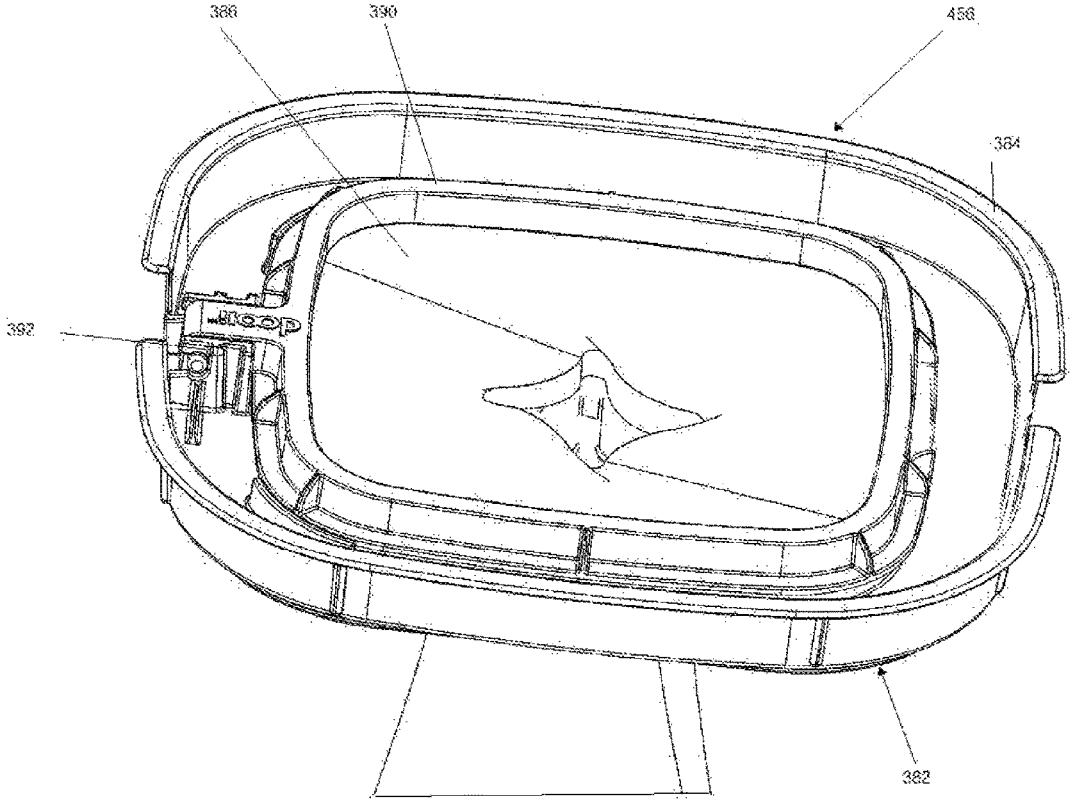
FIGS. 65A, 65B and 65C are assembled views of inserts similar to the insert in FIG. 64.
Figure 65B:
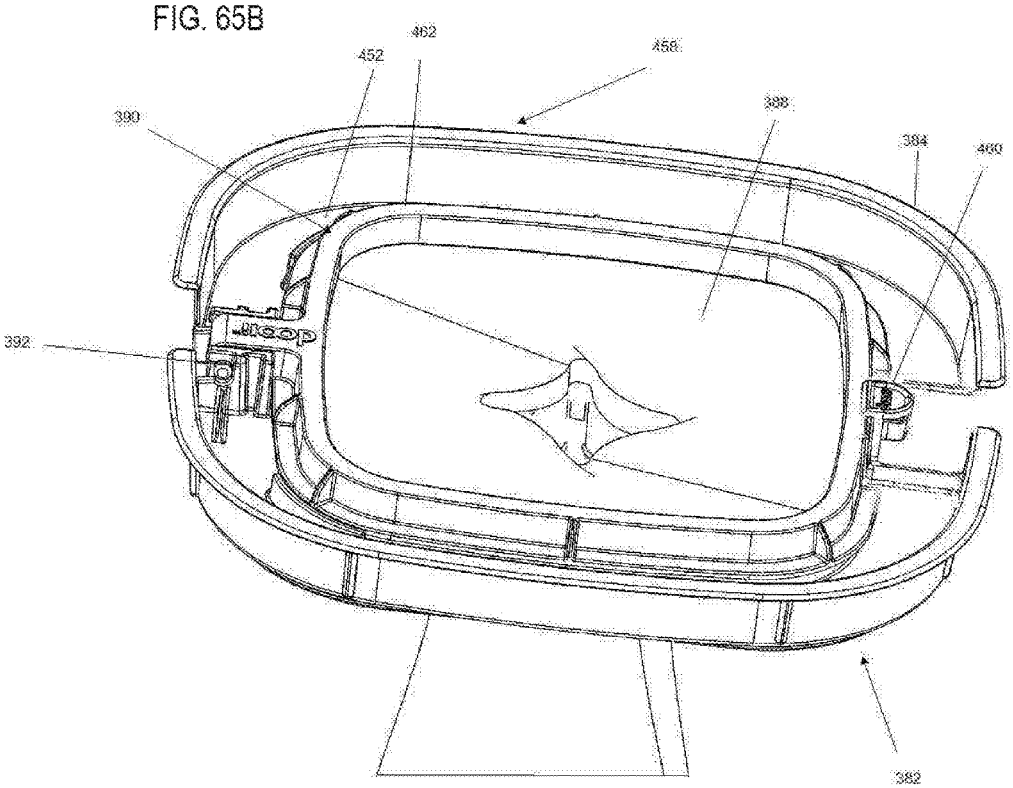
Figure 65C:
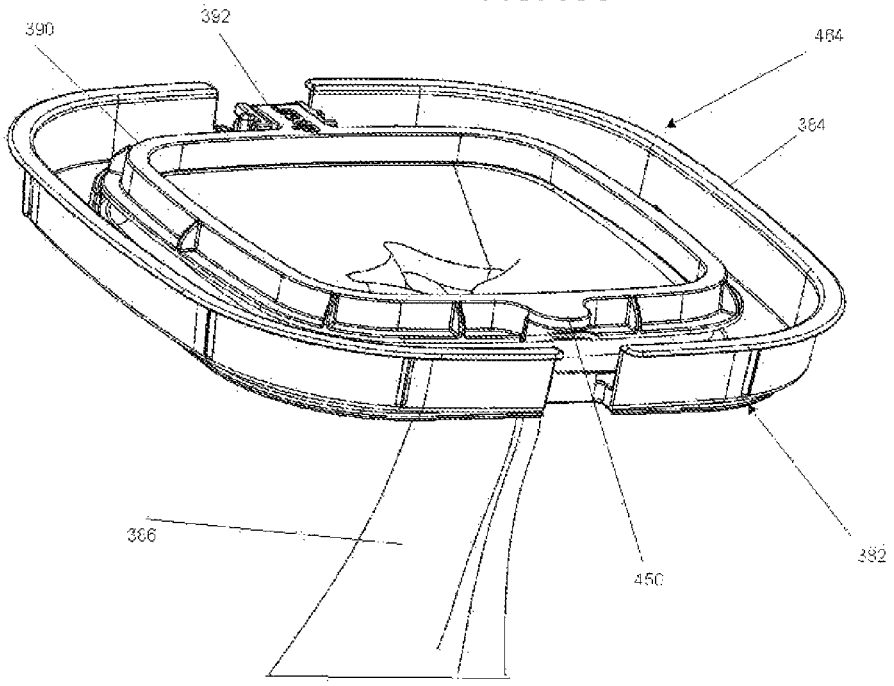
Figure 66:
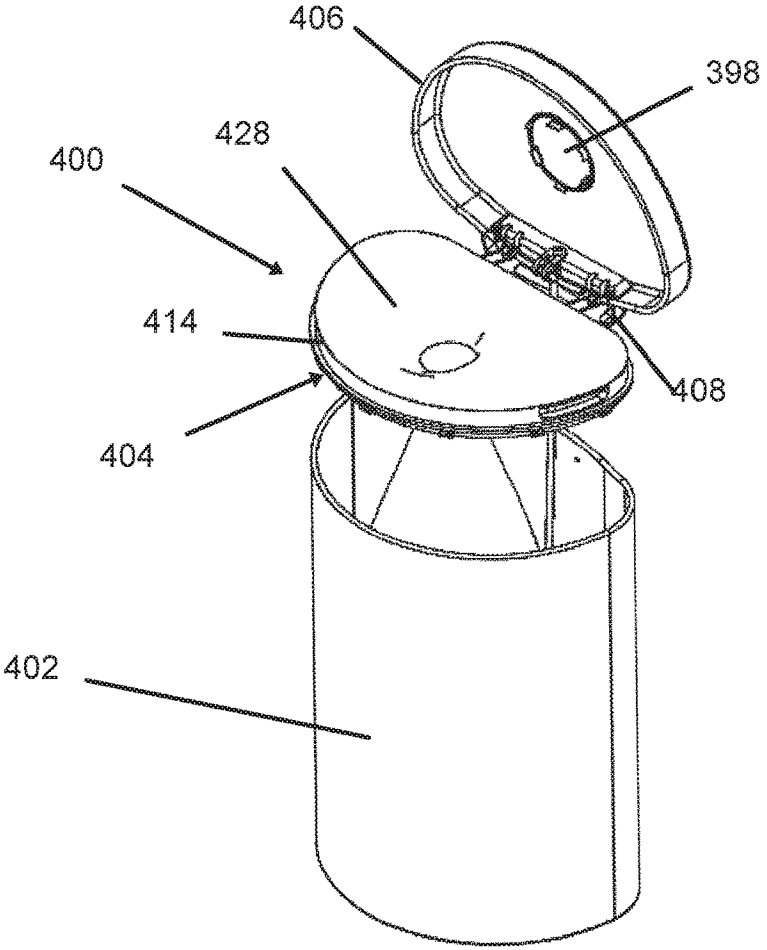
FIG. 66 is a perspective view of another embodiment of a waste disposal device in accordance with the invention showing a state wherein a closure component and bag assembly is separated from its base.
Figure 67:
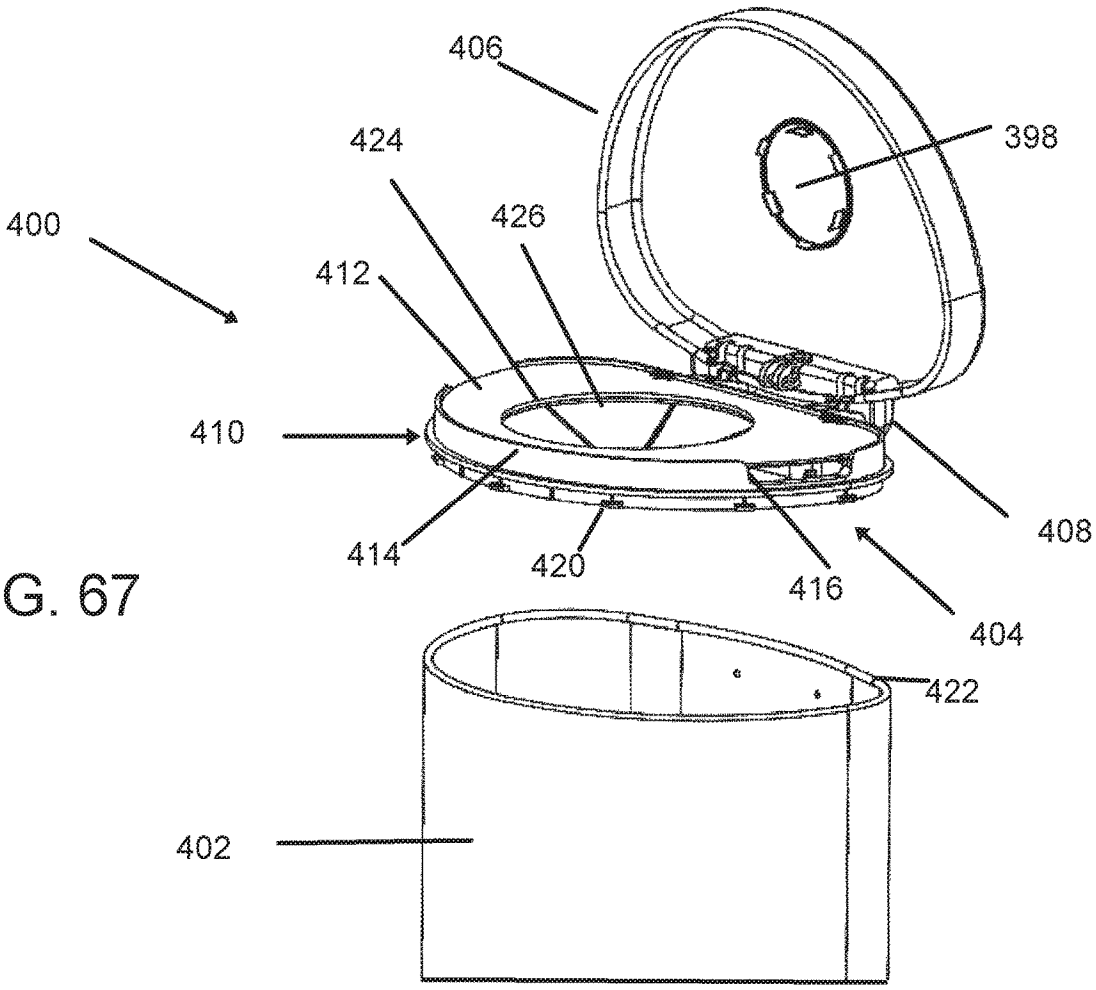
FIG. 67 is a perspective view of part of the waste disposal device shown in FIG. 66 without the bag.

Referring now to FIGS. 65A, 65B and 65C, additional insert assemblies are shown, designated 456, 458, 464, respectively. These insert assemblies 456, 458, 464 are like insert assembly 380 and include the same features unless indicated otherwise. As to the specific differences, insert assembly 456 does not include tab 450 or retainer 454. It is thus like insert 230C shown in FIG. 41.

Insert assembly 458 does not include tab 450 but includes a retainer 460 arranged on the annular part 452 of the body 382 in a position to engage with a horizontal wall 462 of the closure component 390 (since there is no tab to engage with the retainer 460 as shown in FIG. 65). Retainer 460 otherwise has the same features as retainer 262. In view of placement of retainer 460 to engage with the wall 462, a cutout is formed in the annular part 452 inward from the outer circumference of the annular part. Thus, retainer 460 is elevated in the same direction from the bottom of the annular part 452 as the attachment structure 392 and the structure that defines the bag-engagement edge(s) at the inner bag-engagement edge region of the annular part 452 (like retainer 262D in FIG. 43A).

Insert 464 includes a tab 450 but does not include any retainer. A cutout is formed in the annular part 452 inward from the outer circumference of the annular part 452 to facilitate access to the tab 450. This embodiment is therefore like the embodiment shown in FIG. 41.

As shown in FIGS. 65A-65C, the inserts have a generally square shape and there is only a ridge that projects from the annular part 452 of the body, but not a horizontal wall or annular at the inner bag-engagement edge region. There is only a generally rectangular/square shaped wall.

Referring now to FIGS. 66-72, for any of the embodiments disclosed above having a closure component and lid, it is possible to construct the closure component as a unit with the lid of the waste disposal device. For these embodiments, the unit, referred to as a closure component and lid assembly 400, may be arranged on any support. The support may be a pail with a base capable of supporting itself on a horizontal surface, or a suspended structure or a structure fixed to a vertical surface. In FIGS. 66-72, the support will be a pail 402 having a generally semi-circular form. This form is not required and the pail 402 may have any shape, e.g., circular and rectangular.

An advantage of these embodiments is that it is possible to lift up the closure component and lid assembly 400, separating it from its support and then more easily remove the bag of waste. A new (empty) bag is engaged with the closure component and lid assembly 400 and then it is repositioned on the support. Access to the support, e.g., via a door in the pail, is not required. An additional advantage is that it is possible to vary the shape of the closure component and lid assembly 400 so that it is able to mate with a correspondingly shaped an independent lower pail to provide a waste disposal device with easy trapping of a bag and easy removal of the bag as well (and an inner liner is not required). Essentially, the bag gets trapped around a perimeter of the closure component and lid assembly 400 when in a closed position (see FIG. 71). By contrast, conventional pails with inner liners are messy and often the bag creeps down.

Yet another advantage is that it becomes very easy to retrofit existing containers currently on the market by removing the lid and dropping in the closure component and lid assembly 400, which may offer added odor and bacteria prevention. It is possible to mate the closure component and lid assembly 400 to a large diameter paper tube which may be environmentally friendly, disposable and replaceable from time to time. Alternatively, instead of expensive injection molding, the plastic components, including the base, of the closure component and lid assembly 400 may be extruded and have different heights for different applications. The same closure component and lid assembly 400 can thus be used with the different height bases.

In the following description of FIGS. 66-72, the primarily differences between these embodiments and other embodiments disclosed above are identified. The same features of the closure components and lids disclosed elsewhere herein may be included in the closure component and lid assembly now being described, to the extent possible.

Figure 68:
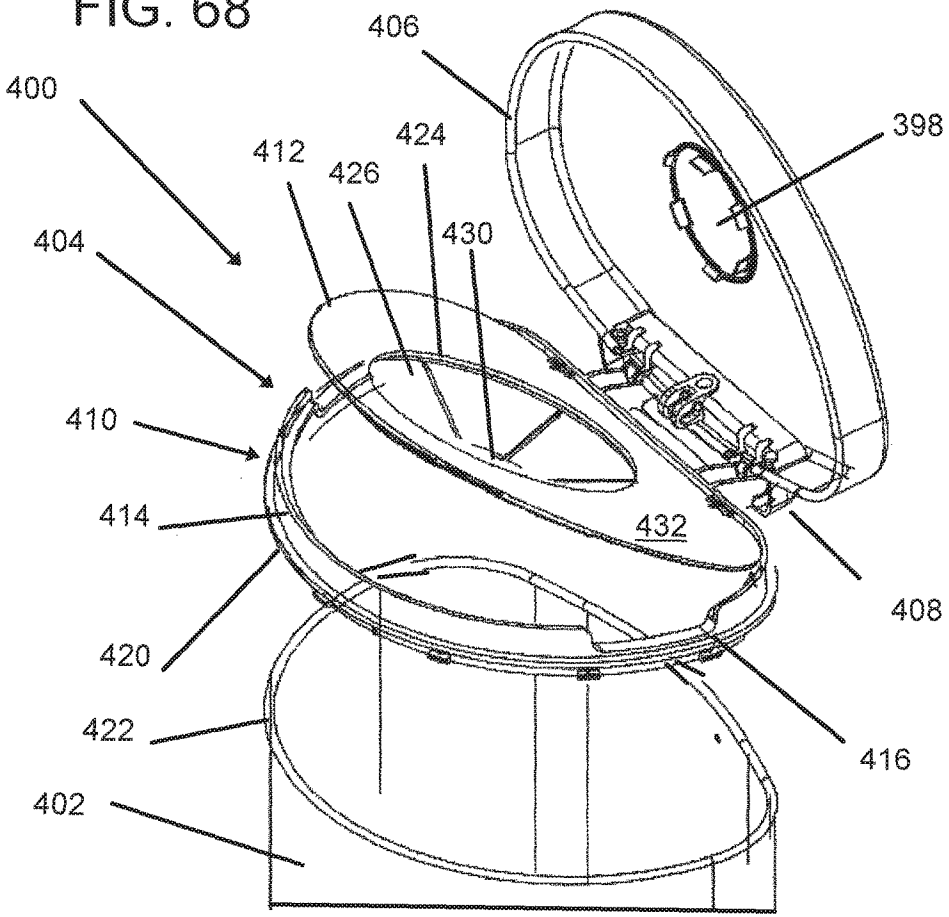
FIG. 68 is a perspective view of part of the waste disposal device shown in FIG. 66 without the bag and with the closure component pivoted upward.
Figure 69:
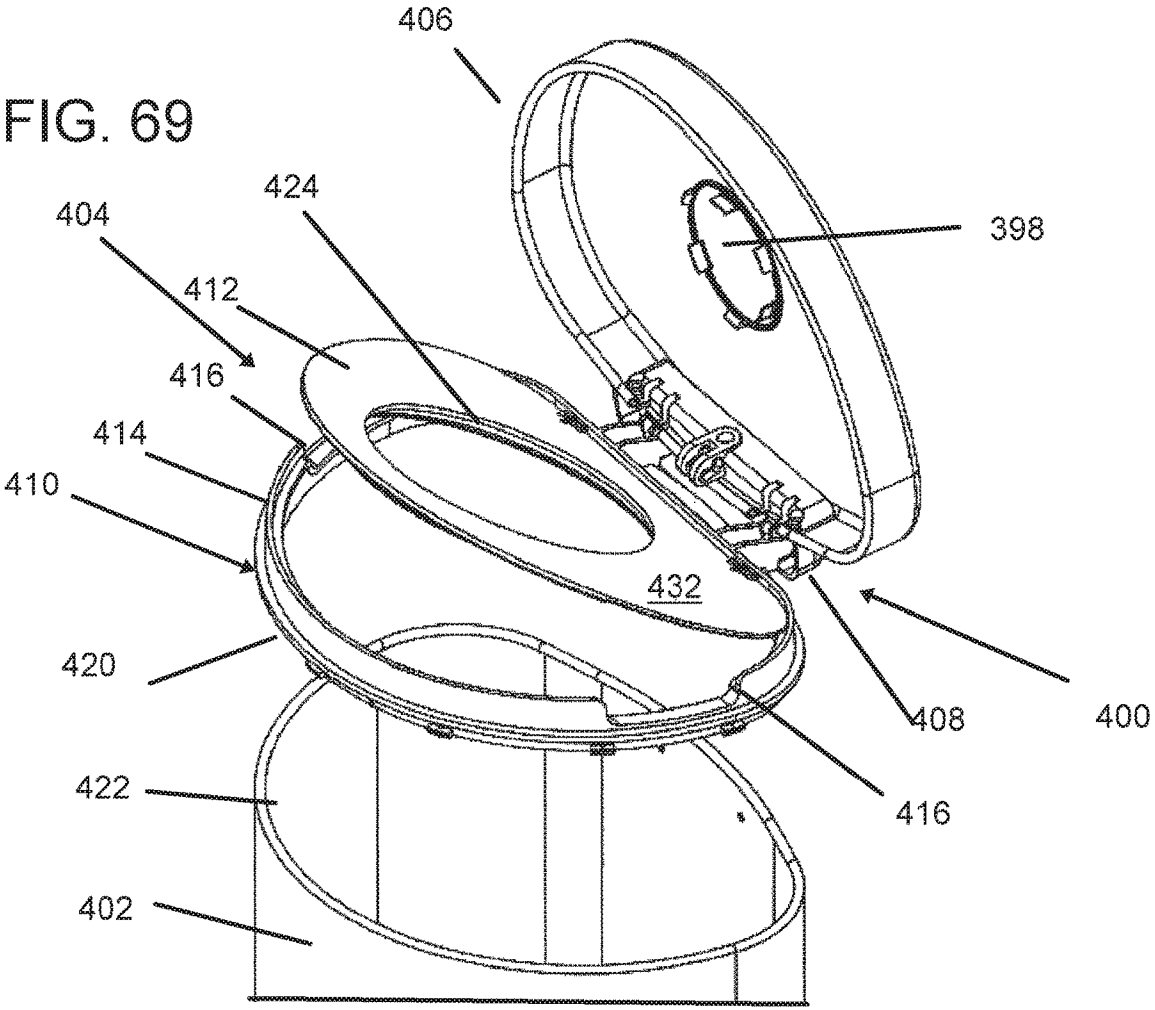
FIG. 69 is a perspective view of part of the waste disposal device shown in FIG. 66 without the bag and an optional membrane, and with the closure component pivoted upward.

Closure component and lid assembly 400 includes a closure component portion 404 attached to a lid 406 via an attachment structure 408. A waste treatment component 398, only part of which is shown in FIGS. 66-72, may be situated on the underside of the lid 406. Closure component portion 404 includes a support portion 410 and a closure component 412 pivotally attached to the support portion 410 (see FIGS. 66 and 67). Support portion 410 includes a peripheral wall 414 that has one or more cut-out portions 416 to facilitate pivotal movement of the closure component 412 from a position in which it rests on the ledge 418 (which ledge 418 is shown in FIG. 68). Support portion 410 also includes a first part 420 of cooperating mating structure that enables it to be secured to the top of the pail 402. The pail 402 includes the other, complementary part 422. The complementary parts 420, 422 may simply be a particular shape or form that allows for secure placement of the support portion 410 onto the pail 402.

Closure component 412 generally has the same cross-sectional shape as the cross-sectional shape of the pail 402 and support portion 410 parallel to a surface on which the closure component and bag assembly 400 rests. Closure component 412 defines an opening 424 and optionally includes or retains a membrane 426 that is situated in the opening 424 and may be releasably or permanently attached to a generally planar portion of the closure component 412. Membrane 426 includes a plurality of slots between fingers of the membrane 426 that provide the membrane 426 with flexibility to enable insertion of waste into a bag 428 that overlies the membrane 426 with a portion of the bag 428 being passed through a central opening 430 of the membrane 426 (see FIGS. 67, 68 and 72).

Figure 72:
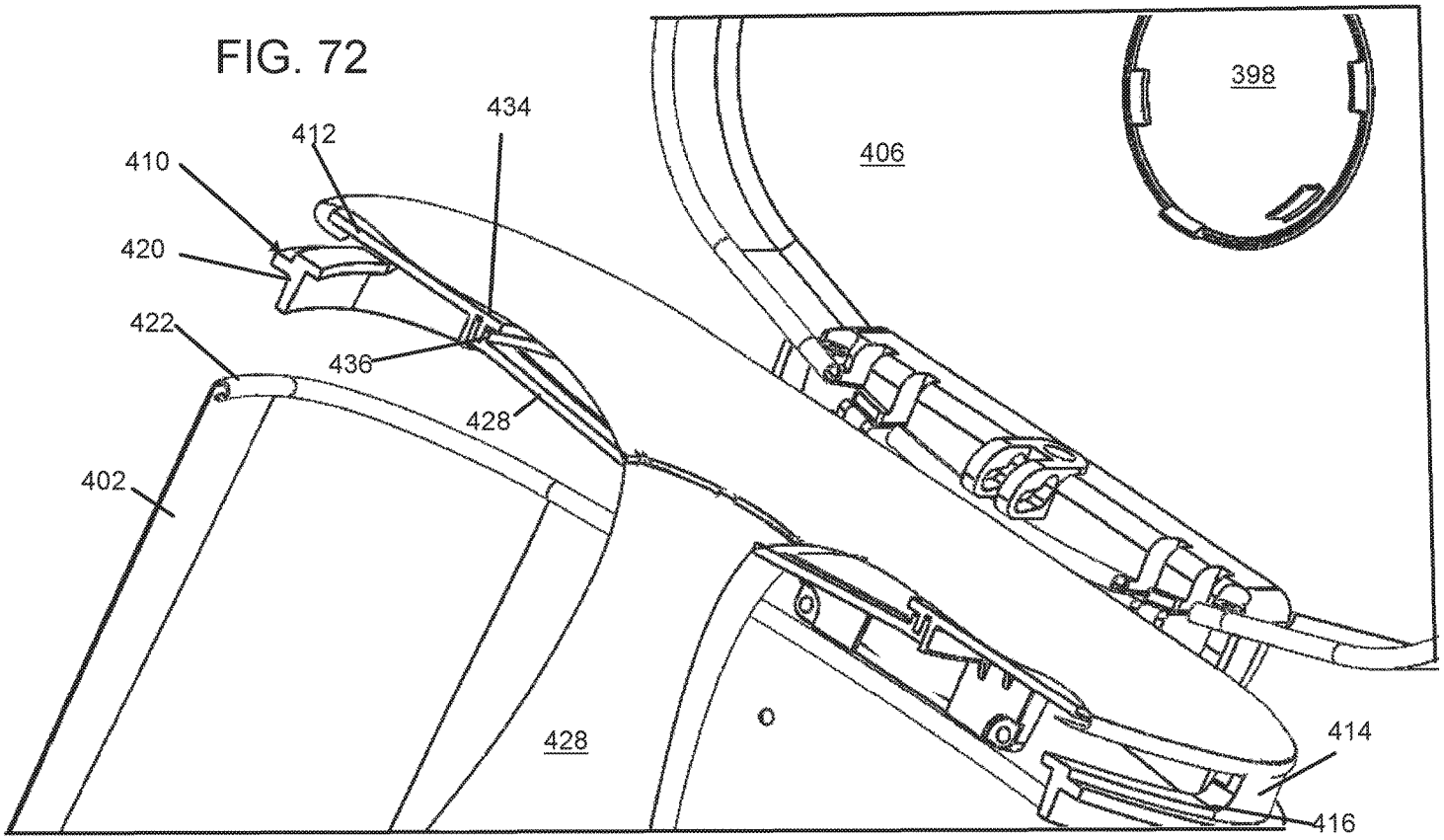
FIG. 72 is a view similar to FIG. 70 but wherein the waste disposal device includes a membrane.

Attachment of the membrane 426 to a planar portion 432 of the closure component 412 is made by a press fit or interference fit (see FIG. 72). To this end, a rim 434 around the opening 424 includes a projection and groove (see FIGS. 70-72), while the peripheral edge 436 of the membrane 426 has a mating form (see FIG. 72).

Trapping of the bag 428 is achieved by placing an upper edge of the bag 428 around the edge of the closure component 412 when apart from the support portion 410, and then pivoting the closure component 412 to rest on the support portion 410. In the final position, the bag 428 is wrapped around the closure component 412.

Figure 70:
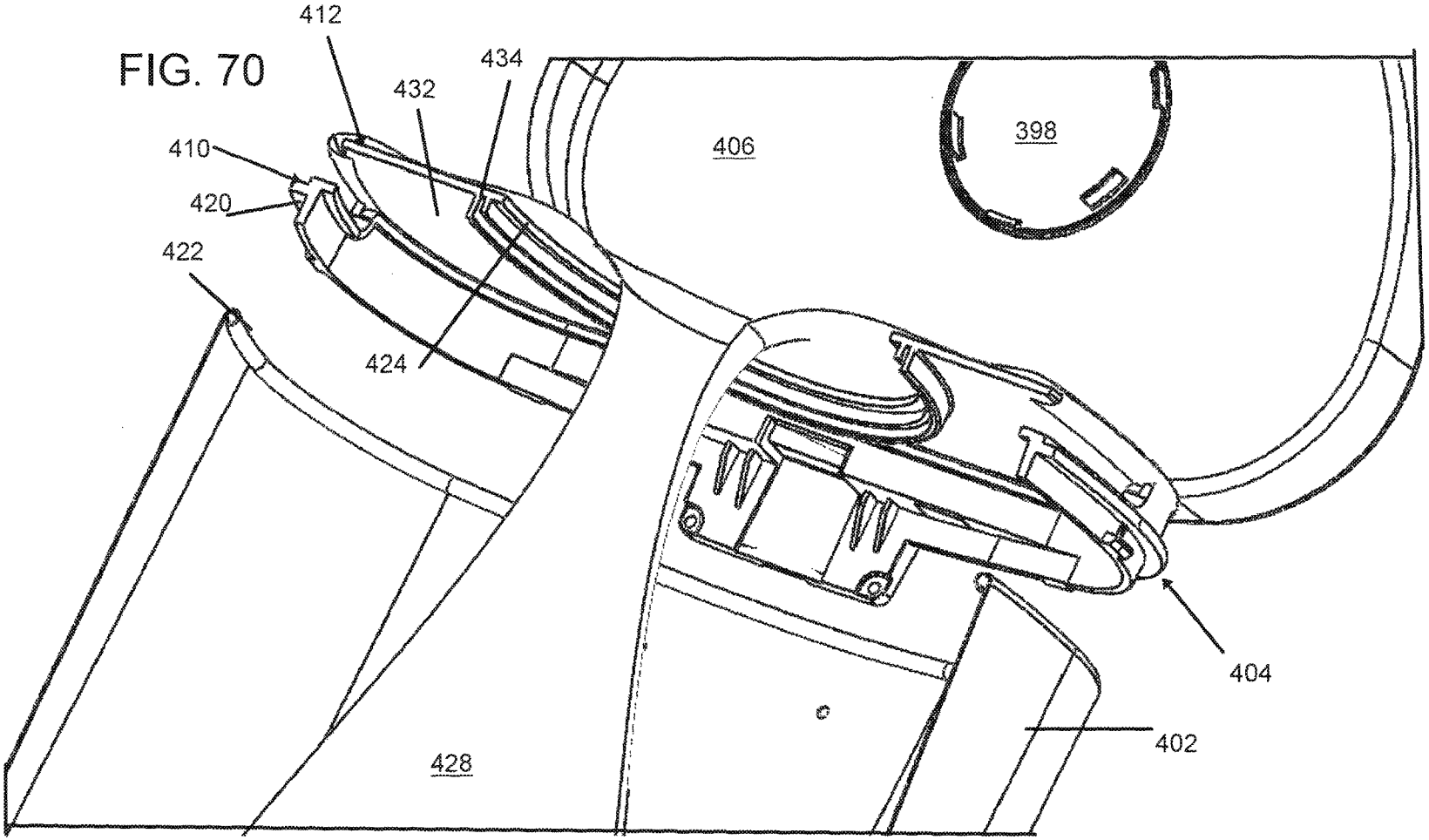
FIG. 70 is a cross-sectional view of part of the waste disposal device shown in FIG. 69 with a bag and in a state wherein a closure component and bag assembly is separated from its base.
Figure 71:
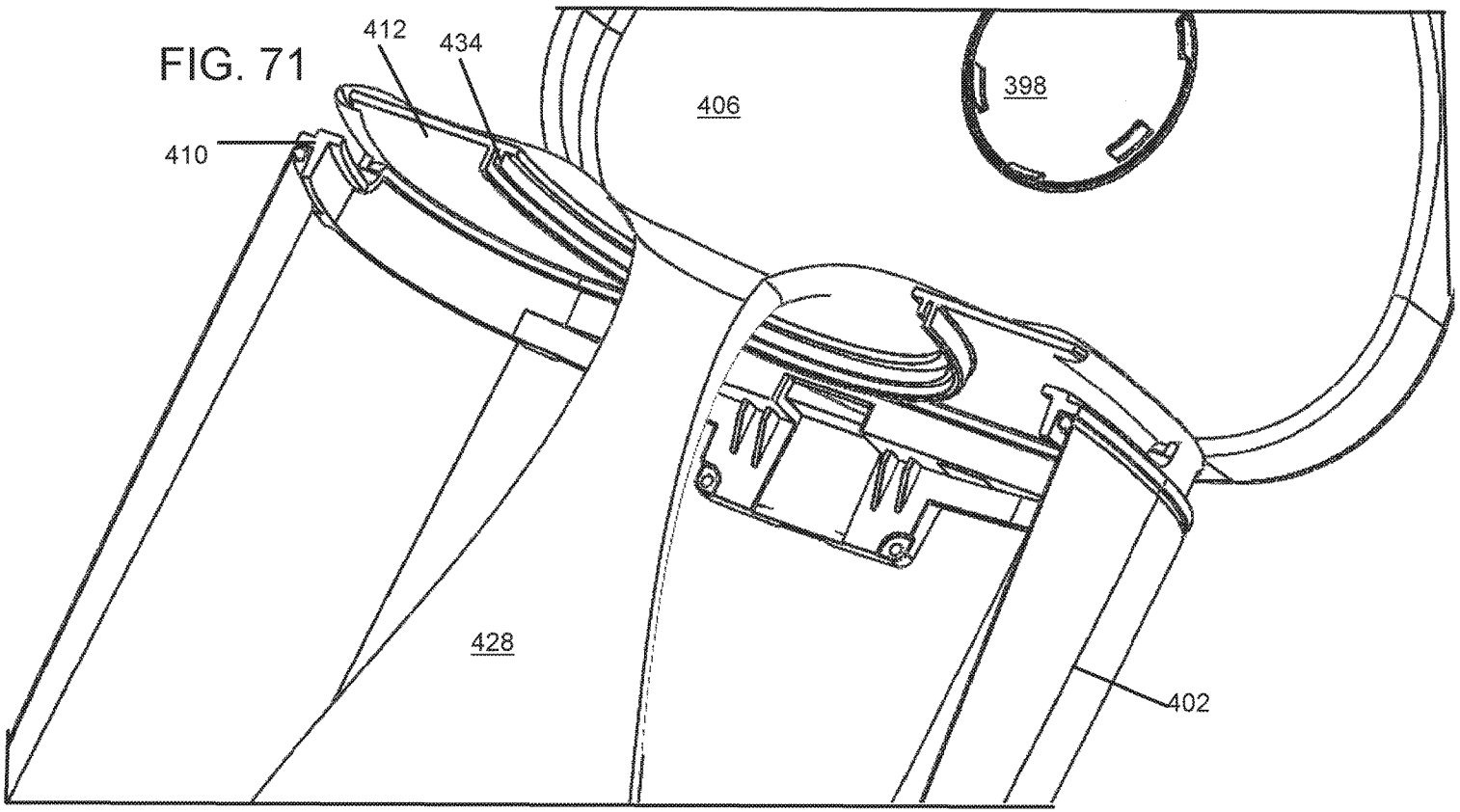
FIG. 71 is a cross-sectional view of part of the waste disposal device shown in FIG. 69 with a bag and in a state wherein the closure component and bag assembly rests on its base.

The closure component and bag assembly 400 with the bag 428 thus trapped is then engaged with the pail 402. For example, FIG. 70 shows the closure component and bag assembly 400 including a bag 428 but apart from the pail. From this state, the closure component and bag assembly 400 is position on the pail 402 to bring it into the state shown in FIG. 71, with the first part 420 resting on the second part 422 of the cooperating mating structure.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. Indeed, combinations of features of two or more of the inserts disclosed herein, e.g. the shape of one and the bag retention mechanism of another, may be used together to create a new insert. All such combinations and permutations of features of the inserts disclosed herein are considered part of the invention.

The invention claimed is:

1. An insert for a container, comprising:

a lower bag support structure defining an aperture and having a substantially planar portion around said aperture, said lower bag support structure having an upper surface and including at least one bag-engagement surface on an upper side of said planar portion, said lower bag support structure including an outer edge region defining an exposed outer edge of said lower bag support structure facing away from said aperture;

an upper bag support structure having a first state in which said upper bag support structure is connected to said lower bag support along a periphery of said planar portion of said lower bag support structure and also engages with said at least one bag-engagement surface of said lower bag support structure inward of the periphery of said planar portion of said lower bag support structure to thereby provide multiple engagement locations between said upper and lower bag support structures when said upper bag support structure in is the first state, said upper bag support structure having a second state in which said upper bag support structure is connected to said lower bag support structure along the periphery of said planar portion of said lower bag support structure and does not engage with said at least one bag-engagement surface of said lower bag support structure inward of the periphery of said lower bag support structure to thereby enable insertion and removal of a bag between said upper and lower bag support structures inward of the periphery of said planar portion of said lower bag support structure when said upper bag support structure is in the second state, said upper bag support structure comprising first and second walls defining a channel therebetween, said at least one bag-engagement surface of said lower bag support structure comprising first and second bag-engagement edges that enter into said channel when said upper bag support structure is in the first state, the insert being configured to exert pressure to retain the bag between said upper and lower bag support structures when said upper bag support structure is in the first state with said upper bag support structure engaging with said at least one bag-engagement surface of said lower bag support structure inward of the periphery of said planar portion of said lower bag support structure, said upper and lower bag support structure being a unitary structure when said upper bag support structure is connected to said lower bag support structure along the periphery of said planar portion of said lower bag support structure; and an attachment structure that enables said upper bag support structure to move between the first and second states, said attachment structure including a first part arranged on said lower bag support structure, a second part arranged on said upper bag support structure, and a pivot pin mounted between said first and second parts and arranged above said upper surface of said lower bag support structure, said first part of said attachment structure and said first and second bag-engagement edges being elevated in a common direction from said planar portion of said lower bag support structure, said first part of said attachment structure being situated between an exposed outer edge of said lower bag support structure defined by said outer edge region and said first and second bag-engagement edges.

2. The insert of claim 1, wherein said pivot pin of said attachment structure is configured to enable said upper bag support structure to pivot upward relative to said lower bag support structure.

3. The insert of claim 1, wherein said lower bag support structure is annular.

4. The insert of claim 1, wherein said lower bag support structure comprises an annular disc.

5. The insert of claim 1, wherein said upper and lower bag support structures are annular when said upper bag support structure is in the first state.

6. The insert of claim 1, wherein said upper bag support structure comprises a tab configured to allow pressure exerted to an underside of said tab to cause separation of said upper bag support structure from said lower bag support structure when said upper bag support structure is in the first state to thereby enable said upper bag support structure to be moved to the second state.

7. The insert of claim 6, wherein said tab is configured such that the underside of said tab faces toward said planar portion of said lower bag support structure.

8. The insert of claim 1, wherein said first and second walls are circular and at different radial distances from a center of said aperture.

9. The insert of claim 1, further comprising at least one projection projecting outward from an outer peripheral edge region of said lower bag support structure.

10. An insert for a container, comprising:

a lower bag support structure defining an aperture and including at least one bag-engagement surface on an upper side that comprises first and second bag-engagement edges, said lower bag support structure having an upper surface and an outer edge region defining an exposed outer edge of said lower bag support structure facing away from said aperture;

an upper bag support structure including first and second walls defining a channel therebetween; and an attachment structure that enables said upper bag support structure to pivot relative to said lower bag support structure, said attachment structure enabling the insert to have a first state in which said first and second bag-engagement edges of said lower bag support structure enter into said channel of said upper bag support structure while said attachment structure connects said upper and lower bag support structures together and to have a second state in which said first and second bag-engagement edges of said lower bag support structure do not enter into said channel of said upper bag support structure while said attachment structure connects said upper and lower bag support structures together, said attachment structure including a first part arranged on said lower bag support structure, a second part arranged on said upper bag support structure, and a pivot pin mounted between said first and second parts and arranged above said upper surface of said lower bag support structure, said first part of said attachment structure and said first and second bag-engagement edges being elevated in a common direction from said upper surface of said lower bag support structure, said first part of said attachment structure being situated between an exposed outer edge of said lower bag support structure defined by said outer edge region and said first and second bag-engagement edges, the insert being configured to exert pressure to retain a bag between said upper and lower bag support structures when the insert is in the first state with said first and second bag-engagement edges of said lower bag support structure entering into said channel of said upper bag support structure, said upper and lower bag support structure being a unitary structure when said upper bag support structure is connected to said lower bag support structure by said attachment structure.

11. The insert of claim 10, wherein said upper and lower bag support structures are annular when the insert is in the first state.

12. The insert of claim 10, wherein said upper bag support structure comprises a tab configured to allow pressure exerted to an underside of said tab to cause separation of said upper bag support structure from said lower bag support structure when the insert is in the first state to thereby enable the insert to be moved to the second state.

13. The insert of claim 10, wherein said first and second walls are circular and at different radial distances from a center of said aperture.

14. A waste container for use with a bag, comprising:

a base defining a waste-receiving compartment;

an insert supported on said base; and a lid attached to said base and that is movable between a first, closed position covering said insert and a second, open position in which said lid does not obstruct access to said insert, said insert comprising a lower bag support structure defining an aperture and having a substantially planar portion around said aperture, said lower bag support structure having an upper surface and including at least one bag-engagement surface on an upper side of said planar portion, said lower bag support structure including an outer edge region defining an exposed outer edge of said lower bag support structure facing away from said aperture;

an upper bag support structure having a first state in which said upper bag support structure is connected to said lower bag support structure along a periphery of said planar portion of said lower bag support structure and also engages with said at least one bag-engagement surface of said lower bag support structure inward of the periphery of said planar portion of said lower bag support structure to thereby provide multiple engagement locations between said upper and lower bag support structures when said upper bag support structure in is the first state, said upper bag support structure having a second state in which said upper bag support structure is connected to said lower bag support structure along the periphery of said planar portion of said lower bag support structure and does not engage with said at least one bag-engagement surface of said lower bag support structure inward of the periphery of said lower bag support structure to thereby enable insertion and removal of a bag between said upper and lower bag support structures inward of the periphery of said planar portion of said lower bag support structure when said upper bag support structure is in the second state, said upper bag support structure comprising first and second walls defining a channel therebetween, said at least one bag-engagement surface of said lower bag support structure comprising first and second bag-engagement edges that enter into said channel when said upper bag support structure is in the first state, the insert being configured to exert pressure to retain the bag between said upper and lower bag support structures when said upper bag support structure is in the first state with said upper bag support structure engaging with said at least one bag-engagement surface of said lower bag support structure inward of the periphery of said planar portion of said lower bag support structure, said upper and lower bag support structure being a unitary structure when said upper bag support structure is connected to said lower bag support structure along the periphery of said planar portion of said lower bag support structure; and an attachment structure that enables said upper bag support structure to move between the first and second states, said attachment structure including a first part arranged on said lower bag support structure, a second part arranged on said upper bag support structure, and a pivot pin mounted between said first and second parts and arranged above said upper surface of said lower bag support structure, said first part of said attachment structure and said first and second bag-engagement edges being elevated in a common direction from said planar portion of said lower bag support structure, said first part of said attachment structure being situated between an exposed outer edge of said lower bag support structure defined by said outer edge region and said first and second bag-engagement edges.

15. The container of claim 14, wherein said pivot pin of said attachment structure is configured to enable said upper bag support structure to pivot upward relative to said lower bag support structure.

16. The container of claim 14, wherein said lower bag support structure is annular.

17. The container of claim 14, wherein said lower bag support structure comprises an annular disc.

18. The container of claim 14, wherein said upper and lower bag support structures are annular when said upper bag support structure is in the first state.

19. The container of claim 14, wherein said upper bag support structure comprises a tab configured to allow pressure exerted to an underside of said tab to cause separation of said upper bag support structure from said lower bag support structure when said upper bag support structure is in the first state to thereby enable said upper bag support structure to be moved to the second state.

20. The container of claim 14, further comprising at least one projection projecting outward from an outer peripheral edge region of said lower bag support structure.

* * * * *